US006629785B2

(12) United States Patent
Ishikawa

(10) Patent No.: US 6,629,785 B2
(45) Date of Patent: Oct. 7, 2003

(54) METHOD AND APPARATUS FOR PROCESSING SILVER HALIDE COLOR PHOTOGRAPHIC LIGHT-SENSITIVE MATERIAL

(75) Inventor: Takatoshi Ishikawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/984,195

(22) Filed: Oct. 29, 2001

(65) Prior Publication Data

US 2002/0048005 A1 Apr. 25, 2002

Related U.S. Application Data

(62) Division of application No. 09/571,869, filed on May 16, 2000.

(30) Foreign Application Priority Data

May 17, 1999 (JP) ..... 11-135918
Jun. 8, 1999 (JP) ..... 11-161242
Jun. 8, 1999 (JP) ..... 11-161243
Jun. 8, 1999 (JP) ..... 11-161244

(51) Int. Cl.[7] ..... G03D 3/02; G03D 13/00
(52) U.S. Cl. ..... 396/568; 396/578; 396/626
(58) Field of Search ..... 396/626, 578, 396/568; 355/27–29

(56) References Cited

U.S. PATENT DOCUMENTS 5,382,507 A * 1/1995 Shimizu et al. ..... 430/399
5,570,154 A * 10/1996 Kurimoto et al. ..... 396/568
5,852,755 A * 12/1998 Nakashima ..... 396/626

FOREIGN PATENT DOCUMENTS

JP 1-282553 * 11/1989
JP 03-134664 * 6/1991
JP 4-3288545 * 11/1992
JP A-9-204030 8/1997
JP 11-202493 * 7/1999

OTHER PUBLICATIONS

JP 08/030167, Aug. 8, 1997, Abstract.

JP 09/211815, Aug. 15, 1997, Abstract and Partial English Language Translation.

JP 09/204030, Aug. 5, 1997, Abstract and Partial English Language Translation.

* cited by examiner

*Primary Examiner*—D. Rutledge
(74) *Attorney, Agent, or Firm*—Sughrue Mion, PLLC

(57) ABSTRACT

A method for processing a silver halide color photographic light-sensitive material is disclosed, comprising processing a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, wherein both the replenishing amount and the concentration of the replenisher for the color developer are changed according to the processed amount of said two types of light-sensitive materials.

4 Claims, 9 Drawing Sheets

METHOD AND APPARATUS FOR PROCESSING SILVER HALIDE COLOR PHOTOGRAPHIC LIGHT-SENSITIVE MATERIAL

This is a divisional of application Ser. No. 09/571,869 filed May 16, 2000, the disclosure of which is incorporated herein by reference.

FIELD OF THE INVENTION

The present invention relates to a method and an apparatus for processing silver halide color photographic light sensitive materials, more specifically, the present invention relates to a processing method where even when light-sensitive materials having emulsions different in the silver halide composition and being different in the development behavior are processed in mixture, excellent photographic properties of respective light-sensitive materials can be maintained. The present invention provides a processing method and a processing apparatus, which can simultaneously process light-sensitive materials having emulsions different in the silver halide composition by a simple modification.

BACKGROUND OF THE INVENTION

Among silver halide color photographic light-sensitive materials, the photographic film light-sensitive material for use in taking a picture by camera work (hereinafter sometimes referred to as a "film") is large in the coated silver amount as compared with printing materials (hereinafter sometimes referred to as a "print"), therefore, a large load is imposed on the development step or desilvering step and the development processing time is generally long.

In recent years, color laboratories are overspread and small color laboratories called mini-lab for performing the development processing (hereinafter simply referred to as "processing") at the shop-front of photographic shops in the city are increased. Thus, the tendency is apparently turning from conventional collection-and-delivery processing which is conditioned on collection and delivery, to the shop-front processing performed at the mini-lab. In the shop-front processing, reduction in the time until finish and delivery is particularly a matter of importance. Among the processing operations, the processing of a film takes a long time and reduction in the time necessary for this processing is demanded.

In order to shorten the film processing step, a film containing a high silver chloride emulsion in which the main component of silver halide is silver chloride is disclosed to take the place of conventional films containing a high silver bromide emulsion in which the main component of silver halide is silver bromide. As compared with the latter case, the emulsion in the former film has excellent effect in attaining a rapid processing or reducing the replenishing amount, because the reaction rate at the development is high and iodide ion working out to an inhibitor at the fixing processing is scarcely released. With respect to the example of this high silver chloride emulsion, JP-A-63-2129932 (the term "JP-A" as used herein means an "unexamined published Japanese patent application") discloses a technique containing a high silver chloride emulsion having a (111) face and U.S. Pat. No. 5,264,337 discloses a tabular emulsion having a (100) face.

The material for photographing (i.e., film) using this high silver chloride emulsion has a possibility that it can be processed with a processing solution common to that for color paper (print) which similarly uses a high silver chloride emulsion. EP-617325A and JP-A-7-270991 disclose this technique.

Although the high silver chloride-type photographing material is advantageous in its excellent rapid developability, the current color photographic and color laboratory market is constructed by high silver bromide-type photographing materials and a system for developing the high silver chloride-type photographing material is not present. If a high silver chloride-type photographing material is introduced, propagated and raised to a predominant photographing material in the market and along with it, an exclusive development service network is completed, users could enjoy many merits. However, at the initial stage in the introduction of high silver chloride photographing materials, since a satisfactory development service network capable of coping with the new processing for the photographing materials introduced is not established, the development service thereof must be furnished by the existing processing system for films using a high silver bromide emulsion. In other words, at the initial stage in the introduction of high silver chloride photographing materials, it is anticipated that new and old light-sensitive materials are processed in mixture. In this case, the composition of the color developer greatly changes, particularly, the bromide ion concentration greatly changes, to cause extreme fluctuation in the photographic properties (particularly sensitivity and gradation) of both the light-sensitive material having a silver iodobromide emulsion and the light-sensitive material having a high silver chloride emulsion, therefore, the photographic performance cannot be maintained and a countermeasure therefor is necessary. Needless to say, when the switch to the photographing materials having a high silver chloride emulsion is completed on the market, the development processing thereof can be dedicatedly performed and the above-described problem can be overcome.

At the stage of introducing high silver chloride photographing materials, even when the processing thereof must be shared with conventional high silver chloride photographing materials, if the replenisher for conventional high silver chloride photographing materials can be used, the difficulties standing as an obstacle to the introduction of the new photographing material can be eliminated. Under these circumstances, a new replenishing system capable of realizing the common use of the replenisher is being demanded.

With respect to the apparatus for processing light-sensitive materials photographing, an apparatus described in JP-A-9-43806 may be used, for example. This apparatus comprises replenishing tanks for housing thick replenishers prepared by concentrating various processing solutions and a water replenishing tank for housing a diluting water for diluting the thick processing solution. In each replenishing or water replenishing tank, a passage line extending to the processing tank is provided. At the replenishing time, a pump provided to each passage line is operated and the thick replenishers and the diluting water can be fed to the processing tank to supply the developer replenisher. According to this apparatus, it is said that the processing solution stored in the processing tank can be prevented from the liquid exhaustion accompanying the processing and the water content evaporated can be supplemented.

However, even this development processing apparatus encounters difficulties in maintaining the photographic properties when the processing must be shared with conventional high silver bromide photographing materials at the stage of introducing high silver chloride photographing materials. Accordingly, a new replenishing system capable of correctly processing those two types of photographing materials is being demanded.

Furthermore, for example, JP-A-5-107712 describes an apparatus for processing light-sensitive materials for photographing. This apparatus comprises a processing tank for filling processing solutions for use in the processing of light-sensitive materials, an auxiliary tank for passing a processing solution into the processing tank, and a solid processing agent feeding unit for feeding a replenisher solid processing agent for maintaining the capability of the processing agent to the auxiliary tank, where the feeding unit is designed to work when the accumulated area of light-sensitive materials used reaches a predetermined value.

In addition, for example, JP-A-4-213454 describes an apparatus for processing light-sensitive materials for photographing. This apparatus comprises processing tanks for filling processing solutions for use in the processing of light-sensitive materials and an auxiliary tank for passing a processing solution to the processing tank, where the processing solution is obtained by dissolving a powdered processing agent in a solvent and an adding unit for adding the powdered processing agent to the auxiliary tank is provided.

Even in the processing apparatus using this replenishing system, a new replenishing method is being demanded, which can correctly process two types of photographing materials when high silver chloride photographing materials are introduced and the processing thereof must be shared with conventional high silver bromide photographing materials.

Still further, for example, JP-A-8-248606 and JP-A-8-234389 describe an apparatus for processing light-sensitive materials for photographing, in which a thick developer replenisher is prepared by dissolving or diluting a mixed processing agent in or with water and the thick replenisher is charged into a developing tank. In this type of apparatus, a mixed processing agent for the developer replenisher and water for dissolving or diluting the mixed processing agent are fed to a replenisher tank provided in the apparatus and mixed to previously prepare a concentrated developer replenisher and the replenisher is stored. At the replenishing time, the replenisher is appropriately supplied to supplement the deteriorated consumed components.

In the developing tank, water evaporates with the passing of time and the water evaporated must be supplemented. The above-described water for preparing a developer replenisher is used also as a supplementary water and the water reduced by the evaporation is appropriately supplemented from a water tank.

In other words, the apparatus described in that patent publication has a system of independently supplying the concentrated developer replenisher and the water supplementary for the evaporation.

Even in the processing apparatus using this replenishing system, a new replenishing method is being demanded, which can correctly process two types of photographing materials when high silver chloride photographing materials are introduced and the processing thereof must be shared with conventional high silver bromide photographing materials.

SUMMARY OF THE INVENTION

Accordingly, an object of the present invention is to provide a processing method and an apparatus, in which even when light-sensitive materials for photographing having emulsions different in the silver halide composition are processed in mixture, both types of light-sensitive materials can have stable photographic property. In particular, the object of the present invention is to provide a processing method and an apparatus, in which conventional processing agents and processing apparatuses can be used in common and at the same time, the load in the modification of the processing apparatus is small.

The object of the present invention can be attained by the following processing method and apparatus of the present invention, which are practicable and cause no trouble in the color laboratory market. The embodiment and preferred embodiments of the present invention are described below.

(1) A method for processing a silver halide color photographic light-sensitive material, comprising processing a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, wherein both the replenishing amount and the concentration of the replenisher for the color developer are changed according to the processed amount of the two types of light-sensitive materials.

(2) The method for processing a silver halide color photographic light-sensitive material as described in (1) above, wherein the change in the replenishing amount and the concentration of the color developer replenisher according to the processed amount of the color photographic light-sensitive material A and the color photographic light-sensitive material B is performed to maintain the bromide ion concentration in the developer tank within the allowable range including the standard concentration.

(3) The method for processing a silver halide color photographic light-sensitive material as described in (1) or (2) above, wherein the change in the replenishing amount and the concentration of the color developer replenisher according to the processed amount of the color photographic light-sensitive material A and the color photographic light-sensitive material B is performed to maintain both the bromide ion concentration and the color developing agent concentration in the developing tank within respective allowable ranges including respective standard concentrations.

(4) The method for processing a silver halide color photographic light-sensitive material as described in any one of (1) to (3), wherein the change in the concentration of the color developer replenisher is performed by changing only the amount of water for dissolving the constituent chemicals without changing the relative quantitative relationship among the chemicals in the formulation of the replenisher.

(5) The method for processing a silver halide color photographic light-sensitive material as described in any one of (1) to (4) above, wherein the high silver bromide emulsion contained in said color photographic light-sensitive material A is a silver iodobromide emulsion containing from 0.1 to 15 mol % of iodide ion.

(6) The method for processing a silver halide color photographic light-sensitive material as described in any one of (1) to (4) above, wherein the high silver chloride emulsion contained in said color photographic light-sensitive material B comprises tabular silver halide grains having a (100) face as the main plane and having a silver chloride content of from 50 to 100 mol %.

(7) The method for processing a silver halide color photographic light-sensitive material as described in any one of (1) to (6) above, wherein the common developer replenisher for simultaneously processing both said color photographic light-sensitive material A and said color photographic light-sensitive material B is a replenisher in which the composition of constituent chemicals is the same as the composition of constituent chemicals in the formulation of a replenisher designed to process said color photographic light-sensitive material A alone and the amount of water for dissolving the constituent chemicals is changed from the amount of water in said replenisher formulation.

(8) The method for processing a silver halide color photographic light-sensitive material as described in (1) above, comprising processing a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, wherein the developer replenisher is supplied by a method of feeding a thick replenisher resulting from the concentration of the developer replenisher and a diluting water for diluting the thick replenisher each directly to the developing tank and wherein the feeding amount of the diluting water is changed to change both the concentration of the developer replenisher and the replenishing amount of the developer replenisher per the unit processing area according to the processed amounts of two types of light-sensitive materials.

(9) An apparatus for processing silver halide color photographic light-sensitive materials, which processes a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, the apparatus comprising a developing tank for storing a developer, a thick replenisher feeding means for feeding a thick replenisher prepared by concentrating a developer replenisher directly to the developing tank, a diluting water feeding means for feeding a diluting water for diluting the thick replenisher to the developing tank, a processed amount setting means for setting respective processed amounts of the light-sensitive materials, and a diluting water feeding controlling means for changing the feeding amount of the diluting water to change both the concentration of the developer replenisher and the replenishing amount of the developer replenisher per the unit processing area according to respective processed amounts of the light-sensitive materials.

(10) The method for processing a silver halide color photographic light-sensitive material as described in (1) above, comprising processing a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, wherein the two kinds of color photographic light-sensitive materials both are developed by a method of individually charging a solid processing agent and a diluting water into a developing tank and wherein both the replenishing amount and the concentration of the color developer replenisher are substantially changed according to the processing ratio between two types of light-sensitive materials by changing the interval in the charging of the solid processing agent and/or the feeding amount of the diluting water.

(11) An apparatus for processing silver halide color photographic light-sensitive materials, which processes a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, the apparatus comprising a developing tank for storing a developer, a solid processing agent feeding means for feeding a solid processing agent at predetermined intervals to the developing tank, a diluting water feeding means for feeding a diluting water for dissolving the solid processing agent to the developing tank, a processed amount setting means for setting respective processed amounts of the light-sensitive materials, and a replenishment controlling means for changing the charging interval of the solid processing agent and/or the feeding amount of the diluting water to substantially change both the replenishing amount and the concentration of the replenisher according to the processing ratio between the two types of light-sensitive materials.

(12) The method for processing a silver halide color photographic light-sensitive material as described in (1, comprising processing a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, wherein both the color photographic light-sensitive material A and the color photographic light-sensitive material B are developed by a method of individually charging a solid processing agent and a diluting water into a developing tank and wherein both the replenishing amount and the concentration of the color developer replenisher are substantially changed according to the processing ratio between two types of light-sensitive materials by changing the charged amount of the diluting water.

(13) An apparatus for processing silver halide color photographic light-sensitive materials, which processes a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, the apparatus comprising a developing tank for storing a developer, a solid processing agent feeding means for feeding a solid processing agent at predetermined intervals to the developing tank, a diluting water feeding means for feeding a diluting water for dissolving the solid processing agent to the developing tank, a processed amount setting means for setting respective processed amounts of the light-sensitive materials, and a replenishment controlling means for changing the feeding amount of the diluting water per the unit processing area to substantially change both the replenishing amount and the concentration of the replenisher according to the processing ratio between the two types of light-sensitive materials.

(14) The method for processing a silver halide color photographic light-sensitive material as described in (1) above, comprising processing a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, wherein the developer replenisher is supplied by a method of dissolving or diluting a mixed processing agent for the developer replenisher in or with water to prepare a developer replenisher and supplying the replenisher to the developing tank, and the amount of water for the mixing of the replenisher is changed to change both the concentration of the replenisher and the replenishing amount of the replenisher per the unit processing area according to the processing ratio between two types of light-sensitive materials.

(15) An apparatus for processing silver halide color photographic light-sensitive materials, which processes a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, the apparatus comprising a developing tank for storing a developer, a replenisher tank for storing a developer replenisher, a reservoir tank for storing water for dissolving or diluting a mixed processing agent for the developer replenisher supplied to the replenisher tank, a water feeding means for feeding the water to the replenisher tank, a processed amount setting means for setting respective processed amounts of the light-sensitive materials, and a replenishment controlling means for changing both the amount of the water supplied to the replenisher tank and the replenishing amount of the replenisher per the unit processing area at the mixing of the replenisher to change both the concentration and the replenishing amount of the developer replenisher according to respective processed amounts of the light-sensitive materials.

(16) The processing method as described in (14) above, wherein the replenishing amount of the replenisher is changed by changing the unit replenishing amount of the replenisher per once mixing.

(17) The processing method as described in (14) above, wherein the replenishing amount is changed by changing the interval in supplying the replenisher.

2 Developing tank

4 Replenisher

Figure 1:
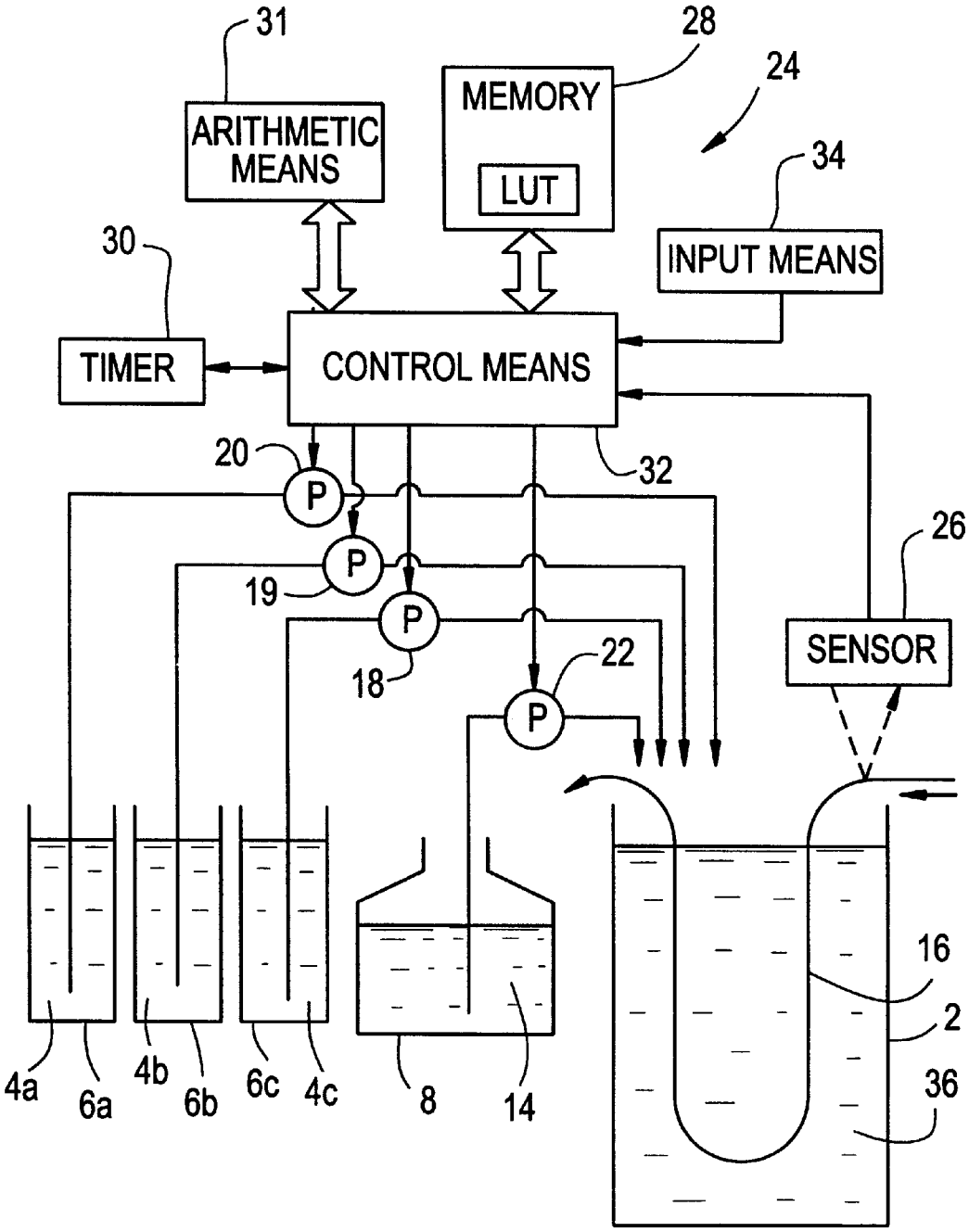
FIG. 1 is a block diagram of a replenishing unit.

4*a,* 4*b,* 4*c* Agent A, agent B and agent C (thick replenisher)

6 Replenishing tank

8 Diluting water tank (or dissolving water tank)

10 Solid processing agent (or mixed processing agent for developer replenisher)

12 Container

13 Solid processing agent feeding unit

14 Diluting water (or dissolving water)

16 Light-sensitive material

18, 19, 20, 22 Pump

24 Replenishment controlling unit

26 Sensor

28 Memory

30 Timer

31 Arithmetic means

34 Input means

36 Developer

38 Input means

DETAILED DESCRIPTION OF THE INVENTION

Specific embodiments of the method for processing silver halide color photographic materials of the present invention are described in detail below.

The silver halide color photographic light-sensitive materials for photographing currently distributed on the color photographic market are a material containing a high silver bromide emulsion having a silver bromide content of from 50 to 100 mol % (hereinafter referred to as a photographing material A or film A). On the global color photographic market, light-sensitive materials containing the corresponding high silver bromide emulsion are available from respective manufacturers of light-sensitive materials. At the color laboratories, the same development processing is performed irrespective of manufacturers, therefore, in the present invention, these materials all are referred to as a photographing material A or film A.

On the other hand, the silver halide color photographic light-sensitive material for photographing, of which introduction is demanded because of its advantageous properties such as rapid processability, is a material containing a high silver chloride emulsion having a silver chloride content of from 50 to 100 mol % (hereinafter referred to as a photographing material B or film B). Similarly to the film A, the films of this type all are referred to as film B irrespective of manufacturers as a supplier of the light-sensitive material.

With respect to the method for processing a film A and a film B with a common color developer, JP-A-9-204030 discloses a processing method where two kinds of replenishers different in the bromide ion concentration are prepared based on the silver bromide contents and the processed amounts of those two films. In the present invention, however, not only the replenishing amount of the color developer replenisher but also the concentration of the replenisher is changed according to the processed amounts of two films, whereby a simple and easy developing method favored with higher stability and dispensable with the control for every slight change in the processed amount can be obtained. Moreover, by changing both the replenishing amount and the concentration, the replenishing amount needs not be set high and practical replenishing can be performed with good profitability and reduced amount of waste solutions.

The term "concentration of the developer replenisher" as used herein means a concentration of constituent chemicals based on the total of an amount of water for dissolving and/or diluting constituent chemicals in the formulation of a thick replenisher and an amount of the thick replenisher. In other words, this term denotes a concentration obtained by changing the amount of the diluting water while keeping constant the relative relationship of the quantitative ratio among individual constituent chemicals of the thick replenisher.

In the present invention, the change of the replenishing amount and the concentration of the color developer replenisher in the common processing of a film A and a film B is performed such that the bromide ion concentration in the developing tank is maintained in an allowable range including the standard concentration. The term "standard concentration" as used herein means a concentration determined for achieving standard finish in the photographic properties of the film. The standard concentration is determined at the stage of designing the development processing and the development operation is performed to maintain this standard concentration. The allowable range of the concentration including the standard concentration, where the concentration in the developing tank can change, is determined such that the change in the photographic properties is maintained in their allowable range. The allowable range for the change in the photographic properties is a range where a large number of users satisfy the finish. This is specifically described in International Standard ISO 10977 and the like. In the present invention, the replenishing amount and the concentration of the replenisher are established so that the change of the bromide ion concentration can be maintained in this range.

The reason why both the replenishing amount and the concentration of the color developer replenisher is changed is specifically described below. When a film B is simultaneously processed in mixture in a developing apparatus under the development processing of a film A, if not applied any treatment, the bromide ion concentration in the developing tank decreases because the amount of bromide ion released from the film B into the developer is small, as a result, the finish film cannot be satisfied in the photographic properties. To cope with this, in general, change of the replenisher composition is required. In the present invention, however, the amount of the replenisher added to the developing tank is reduced with an attempt to maintain the bromide ion concentration in the developing tank (bromide ion is not contained in the replenisher or if contained, the concentration thereof is lower than the concentration in the developing tank). When the replenishing amount is reduced, even if the bromide ion concentration can be maintained, the concentrations of other constituent chemicals including the color developing agent cannot be maintained. Therefore, in the present invention, the concentration of the replenisher is also changed, whereby the concentrations of other constituent chemicals in the developing tank can be maintained. This is the essential point of the present invention where both the replenishing amount and the concentration are changed and thereby simultaneous development of two kinds of films can be realized. According to this method, even if the mixing ratio of the film B is changed, this can be coped with only by the change of the replenishing amount and the concentration (namely, the amount of water for dilution or dissolving used at the preparation) of the replenisher in use but the fundamental formulation of the replenisher needs not be changed.

Particularly, the replenishing amount and the concentration are more preferably changed so that not only the bromide ion but also the color developing agent can be maintained in the allowable range including the standard concentration thereof. As a standard in the development of ordinary color light-sensitive material for photographing, when the change of the bromide ion concentration in the developing tank is within ±10% (usually ±0.14 g/l) of the set concentration in the formulation, almost allowable photographic properties can be obtained, though it may vary more or less depending on the products of individual manufacturers. Furthermore, the color developing agent concentration can also be allowed to change in the range of ±10% (usually about 0.5 g/l) of the set concentration. With respect to the pH of the developer, the allowable change range is ±0.10. As such, the present invention is a method of maintaining the concentration or the pH, particularly the bromide ion concentration, of the developer replenisher in the developing tank by changing both the concentration and the replenishing amount of the developer replenisher according to the change in the mixing ratio of two kinds of light-sensitive materials, so that the photographic properties of two kinds of light-sensitive materials can be maintained in their allowable range.

Other methods for maintaining the photographic properties of light-sensitive materials by changing the concentration and the replenishing amount of the developer replenisher are described below.

According to the present invention, the feeding amount of the diluting water for diluting a thick replenisher (also called a concentrated replenisher) is changed, whereby the concentration of the developer replenisher can be controlled and at the same time, the replenishing amount of the developer replenisher per the unit processing area can be controlled.

With the increase in the processed amount of the light-sensitive material containing a high silver chloride emulsion, the bromide ion concentration in the developer gradually decreases and the originally required bromide ion concentration cannot be obtained. Therefore, the bromide ion concentration must be increased by some means. According to the present invention, as the processed amount of the light-sensitive material containing a high silver chloride emulsion increases, the amount of the developer replenisher is decreased from the replenishing amount till then to reduce the amount of the developer in the developing tank, whereby the bromide ion concentration in the developer can be increased and the originally required set value can be maintained. However, if only the amount of the developer replenisher is decreased, the amount of necessary developing agent, alkali or the like also decreases. Therefore, in the present invention, the concentration of the developer replenisher supplied is increased higher than the concentration till then, whereby even if the developer replenisher is supplied in a reduced amount, since the developer replenisher is concentrated, the necessary amount of the developing agent, alkali or the like can be ensured and the proper development capability can be maintained.

According to the present invention, the amount of the diluting water for dissolving a solid processing agent is changed and at the same time, the charging interval of the solid processing agent supplied to the developing tank is changed to the same interval as in conventional techniques or changed when required, whereby the replenishing amount and the concentration of the developer replenisher can be controlled. Therefore, the bromide ion concentration must be increased by some means. According to the present invention, as the processed amount of the light-sensitive material containing a high silver chloride emulsion increases, the amount of the developer replenisher is decreased from the replenishing amount till then to reduce the amount of the developer in the developing tank, whereby the bromide ion concentration in the developer can be increased and the originally required set value can be maintained. However, if only the amount of the developer replenisher is decreased, the amount of necessary developing agent, alkali or the like also decreases. Therefore, in the present invention, the concentration of the developer replenisher supplied is increased and the replenishing amount is decreased, whereby the desired composition can be maintained to a certain extent. In the case of a solid replenisher, the charged amount of the diluting water is changed, more specifically, the charged amount of the diluting water is decreased as compared with the charged amount in conventional techniques and at the same time, the charging interval of the solid processing agent is changed to the same as in conventional techniques or the interval is reduced according to the necessity, whereby the concentration of the replenisher can be substantially increased and the replenishing amount can be reduced. Even if the replenisher is supplied in a reduced amount, since the replenisher is concentrated, necessary ingredients can be ensured and proper development capability can be maintained. By increasing the amount of the solid processing agent per once charging, the replenisher can be substantially made to have a higher concentration, and by reducing the amount of the diluting agent (for example, increasing the charging intervals or reducing the amount in once charging), the replenishing amount can be reduced.

The solid processing agent defined in the present invention is a concept including tablet, granular and powdery processing agents. The developing tank is a concept including a processing tank filled with a processing solution for processing light-sensitive materials and an auxiliary tank for passing the processing solution into the processing tank.

According to the present invention, the amount of water for dissolving or diluting the mixed processing agent for the developer replenisher is changed, whereby the concentration of the developer replenisher can be controlled, and also the amount of the replenisher supplied to the developing tank is changed, whereby the replenishing amount per the unit processing area can be controlled.

With the increase in the processed amount of the light-sensitive material containing a high silver chloride emulsion, the bromide ion concentration in the developer gradually decreases and the originally required bromide ion concentration cannot be obtained. Therefore, the bromide ion concentration must be increased by some means. According to the present invention, as the processed amount of the light-sensitive material containing a high silver chloride emulsion increases, the amount of the developer replenisher is decreased from the replenishing amount till then to reduce the amount of the developer in the developing tank, whereby the bromide ion concentration in the developer can be increased and the originally required set value can be maintained. However, if only the amount of the developer replenisher is decreased, the amount of necessary developing agent, alkali or the like also decreases. Therefore, in the present invention, the concentration of the replenisher supplied is increased at the mixing of the developer higher than the concentration till then, whereby even if the replenisher is supplied in a reduced amount, since the replenisher is concentrated, the necessary amount of the developing agent, alkali or the like can be ensured and the proper development capability can be maintained.

In the present invention, the replenishing amount may be changed by changing the charging rate or interval of the concentrated replenisher.

Furthermore, the mixed processing agent for use in the present invention may be liquid or solid, more specifically, may have any shape such as concentrated solution, tablet, powder or granule.

The fundamental methods of the present invention are described above. In the following, specific embodiments of the application to individual predominant color developing methods are described. In the embodiments of the present invention described below, the term "both the replenishing amount and the concentration of the replenisher are changed" means that in the case where the replenisher is a liquid, the amount and the concentration of the liquid are changed and in the case where the replenisher is a solid, namely a solid processing agent (e.g., powder, granule, tablet), the weight of the solid and the amount of water (diluting water) per once charging, corresponding to the amount and the concentration of the equivalent liquid replenisher are changed. In the latter case, by changing the interval/rate in charging the solid and water (diluting water), "both the replenishing amount and the concentration of the replenisher can be changed" in substance.

At many color laboratories, particularly mini laboratories, the replenisher is prepared by dissolving or diluting a mixed processing agent supplied from the manufacturer of the processing agent, in or with water at a fixed ratio.

When the present invention is applied to a development processing which uses a mixed processing agent, a developer replenishing agent for the mixed processing agent supplied on the market is used as it is and the concentration of the color developer replenisher can be changed by changing the amount of water used for dissolving or diluting the replenishing agent at the preparation of a replenisher.

The mixed processing agent (including a solid processing agent other than those in the form of an aqueous solution) as the developer replenishing agent is a single composition in some cases or consists of a plurality of compositions (individual compositions are usually called a part) in other cases. In either case, at the preparation of a replenisher by dissolving or diluting the mixed processing agent in or with water, the concentration of the replenisher is changed by changing the amount of water for dissolving or diluting the mixed processing agent according to the present invention. This is simple and practical.

The mixed processing agent may be used by a system disclosed, for example, in JP-A-7-295190, where in spite of preparing a replenisher by mixing respective parts (including a single part structure) with water for dissolving or diluting them and charging the replenisher into a developing tank, respective parts and water are separately charged into a developing tank and these are substantially dissolved or diluted in the developing tank. In the case of applying the development processing method of the present invention to this system, a practically preferred embodiment is to change the concentration of the developer replenisher by changing the charged amount of water based on the charged amounts of respective parts and to change the replenishing amounts of the replenishing chemicals by changing the charging interval of respective parts of the processing agent. When a high silver chloride light-sensitive material is processed in mixture with a high silver bromide light-sensitive material, the pouring rate of water is decreased based on the pouring rate of each part, whereby the concentration of the replenisher added is increased and at the same time, the replenishing rate is reduced. The development processing method of the present invention can also be applied to the development processing apparatus descried in JP-A-9-43806.

The mixed processing agent may be used by a system disclosed, for example, in JP-A-5-107712, where a solid mixed processing agent consisting of parts (including a single part structure) and diluting water are separately charged into a developing agent. In the case of applying the development processing method of the present invention to this system, a practically preferred embodiment is to substantially change the concentration of the developer replenisher by changing the ratio of the charging interval or rate of water to the charging interval of each part and to substantially change the replenishing amount of the replenishing chemicals by changing the charging intervals of respective solid processing agent parts.

The general-purpose color development processing system includes a system described, for example, in JP-A-8-248606 and JP-A-8-234389, where a mixed processing agent is dissolved in water to prepare a concentrated developer replenisher and the concentrated replenisher and diluting water are charged into a developing tank. In this case, the replenishing amount is changed by changing the charging rate or interval of the concentrated replenisher and the concentrations of respective components including the bromide ion concentration are maintained by changing the charging interval (or rate) of the diluting water.

The film A for use in the present invention is a film containing a silver iodobromide emulsion having an iodide ion content of from 0.1 to 15 mol % and this is in the position as a representative film of conventional general-purpose films.

On the other hand, the film B is a film containing a high silver chloride emulsion comprising tabular silver halide grains having (100) faces as the main planes and having a silver chloride content of from 50 to 100 mol %. This film is imaged as the expected coming general-purpose film. The film B preferably contains an emulsion comprising high silver chloride grains where tabular silver chloride grains having (100) or (111) faces as the main planes account for 80% or more.

As understood from the description in the foregoing pages, the developer replenisher for use in the development processing method of the present invention is preferably a developer replenisher supplied on the market or indicated in the formulation as the replenisher for the film A. This developer replenisher is ensured with the supply of processing chemicals or processing agents. Furthermore, the development processing method for the film A is established and in the simultaneous processing of the film B using this processing method, the necessary change can be made by the method of the present invention according to the amount of the film B processed. Thus, even in the mixed processing, the mixed processing agent (or solid processing agent) for the development or the formulation of the developer replenisher needs not be changed and also the development processing apparatus requires no or very small modification.

Although it may be partly overlapped with the description set forth above, the embodiment of the development processing method of the present invention in the process of changeover from the development processing on the current market predominated by the film A to the coming market mostly prevailed over by the film B through the introduction of the film B and the mixed processing, is specifically described below.

In the current color laboratories mainly dealing with the film A, an exclusive processing of the film A is proceeding. In this processing, the developer replenishing amount is, though it may vary depending on the formulation of the replenisher, usually from 200 to 1,500 ml/m$^2$. The bromide ion concentration in the developing tank is preferably from $8\times10^{-3}$ to $13\times10^{-3}$ mol/l, more preferably from $1\times10^{-2}$ to $1.2\times10^{-2}$ mol/l.

With respect to the general-use form of the developer replenisher, the replenisher is constituted by three agent parts called agent A, agent B, agent C and the like. Water is added to these to prepare a replenisher consisting of two agent parts called agent D and agent E, water is added to these to prepare a replenisher consisting of one agent part called agent F, or water is added to these to prepare a replenisher. These respective parts and water may be fed by respective quantitative pumps and automatically mixed. Also, as described above, these may be automatically fed to a developing tank to perform the substantial mixing and replenishment in the developing tank.

Even if a part or the whole of the parts are a solid processing agent, the difference is only the solid charging in place of the solution feeding and the point is substantially the same.

Specific examples of these embodiments are disclosed, for example, in JP-A-8-234389, JP-A-8-248606, JP-A-9-234130, JP-A-9-234131 and JP-A-10-167447 and the present invention can be applied to the techniques described in these patent publications.

At the stage where the film B is introduced into the market and the mixed processing is performed, processing by the method of the present invention starts. The replenishing amount is varied according to the mixing ration of the film B but for example, in the case where the film B does not contain silver bromide and the ratio thereof is 20%, the bromide ion amount released in the developing tank during the development decreases by 20% and the replenishing amount is proportionally decreased by 20%, whereby the bromide ion concentration can be maintained constant due to the bromide ion released from the film A to the developing tank during the development and the replenisher. Even if the film B is introduced, this bromide ion concentration must be maintained so as to keep the finish quality of films.

On the other hand, if the replenishing amount is reduced, the concentration of the constituent chemicals consumed in the developer, such as color developing agent, cannot be maintained, therefore, the concentration of the consumed constituent chemicals is increased in proportion to the reduction in the replenishing amount, namely, by about 20%, whereby the concentration can be maintained. This can be coped with by reducing the amount of water by 20% at the preparation of the replenisher.

To speak more generally, assuming that the silver bromide contents of emulsions in film A and film B are a mol % and b mol %, respectively, and the mixing ratio of the film B is x %, the replenishing amount V1 in the mixed processing is represented by the following formula:

$$V1=V\times[a\times(1-0.01x)+b\times0.01x]/a$$

The concentration ratio of the replenisher is nearly V/V1, where V is a replenishing amount when only the film A is developed.

The replenishing amount and the concentration of the replenisher may be continuously changed according to the change of the mixing ratio x, however, in more practical manner, these may be stepwise changed with the increase of x. For example, the following situation may be considered. The light-sensitive materials called film A or film B brought in for the development at the color laboratories include films of various brand names different in the manufacturer and in the sensitivity and the like. In order to always achieve a preferred finish by the same development formulation, the formulation for the development processing is designed to have a broad allowance. Accordingly, even if the change is stepwise performed as shown below, the photographic properties in substance can be usually prevented from lowering.

When x is from 0 to 10%, V1 is set to 95%;

when x is from 11 to 20%, V1 is set to 85%; and when x is from 21 to 30%, V1 is set to 75%.

Namely, with the increase in the mixing ratio of the film B, the processing is performed using a replenisher of which concentration is increased in proportion therewith by reducing the replenishing amount from 100% to 95%, to 85% and further to 75%. In this method, until the mixing ratio of film B reaches 50%, the development processing can be performed while maintaining the photographic properties of the finished film within an allowable range. When the mixing ratio of the film B exceeds it, the replenishing amount may be further reduced in proportion therewith, however, it is rather preferred to use in combination a method of separately adding bromide ion proposed in JP-A-9-204030.

The mixing ratio between the film A and the film B may be known by the number of films brought in from users for the development but in a more simple and easy method, a DX code-reading device is fixed to the development processing apparatus to count respective numbers of film A and film B and from the integrated value thereof, the mixing ratio may be known. At a large processing station capable of analyzing and controlling the developer, the composition of the tank solution in the developing tank is monitored and when the mixing ratio departs from the allowable range including the standard value, the setting of the replenishing amount and the concentration of the replenisher may be changed to a level where the mixing ratio of film B is high.

For the common color developer replenisher used in the above-described development processing method, the chemicals or mixed processing agents currently supplied from manufacturers of respective processing chemicals or processing agents may be continuously used. In the case of a thick replenisher, the product differs some or less depending on individual brands, therefore, if desired, not only the amount of the diluting water but also the amount of the thick replenisher may be changed.

The developer replenisher or replenishing agent and the solid processing agent each contains as an essential component an aromatic primary amine color developing agent. As the color developing agent, an aminophenol-based compound may be useful but a p-phenylenediamine-based compound is preferred and representative examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl) aniline, 4-amino-3-methyl-N,N-bis (4-hydroxybutyl) aniline, 4-amino-3-methyl-N,N-bis (5-hydroxypentyl) aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)-aniline, their sulfates, hydrochlorides and p-toluenesulfonates, and hydrates of these salts. Among these, particularly preferred are 3-methyl-4-amino-N-ethyl-N-β-hydroxyethyanilien, 4-amino-3-methyl-N-ethyl-N-(3-hydroxypropyl)aniline, 4-amino-3-methyl-N-ethyl-N-(4-hydroxybutyl)aniline, and their hydrochlorides, p-toluenesulfonates and sulfates. These compounds can be used in combination of two or more according to the purpose.

The amount of the aromatic primary amine developing agent used is preferably from 0.0002 to 0.2 mol, more preferably from 0.001 to 0.1 mol, per l of the color developer, which is designed to maintain the concentration in the developing tank within the above-described range when the developing agent is charged as a prepared replenisher or replenished directly into the developing tank.

The color developer replenisher (in the composition described below, the same applies to the composition of the mixed processing agent or solid processing agent for the color developer replenisher) contains, if desired, an alkali agent and a pH buffering agent, such as carbonates, borates or phosphates of an alkali metal; a development inhibitor or an antifoggant, such as chlorides, bromides, iodides, benzimidazoles, benzothiazoles and mercapto compounds; an antifungal and a preservative, such as isothiazolones, thiabendazoles, benzotriazoles and benzisothiazolones; an antioxidant, a chelating agent and the like.

Representative examples of the preservative which is used, if desired, include hydroylamine, diethylhydroxylamine, hydroxylamines represented by formula (1) described in JP-A-3-144446, sulfites, hydrazines such as N,N-biscarboxymethylhydrazine, phenylsemicarbazides, triethanolamine and catecholsulfonic acids; representative examples of the development accelerator include organic solvents such as ethylene glycol and diethylene glycol, benzyl alcohol, polyethylene glycol, quaternary ammonium salts and amines; representative examples of the auxiliary developing agent include 1-phenyl-3-pyrazolidone; and representative examples of the hard water softening agent, namely, chelating agent include aminopolycarboxylic acid, aminopolyphosphonic acid, alkylphosphonic acid, phosphonocarboxylic acid, ethylenediaminetetraacetic acid, nitrilotriacetic acid, diethylenetriaminepentaacetic acid, cyclohexanediaminetetraacetic acid, hydroxyethyl-iminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof. Other than these, a dye-forming coupler (so-called external developer), a competing coupler and a tackifying agent may be used, if desired, in the developer, the developer replenisher or the mixed processing agent therefor.

Among the above-descried additives, as the preservative, an unsubstituted hydroxylamine and a substituted hydroxylamine are most preferred. In particular, diethylhydroxylamine, monomethylhydroxylamine and those having as a substituent an alkyl group substituted by a water-soluble group such as a sulfo group, a carboxy group or a hydroxy group are preferred. Of these, most preferred are N,N-bis(2-sulfoethyl)-hydroxylamine and alkali metal salts thereof.

The developer preferably contains a chelating agent, more preferably a biodegradable chelating compound, so as to prevent adverse effects incurred due to mingling of iron or when the water for the development is hard water, to prevent adverse effects on the photographic properties. Examples thereof include chelating agents described in JP-A-63-146998, JP-A-63-199295, JP-A-63-267750, JP-A-63-267751, JP-A-2-229146, JP-A-3-186841, German Patent 3,739,610 and European Patent 468325.

The processing solution in the replenishing tank or processing tank for housing the color developer is preferably shielded by a liquid agent such as a high boiling point organic solvent to reduce the contact area with air. The liquid shielding agent is most preferably liquid paraffin. In particular, the replenisher preferably uses this liquid shielding agent.

In the present invention, the temperature at the processing with the color developer is from 20 to 55° C., preferably from 30 to 55° C. The processing time is from 30 seconds to 5 minutes, preferably from 60 seconds to 3 minutes and 20 seconds.

In the processing method of light-sensitive materials of the present invention, desilvering follows the color development. In the desilvering process, two types of light-sensitive materials are preferably processed with a common tank solution and a common replenisher. However, the replenishing amount may be differently set for respective light-sensitive materials or may be appropriately changed according to the mixing ratio. The desilvering process is described in detail below.

The desilvering process usually consists of a bleaching step, a bleach-fixing step, a fixing step or a combination thereof, and various process forms are present. Specific examples of the process form are shown below, however, the present invention is by no means limited thereto.

(Process 1) bleach-fixing (Process 2) bleaching—bleach-fixing (Process 3) bleaching—bleach-fixing—fixing (Process 4) fixing—bleach-fixing (Process 5) bleaching—fixing These processing baths each may be divided into two or more baths, if desired. The replenishment may be performed by a so-called cascade system where an overflow of one processing bath sequentially flows into another processing bath.

Examples of the bleaching agent used in the processing solution having bleaching ability include ferric aminopolycarboxylate complexes, persulfates, bromates, hydrogen peroxide, potassium ferricyanide, and the like. Among these, ferric aminopolycarboxylate complexes are most preferred.

The ferric complex salt for use in the present invention may be added and dissolved in the form of a ferric complex salt by previously forming the complex, or a complex-forming compound and a ferric salt (e.g., ferric sulfate, ferric chloride, ferric bromide, ferric nitrate, ferric ammonium sulfate) may be allowed to be present together to form a complex salt in the solution having bleaching ability.

The complex-forming compound may be used slightly in excess of the amount necessary for forming a complex with ferric ion, and when added in excess, the excess range is preferably from 0.01 to 10%.

Examples of the compound capable of forming a ferric complex salt in the processing solution having bleaching activity for use in the present invention include ethylenediaminetetraacetic acid (EDTA), 1,3-propanediaminetetraacetic acid (1,3-PDTA), diethylenetriaminepentaacetic acid, 1,2-cyclohexanediaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl)-iminodipropionic acid, β-alaninediacetic acid, α-methylnitrilotriacetic acid, 1,4-diaminobutanetetraacetic acid, glycol ether diaminetetraacetic acid, N-(2-carboxyphenyl)iminodiacetic acid, ethylenediamine-N-(2-carboxyphenil)-N, N',N'-triacetic acid, ethylenediamine-N, N'-disuccinic acid, 1,3-diaminopropane-N,N'-disuccinic acid, ethylenediamine-N,N'-dimalonic acid and 1,3-diaminopropane-N, N'-dimalonic acid, however, the present invention is by no means limited thereto.

The concentration of the ferric complex salt in the processing solution having bleaching ability for use in the present invention is suitably from 0.005 to 1.0 mol/l, preferably from 0.01 to 0.50 mol/l, more preferably from 0.02 to 0.30 mol/l.

The concentration of the ferric complex salt in the replenisher of the processing solution having bleaching ability is preferably 0.005 to 2 mol/l, more preferably from 0.01 to 1.0 mol/l.

The bath having bleaching ability or a prebath thereof may contain various compounds as the bleaching accelerator. Examples thereof include compounds having a mercapto group or a disulfide bond described in U.S. Pat. No. 3,893,858, German Patent No. 1,290,812, JP-A-53-95630 and *Research Disclosure,* No. 17129 (July, 1978), thiourea compounds described in JP-B-45-8506 (the term "JP-B" as used herein means an "examined Japanese patent publication"), JP-A-52-20832, JP-A-53-32735 and U.S. Pat. No. 3,706,561, and halides such as iodide ion and bromide ion. These are preferred because of their high bleaching power.

The bath having bleaching ability which can be used in the present invention may contain a rehalogenating agent such as bromide (e.g. potassium bromide, sodium bromide, ammonium bromide), chloride (e.g. potassium chloride, sodium chloride, ammonium chloride) and iodide (e.g. ammonium iodide). If desired, one or more inorganic or organic acid having a pH buffering function, such as borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid and glutaric acid, or an alkali metal salt or ammonium salt thereof, and a corrosion inhibitor such as ammonium nitrate or guanidine, may also be added.

The bath having bleaching ability may further contain a fluorescent brightening agent of various types, a defoaming agent, a surface active agent, and an organic solvent such as polyvinylpyrrolidone and methanol.

The fixing agent component used in the bleach-fixing solution and the fixing solution is preferably a thiosulfate. Examples of the thiosulfate include sodium thiosulfate, potassium thiosulfate and ammonium thiosulfate. In addition, a known fixing agent may also be used and examples thereof include thiocyanates such as sodium thiocyanate and ammonium thiocyanate; and water-soluble silver halide-dissolving agents, for example, thioether compounds, mesoionic compounds and thioureas, such as ethylenebisthioglycolic acid and 3,6-dithia-1,8-octanediol. In the present invention, thiosulfates, particularly ammonium thiosulfates, potassium thiosulfates and sodium thiosulfates, are preferably used. The total amount of the fixing agent(s) is preferably from 0.3 to 3 mol/l, more preferably from 0.5 to 2.0 mol/l.

The bleach-fixing solution and the fixing solution for use in the present invention each preferably contains a sulfite (or a bisulfite or a metabisulfite) as the preservative, and this compound is preferably contained in an amount of from 0.03 to 0.5 mol/λ, more preferably 0.05 to 0.3 mol/λ.

The bleach-fixing solution and the fixing solution for use in the present invention each may contain as the preservative, in addition to the above-described sulfite ion-releasing compound such as a sulfite (e.g., sodium sulfite, potassium sulfite, ammonium sulfite), a bisulfite (e.g., ammonium bisulfite, sodium bisulfite, potassium bisulfite) and a metabisulfite (e.g., potassium metabisulfite, sodium metabisulfite, ammonium metabisulfite), an aldehyde (e.g., benzaldehyde, acetaldehyde), a ketone (e.g., acetone), an ascorbic acid, a hydroxylamine, benzenesulfinic acid or an alkylsulfinic acid, if desired. In particular, benzenesulfinic acid, p-methylbenzenesulfinic acid, p-aminobenzenesulfinic acid and the like are preferred. The added amount thereof is preferably on the order of from 0.005 to 0.3 mol/λ.

The bleaching solution, the bleach-fixing solution and the fixing solution each may further contain, if desired, a buffering agent, a fluorescent brightening agent, a chelating agent, a defoaming agent, an antifungal agent and the like.

The bleaching solution, the bleach-fixing solution and the fixing solution for use in the present invention each preferably has a pH of from 4 to 8, more preferably from 4.5 to 6.5.

The amount of the replenisher for each of the bleaching solution, the bleach-fixing solution and the fixing solution used in the present invention is from 50 to 2,000 ml per $m^2$ of the light-sensitive material. Also, the washing water in the post-bath or the overflow from the stabilizing bath may be used as the replenisher, if desired.

The temperature at the processing with the bleaching solution, the bleach-fixing solution or the fixing solution is from 20 to 50° C., preferably from 30 to 45° C. The processing time in each step is from 10 seconds to 3 minutes, preferably from 20 seconds to 2 minutes.

The processing solution having bleaching ability for use in the present invention is particularly preferably aerated at the time of processing because the photographic capability can be maintained very stably. The aeration can be performed using a technique known in the art and, for example, air may be blown into the processing solution having bleaching ability or air may be absorbed in the solution using an ejector.

In blowing air, the air is preferably released into the solution through a diffusion tube having micropores. The tube diffuser is widely used, for example, in the aeration tank for treating activated sludge. With respect to the aeration, the matters described in *Z*-121, *Using Process C*-41, 3rd ed., pages BL-1 to BL-2, issued by Eastman Kodak Co. (1982) may be used. In the processing using the processing solution having bleaching ability of the present invention, stirring is preferably intensified and for intensifying the stirring, the description of JP-A-3-33847, page 8, from right upper column, line 6 to left lower column, line 2, may be wholly used.

In the desilverization, the stirring is preferably intensified as much as possible. Specific examples of the method for intensifying the stirring include a method of colliding a jet stream of a processing solution against the emulsion surface of the light-sensitive material described in JP-A-62-183460, a method of increasing the stirring effect using a rotary means described in JP-A-62-183461, a method of increasing the stirring effect by moving the light-sensitive material while putting the emulsion surface into contact with a wire blade provided in the solution to cause turbulence on the emulsion surface, and a method of increasing the circulation flow rate of the entire processing solutions. Such means for intensifying the stirring is effective in any of the bleaching solution, the bleach-fixing solution and the fixing solution. The intensification of stirring is considered to increase the supply rate of the bleaching agent or the fixing agent into the emulsion layer and as a result, to elevate the desilverization rate. The above-described means for intensifying the stirring is more effective when a bleaching accelerator is used and in this case, the acceleration effect can be outstandingly increased or the fixing inhibitory action by the bleaching accelerator can be eliminated.

The automatic developing machine used for the light-sensitive material of the present invention preferably has means for transporting the light-sensitive material described in JP-A-60-191257, JP-A-60-191258 and JP-A-60-191259. As described in JP-A-60-191257 above, this transportation means can extremely decrease the amount of a processing solution carried over from a previous bath to a post bath and provides a great effect of preventing the processing solution from deteriorating in capability. This effect is particularly effective in reducing the processing time or decreasing the replenishing amount of a processing solution in each step.

The light-sensitive material of the present invention is generally subjected to water washing and/or stabilization after the desilvering. In the water washing and/or stabilization step for use in the present invention, the concentration of the residual thiosulfate in the processed light-sensitive material is preferably controlled to be from 30 to 1,500 $\mu mol/m^2$. More specifically, the concentration of the thiosulfate in the final bath is preferably controlled to be on the order of from 0.001 to 0.04 mol/l. To this purpose, a thiosulfate having the above-described concentration may be added to the final bath or when a thiosulfate is used as a fixing component, the replenishing amount in the subsequent water washing or stabilization step may be reduced to adjust the concentration in the final bath to the above-described range and this method is preferred.

Specifically, the replenishing amount is, though it may vary depending on the concentration of the thiosulfate in the fixing step, the number of baths in the water washing or stabilization step, and the like, approximately from 100 to 1,000 ml, preferably on the order of from 130 to 700 ml, per 1 $m^2$ of the light-sensitive material.

With respect to the amount of washing water in the water washing step, the relationship between the number of water washing tanks and the amount of water in a multi-stage countercurrent system can be obtained according to the method described in *Journal of the Society of Motion Picture and Television Engineers,* Vol. 64, pp. 248–253 (May, 1955). According to the multi-stage countercurrent system described in the above-described publication, the amount of washing water may be greatly reduced but due to the increase in the residence time of water in the tank, bacteria proliferate and floats generated disadvantageously adhere to the light-sensitive material. In order to solve this problem in the processing of color light-sensitive materials according to the present invention, a method of reducing calcium ion or magnesium ion described in JP-A-62-288838 may be used and this is very effective. Furthermore, isothiazolone compounds and thiabendazoles described in JP-A-57-8542, chlorine-based bactericides such as sodium chlorinated isocyanurate, and bactericides described in Hiroshi Horiguchi, *Bokin, Bobai-Zai no Kagaku* (*Chemistry of Bactericide and Antifungal*), Sankyo Shuppan (1986), *Biseibutsu no Mekkin, Sakkin, Bobai-Gijutsu* (*Germicidal, Bactericidal and Antifungal Technology of Microorganism*) compiled by Eisei Gijutsu Kai, issued by Kogyo Gijutsu Kai (1982), and *Bokin-Bobai Zai Jiten* (*Lexicon of Bactericide and Antifungal*) compiled by Nippon Bokin Bobai Gakkai (1986), such as benzotriazole, may be also used.

In the processing of light-sensitive materials according to the present invention, the pH of the final bath may be freely selected but preferably from 3.5 to 8, more preferably from 4 to 7. This pH is preferably set so that it can reflect on the pH of the image film of the processed light-sensitive material. To this purpose, a buffering agent of various types may be used. Specific examples thereof include acetic acid, malonic acid, succinic acid, malic acid, maleic acid and phthalic acid. The pH of the image film means a pH obtained by dipping the image film in distilled water and measuring the pH of the leachate before it is affected by the carbon dioxide gas in air.

The washing water temperature and the water washing time may be variously set according to the characteristics, use and the like of the light-sensitive material, but they are generally from 25 to 45° C. and from 20 seconds to 5 minutes, preferably from 25 to 40° C. and from 30 seconds to 3 minutes, respectively. The light-sensitive material of the present invention may also be processed directly with a stabilizing solution in place of the above-described water washing. In the stabilization, known methods described in JP-A-57-8543, JP-A-58-14834 and JP-A-60-220345 all may be used.

The stabilizing solution contains a compound for stabilizing a dye image and examples thereof include formalin, benzaldehydes such as m-hydroxybenzaldehyde, formaldehyde bisulfite adduct, hexamethylenetetramine and derivatives thereof, hexahydrotriazine and derivatives thereof, dimethylolurea, N-methylol compounds such as N-methylolpyrazole, organic acids and pH buffering agents. The added amount of this compound is preferably from 0.001 to 0.02 mol per liter of the stabilizing solution. In the stabilizing solution, the free formaldehyde concentration is preferably low because blowing off of formaldehyde gas can be reduced. From this aspect, preferred as the dye image stabilizer are m-hydroxybenzaldehyde, hexamethylenetetramine, N-methylolazole such as N-methylolpyrazole described in JP-A-4-270344, and azolylmethylamines such as N,N'-bis(1,2,4-triazol-1-ylmethyl)piperazine described in JP-A-4-313753. Particularly, a combination of an azole such as 1,2,4-triazole with an azolylmethylamine such as 1,4-bis(1,2,4-triazol-1-ylmethyl)piperazine or a derivative thereof described in JP-A-4-359249 (corresponding to European Patent Unexamined Published Application No. 519190A2) is preferred because the image stability is high and the formaldehyde vapor pressure is low. Other than these, the stabilizing solution preferably contains, if desired, an ammonium compound such as ammonium chloride and ammonium sulfite, a metal compound such as Bi and Al, a fluorescent brightening agent, a hardener, an alkanolamine described in U.S. Pat. No. 4,786,583, and a preservative which can be contained in the above-described fixing solution and bleach-fixing solution, such as a sulfinic acid compound described in JP-A-1-231051.

The washing water and/or stabilizing solution may contain a surface active agent of various types so as to prevent the formation of water spots in the course of drying of the light-sensitive material. In particular, a nonionic surface active agent is preferred and an alkylphenol ethylene oxide adduct is more preferred. The alkylphenol is preferably an octyl-, nonyl-, dodecyl- or dinonyl-phenol. The addition molar number of ethylene oxide is preferably from 8 to 14. A silicon-base surface active agent having a high antifoaming effect is also preferably used.

The washing water and/or stabilizing solution preferably contain a chelating agent of various types. Preferred examples of the chelating agent include aminopolycarboxylic acids such as ethylenediaminetetraacetic acid and diethylenetriaminepentaacetic acid, organic phosphonic acids such as 1-hydroxyethylidene-1,1-diphosphonic acid, N,N,N'-trimethylenephosphonic acid and diethylenetriamine-N,N,N',N'-tetramethylenephosphonic acid, and hydrolysates of maleic anhydride polymers described in European Patent No. 345,172A1.

The overflow accompanying the replenishment of the washing water and/or the stabilizing solution can be reused in other steps such as desilvering.

In the case where each of the above-described processing solutions is concentrated by evaporation in the process using an automatic developing machine or the like, an appropriate amount of water, correcting solution or processing solution replenisher is preferably replenished so as to compensate the solution for concentration due to the evaporation. The specific method for replenishing water is not particularly limited, however, a method described in JP-A-1-254959 and JP-A-1-254960, where a monitor water tank different from the bleaching tank is provided, the evaporation of water in the monitor water tank is determined, the evaporation of water in the bleaching tank is calculated from the determined evaporation of water, and water is replenished into the bleaching tank in proportion to the evaporation of water, and a method described in JP-A-3-248155, JP-A-3-249644, JP-A-3-249645 and JP-A-3-249646, where the evaporation is compensated using a liquid level sensor or overflow sensor are preferred. The water for compensating for the evaporation of each processing solution may be tap water but the water is preferably deionized water or sterilized water which are preferably used in the above-described water washing step.

Any drying method may be selected but a method using a ceramic hot air heater is preferred. The quantity of air supplied is preferably from 4 to 20 $m^3$/min, more preferably from 6 to 10 $m^3$/min.

The thermostat for preventing overheat of the ceramic hot air heater preferably has a thermal actuation system. The thermostat is preferably fixed in the leeward or the windward through the heat radiation fin or heat transfer area. The drying temperature is preferably controlled according to the water content of the light-sensitive material processed. The drying temperature is optimally from 45 to 80° C. for 24 mm- or 35 mm-width films, from 55 to 65° C. for Brownie films, and from 60 to 100° C. for printing materials. The drying time is preferably from 10 seconds to 2 minutes, more preferably from 20 to 50 seconds.

The material for photographing used in the present invention is described in detail below.

The silver halide composition of the high silver bromide light-sensitive material for use in the present invention is preferably a silver iodobromide or silver iodochlorobromide emulsion containing about 40 mol % or less of silver iodide, more preferably silver iodobromide containing from about 0.1 to about 15 mol % of silver iodide.

The silver halide composition of the high silver chloride light-sensitive material for use in the present invention is preferably a silver chlorobromide emulsion containing about 50 mol % or less of silver bromide or a pure silver chloride emulsion, more preferably silver chloride or silver chlorobromide containing substantially no silver bromide or if contained, having a silver bromide content of about 10 mol % or less, still more preferably 5 mol % or less. If desired, the emulsion may contain a slight amount (10 mol % or less) of silver iodide.

The two types of silver halide emulsions called film A and film B for use in the present invention each may have any shape such as octahedral form, cubic form and spherical form. A tabular emulsion is preferably contained in at least one layer. Particularly, in the latter high silver chloride emulsion, a tabular silver halide emulsion having (100) faces is preferred. The tabular silver halide emulsion which is preferably used is described in detail below. In the tabular silver halide emulsion for use in the present invention, the average aspect ratio means an average of the ratios of the diameter to the thickness of silver halide grains, namely, an average of the values obtained by dividing the diameter of individual silver halide grains by the thickness. The diameter as used herein means a diameter of a circle having an area equal to the projected area of a grain on the observation of the silver halide emulsion through a microscope or electron microscope. Accordingly, an average aspect ratio of 2:1 or more means that the diameter of the circle is 2 times or more the thickness of the grain.

In the tabular silver halide grain for use in the silver halide emulsion to which the present invention is applied, the grain diameter is 2 times or more, preferably from 3 to 20 times, more preferably from 4 to 15 times, particularly preferably from 5 to 10 times, the grain thickness. The ratio of tabular silver halide grains occupying in the projected area of all silver halide grains is 50% or more, preferably 70% or more, more preferably 85% or more.

By using the above-described emulsion, a silver halide photographic light-sensitive material having more excellent sharpness can be obtained. This excellent sharpness owes to the fact that the light scattering by the emulsion using the emulsion is very small as compared with that by conventional emulsion layers. This can be easily confirmed by a test method which can be usually used by one skilled in the art. The reason why the light scattering of the emulsion layer using a tabular silver halide emulsion is small is not clearly known but is considered because the main surface of the tabular silver halide emulsion is oriented in parallel with the support surface.

The diameter of the tabular silver halide grain is from 0.2 to 20 $\mu$m, preferably from 0.3 to 10.0 $\mu$m, more preferably from 0.4 to 5.0 $\mu$m. The thickness of the grain is preferably from 0.5 $\mu$m or less. The term "diameter of a tabular silver halide grain" as used herein means the diameter of a circle having an area equal to the projected area of the grain. The term "thickness of the grain" means the distance between two parallel planes constituting the tabular silver halide grain.

The tabular silver halide grain for use in the present invention is more preferably has a grain diameter of from 0.3 to 10.0 $\mu$m, a grain thickness of from 0.1 to 1.0 $\mu$m and an average aspect ratio (diameter/thickness) of from 3 to 10. If the aspect ratio exceeds 10, the photographic properties of the light-sensitive material may be disadvantageously impaired when folded, firmly rolled or brought into contact with a keen-edged substance. More preferred is a silver halide photographic emulsion in which grains having a grain diameter of from 0.4 to 5.0 $\mu$m and an average aspect ratio (diameter/thickness) of from 5 to 10 occupy 85% or more of the entire projected area of all silver halide grains.

The tabular silver halide grain in the light-sensitive material to which the present invention is applied is preferably the above-described silver bromide or silver iodobromide, or silver chloride, silver chlorobromide or silver bromide. In the case of mixed silver halide grains, the compositional distribution may be uniform or localized.

The grain size distribution of tabular silver halide grains for use in the light-sensitive material to which the present invention is applied may be either broad or narrow.

The coated silver amount is approximately from 2 to 10 g per 1 $m^2$ of the light-sensitive material and particularly in the case of a high silver chloride light-sensitive material, it is preferably from 2 to 6 g, most preferably from 2.5 to 5.5 g, per $m^2$ of the light-sensitive material.

The silver halide emulsion comprising tabular silver halide grains for use in the light-sensitive material to which the present invention is applied is described in a report by Cugnac and Chatean, Duffin, *Photographic Emulsion Chemistry,* pages 66 to 72, the Focal Press, New York (1966), and A. P. H. Trivelli and W. F. Smith (compilers) *Phot. Journal,* 80, page 285 (1940). The emulsion can be easily prepared by a method described, for example, in JP-A-58-113927, JP-A-58-113928 and JP-A-58-127921.

For example, seed crystals in which 40 wt % or more of tabular silver halide grains are present are formed in a relatively high pAg value atmosphere at a pBr of 1.3 or less and grown by keeping the pBr value at the same level while simultaneously adding silver and a halogen solution. During this grain growing process, silver and a halogen solution are preferably added not to allow the generation of new crystal nuclei.

The size of the tabular silver halide grain can be adjusted, for example, by controlling the temperature, selecting the kind and quality of the solvent, or controlling the addition rate of silver salt and halide used for the growth of grains.

At the production of tabular silver halide grains for use in the present invention, a silver halide solvent may be used, if desired, whereby the grain size, the grain shape (for example, diameter/thickness ratio), the grain size distribution or the grain growing rate can be controlled. The amount of the solvent used is preferably from $10^{-3}$ to 1.0 wt %, more preferably from $10^{-2}$ to $10^{-1}$ wt %, of the reaction solution. In the present invention, by increasing the amount of the solvent used, the grain size distribution can be made monodisperse and the growing rate can be increased. When the amount of the solvent used is increased, the grain thickness is also liable to increase At the production of silver halide gains of a photographic emulsion for use in the present invention, a known silver halide solvent may be used. Examples of the silver halide solvent which is often used include ammonia, thioethers, thioureas, thiocyanates and thiazolinethiones The thioethers are described in U.S. Pat. Nos. 3,271,157, 3,574,628 and 3,790,387, the thioureas are described in JP-A-53-82408 and JP-A-55-77737; the thiocyanates are described in U.S. Pat. Nos. 2,222,264, 2,448,534 and 3,320,069; and the thiazolinediones are described in JP-A-53-144319.

In the process of forming or physically ripening silver halide grains, for example, a cadmium salt, a zinc salt, a lead salt, a thallium salt, an iridium salt or a complex salt thereof, a rhodium salt or a complex salt thereof, an iron salt or an iron complex salt may be present together.

At the production of tabular silver halide grains for use in the present invention, a method of increasing the addition rate, added amount or added concentration of a silver salt solution (for example, aqueous $AgNO_3$ solution) and a halide solution (for example, aqueous KBr solution) added is preferably used so as to increase the growing rate of grains. This method is described, for example, in British Patent 1,335,925, U.S. Pat. Nos. 3,650,757, 3,672,900 and 4,242,445, JP-A-55-142329 and JP-A-55-158124.

In the above-described emulsion for use in the present invention, 50% by number of silver halide grains preferably has 10 dislocation lines per one grain.

The dislocation lines of a tabular grain can be observed by a direct method using a transmission type electron microscope at a low temperature described, for example, in J. F. Hamilton, *Phot. Sci. Eng.,* 11, 57 (1967) and T. Shiozawa, *J. Soc. Phot. Sci. Japan,* 35, 213 (1972) More specifically, a silver halide grain taken out from an emulsion carefully so as not to apply such a pressure as to cause generation of dislocation lines on the grain is placed on a mesh for the observation by an electron microscope and observed according to a transmission method while laying the sample in a cool state and thereby preventing damages (e.g., print out) by an electron beam. At this time, as the thickness of the grain is larger, the electron beam becomes more difficult to pass through, therefore, a high-voltage type (200 kV for the grain having a thickness of 0.25 $\mu$m) electron microscope is preferably used to effect the observation more clearly. The site and the number of dislocation lines on each grain can be determined by observing the grain from the direction perpendicular to the main plane on the photograph of the grain obtained by this method.

The dislocation lines of a tabular silver halide grain which is preferably used in the photographic emulsion for use in the present invention are generated over the area from the distance at x % of the length between the center in the long axis direction of the tabular grain and the side to the side. This x value preferably satisfies 10 x<100, more preferably 30 x<98, still more preferably 50 x<95. At this time, the shape formed by connecting the starting points of dislocation lines is nearly a similar figure to the grain form but not completely a similar figure and may deform in some cases. The dislocation lines are directed from nearly the center toward the side but weave on many occasions.

With respect to the number of dislocation lines on a tabular grain contained in the light-sensitive material to which the present invention is applied, grains having 10 or more dislocation lines preferably occupy 50% by number, more preferably 80% by number, and particularly preferably grains having 20 or more dislocation lines occupy 80% by number.

The tabular silver halide grain for use in the present invention can be chemically sensitized, if desired. The chemical sensitization can be performed by a method described, for example, in H. Frieser (compiler), *Die Grundlagen der Photographischen Prozesse mit Silberhalogeniden,* pages 675 to 735, Akademische verlagsgesellschaft (1968).

More specifically, a sulfur sensitization method using a sulfur-containing compound capable of reacting with active gelatin or silver (e.g., thiosulfates, thioureas, mercapto compounds, rhodanines); a reduction sensitization method using a reducing substance (e.g., stannous salts, amines, hydrazine derivatives, formamidinesulfinic acids, silane compounds); and a noble metal sensitization using a noble metal compound (e.g., gold complex salts, complex salts of the Group VIII metals of the Periodic Table such as Pt, Ir and Pd) may be used either individually or in combination.

Specific examples of the sulfur sensitization method are described in U.S. Pat. Nos. 1,574,944, 2,278,947, 2,410,689, 2,728,668 and 3,656,955; specific examples of the reduction sensitization method are described in U.S. Pat. Nos. 2,419, 974, 2,983,609 and 4,054,458; specific examples of the noble metal sensitization method are described in U.S. Pat. Nos. 2,399,083 and 2,448,060 and British Patent No. 618, 061.

From the standpoint of saving silver, the tabular silver halide grain for use in the present invention is preferably sensitized by a gold sensitization, a sulfur sensitization or a combination thereof.

The tabular silver halide grain which is preferred in the present invention can be spectrally sensitized with a methine dye or the like, if desired. In addition to the above-described improved sharpness, the tabular silver halide grain for use in the present invention is also characterized by the high spectral speed. The dye used to this purpose includes a cyanine dye, a merocyanine dye, a composite cyanine dye, a composite merocyanine dye, a holopolar cyanine dye, a hemicyanine dye, a styryl dye and a hemioxonol dye. Among these, dyes belonging to cyanine dye, merocyanine dye and composite merocyanine dye are particularly useful.

Examples of useful sensitizing dyes include those described in German Patent 929,080, U.S. Pat. Nos. 2,493, 748, 2,503,776, 2,519,001, 2,912,329, 3,656,959, 3,672,897 and 4,025,349, British Patent 1,242,588 and JP-B-44-14030.

These sensitizing dyes may be used either individually or in combination. The combination of sensitizing dyes is often used for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,728, 3,814,609 and 4,026,707, British Patent 1,344,281, JP-B-43-4936 and JP-B-53-12375, JP-A-52-109925 and JP-A-52-110618.

The photographic emulsion for use in the present invention may contain various compounds for the purpose of preventing fogging during the production, storage or photographic processing of the light-sensitive material or for stabilizing the photographic properties. More specifically, a large number of compounds known as an antifoggant or a stabilizer may be added, for example, azoles such as benzothiazolium salts, nitroimidazoles, triazoles, benzotriazoles and benzimidazoles (particularly nitro or halogen substitution products); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole) and mercaptopyrimidines; the above-described heterocyclic mercapto compounds having a water-soluble group such as carboxyl group or sulfone group; thioketo compounds such as oxazolinethion; azaindenes such as triazaindenes and tetrazaindenes (particularly 4-hydroxy-substituted (1,3,3a,7) tetrazaindenes]; benzenethio-sulfonic acids; and benzenesulfinic acids. More detailed specific examples and use methods thereof are described, for example, in U.S. Pat. Nos. 3,954,474, 3,982,947 and 4,021,248 and JP-B-52-28660.

The silver halide grain of the light-sensitive material to which the present invention is applied is preferably chemically sensitized with a selenium compound or a tellurium compound and preferred embodiments thereof are described in JP-A-6-282053, from page 14, line 27 to page 19, line 10.

The techniques and inorganic/organic materials which can be used in the color photographic light-sensitive material for use in the present invention are described in the following portions of European Patent 36,938A2 and patents cited therein.

| | | |
|---|---|---|
| 1. | Layer structure: | page 146, line 34 to page 147, line 25 |
| 2. | Silver halide emulsion: | page 147, line 26 to page 148, line 12 |
| 3. | Yellow coupler: | page 137, line 35 to page 146, line 33, and page 149, lines 21 to 23 |
| 4. | Magenta coupler: | page 149, lines 24 to 28; and European Patent 421,453A, page 3, line 5 to page 25, line 55 |
| 5. | Cyan coupler: | page 149, lines 29 to 33; and European Patent 432,804A2, page 3, line 28 to page 40, line 2 |
| 6. | Polymer coupler: | page 149, lines 34 to 38; and European Patent 435,334A2, page 113, line 39 to page 123, line 37 |
| 7. | Colored coupler: | page 53, line 42 to page 137, line 34, page 149, lines 39 to 45 |
| 8. | Other functional couplers: | page 7, line 1 to page 53, line 41, and page 149, line 46 to page 150, line 3; and European Patent 435,334A2, page 3, line 1 to page 29, line 50 |
| 9. | Antiseptic and antifungal: | page 150, lines 25 to 28 |
| 10. | Formalin scavenger: | page 149, lines 15 to 17 |
| 11. | Other additives: | page 153, lines 38 to 47; and European Patent 421,453A1, page 75, line 21 to page 84, line 56, and page 27, line 40 to page 37, line 40 |
| 12. | Dispersion method: | page 150, lines 4 to 24 |
| 13. | Support: | page 150, lines 32 to 34 |
| 14. | Thickness and physical properties of film: | page 150, lines 35 to 49 |
| 15. | Color development step: | page 150, line 50 to page 151, line 47 |
| 16. | Desilverization step: | page 151, line 48 to page 152, line 53 |
| 17. | Automatic developing machine: | page 152, line 54 to page 153, line 2 |
| 18. | Water washing/ stabilization step: | page 153, lines 3 to 37 |

The silver halide color photographic light-sensitive material for photographing used in the present invention may have magnetic recording layer. Particularly, when the present invention is applied to a light-sensitive material having a magnetic recording layer, both types of light-sensitive materials can be advantageously improved in the reading accuracy of the magnetic recording, thus, this is a preferred embodiment.

The silver halide light-sensitive material having thereon magnetic recording, which is preferably used in the present invention, may be prepared in such a manner that a previously heat-treated polyester thin layer support described in detail in JP-A-6-35118, JP-A-6-17528 and *JIII Journal of Technical Disclosure* No. 94-6023, such as a polyethylene aromatic dicarboxylate-base polyester support, having a thickness of from 50 to 300 μm, preferably from 50 to 200 μm, more preferably from 80 to 115 μm, still more preferably from 85 to 105 μm, is heat treated (annealed) at a temperature of from 40° C. to a glass transition temperature for from 1 to 1,500 hours, the support is then subjected to a surface treatment such as ultraviolet irradiation described in JP-B-43-2603, JP-B-43-2604 and JP-B-45-3828, corona discharge described in JP-B-48-5043 and JP-A-51-131576, or glow discharge described in JP-B-35-7578 and JP-B-46-43480, undercoating described in U.S. Pat. No. 5,326,689 is applied thereon, a subbing layer described in U.S. Pat. No. 2,761,791 is provided, if desired, and ferromagnetic particles described in JP-A-59-23505, JP-A-4-195726 and JP-A-6-59357 are coated thereon.

The above-described magnetic layer may be coated like stripes as described in JP-A-4-124642 and JP-A-4-124645. The support may further be subjected to an antistatic treatment described in JP-A-4-62543, if desired, and a silver halide emulsion is coated thereon. The silver halide emulsion used here include those described in JP-A-4-166932, JP-A-3-41436 and JP-A-3-41437. The light-sensitive material prepared in this way is preferably manufactured according to a manufacture control method described in JP-B-4-86817 and the manufacturing data are preferably recorded thereon by the method described in JP-B-6-87146. After or before the recording, the light-sensitive material is cut into a film smaller in the width than conventional 135 size films and two perforations are punched on one side per one small-format picture according to the method described in JP-A-4-125560 so as to match the small format picture smaller than conventional films.

Figure 9:
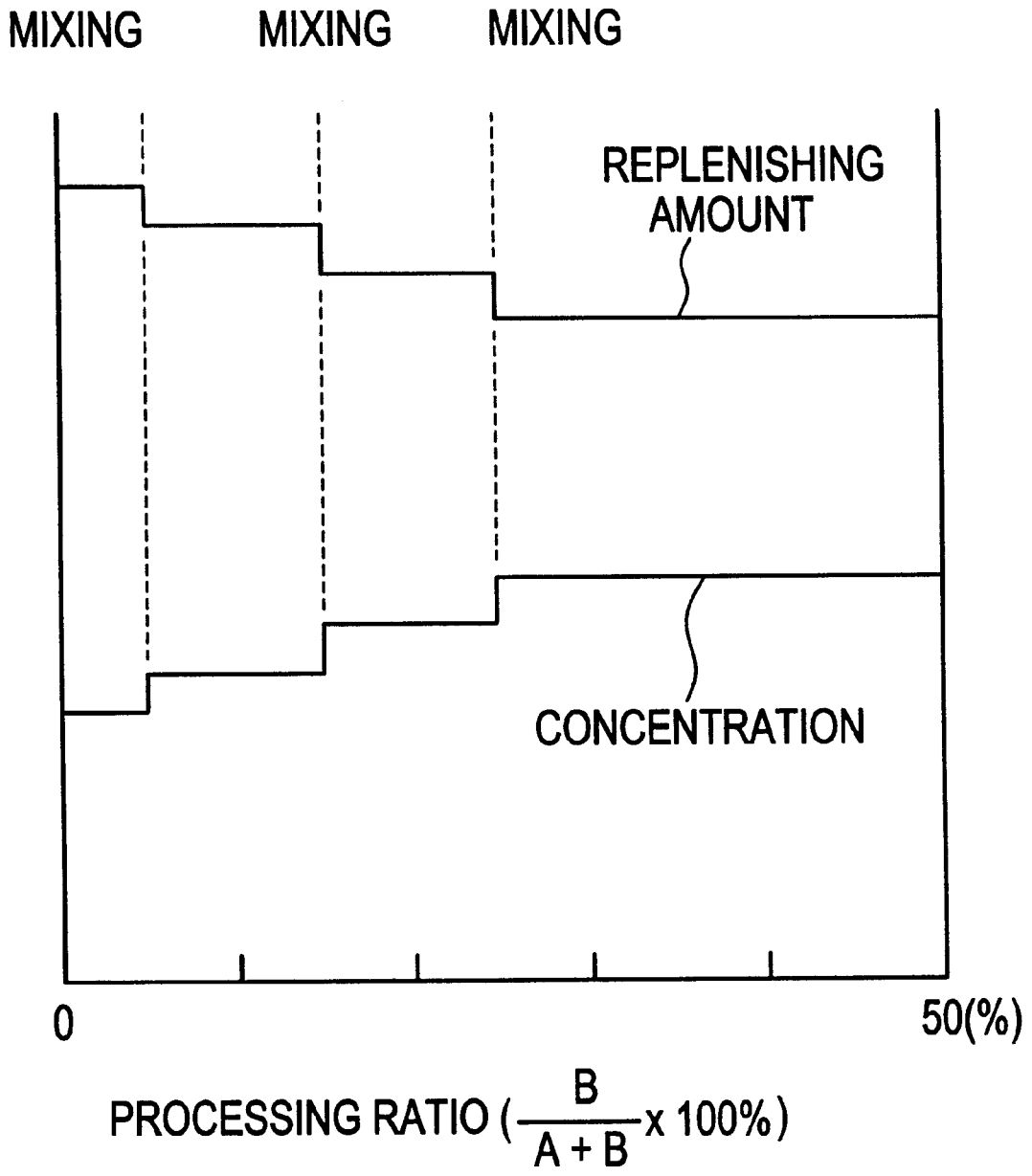
FIG. 9 is a graph showing the relationship between the replenishing amount and the concentration according to the processing ratio of a high silver chloride light-sensitive material.

The thus-prepared film is loaded in a cartridge package described in JP-A-4-157459, a cartridge described in JP-A-5-210202, FIG. 9, a film patrone described in U.S. Pat. No. 4,221,479 or a cartridge described in U.S. Pat. Nos. 4,834,306, 4,834,366, 5,226,613 and 4,846,418, and then used. The film cartridge or film patrone used herein is preferably of such a type that the tongue can be housed as described in U.S. Pat. Nos. 4,848,693 and 5,317,355 in view of the light-shielding property. Also, a cartridge having a lock mechanism described in U.S. Pat. No. 5,296,886, a cartridge capable of indicating the use state described in U.S. Pat. No. 5,347,334 or a cartridge having a function of preventing double exposure is preferably used. Furthermore, a cartridge where the film can be loaded by merely inserting the film into the cartridge described in JP-A-6-85128 may also be used.

The thus-produced film cartridge may be used for photographing and development to satisfy the object or for various photographic enjoyments using a camera, a developing machine or a laboratory machine which will be described below. The film cartridge (patrone) can fully exert its function when, for example, a camera in a simple loading system described in JP-A-6-8886 and JP-A-6-99908, a camera having an automatic winding-up system described in JP-A-6-57398 and JP-A-6-101135, a camera where the film can be taken out and the kind of the film can be exchanged on the way of photographing described in JP-A-6-205690, a camera where the photographing information such as panorama photographing, high-vision photographing or normal photographing (capable of magnetic recording such that the print aspect ratio can be selected) can be magnetic recorded on the film described in JP-A-5-293138 and JP-A-5-283382, a camera having a function of preventing double exposure described in JP-A-6-101194 or a camera having a function to indicate the use state of the film or the like described JP-A-5-150577, is used.

The thus-photographed film may be processed in an automatic developing machine described in JP-A-6-222514 and JP-A-6-222545 and before, during or after the processing, the method of using the magnetic recording on the film described in JP-A-6-95265 and JP-A-4-123054 may be used. Also, the aspect ratio selecting function described in JP-A-5-19364 may be used.

In developing the film, if it is a cine-type development, the film is spliced according to the method described in JP-A-5-119461 before the processing. During or after the development, the film may be subjected to an attaching/detaching operation described in JP-A-6-148805.

After the processing as above, the film information may be converted into a print through back printing or front printing on a color paper according to the method described in JP-A-2-184835, JP-A-4-186335 and JP-A-6-79968. Furthermore, the film may be returned to the user together with the index print and the cartridge for return described in JP-A-5-11353 and JP-A-5-232594.

The cartridge used for the light-sensitive material to which the present invention is applied preferably has an embodiment described in U.S. Pat. Nos. 4,848,893, 5,317,355, 5,347,334 and 5,296,886, and JP-A-6-85128. Particularly, the effect of the present invention can be more outstandingly brought out when a thrust-type cartridge with the tongue being housed, because the inside of the cartridge can be nearly in a closet state.

Preferred embodiments of the camera used for the photographing of the light-sensitive material to which the present invention is applied are described below. The preferred embodiments include a simple loading camera described in JP-A-8886 and JP-A-6-99908, an automatic winding-up camera described in JP-A-6-57398 and JP-A-6-101135, a camera capable of taking the film out on the way of photographing described in JP-A-6-205690, a camera having a recording function capable of selecting the print aspect ratio described in JP-A-5-293138 and JP-A-5-283382, a camera with a function of preventing double exposure described in JP-A-6-101194, and a camera with a function of indicating the use state described in JP-A-150577.

Preferred embodiments of the laboratory processing and equipment for use in the present invention are described below. The preferred embodiments include the matters in relation to the use of magnetic recording described in JP-A-6-95265, JP-A-4-123054 and U.S. Pat. Nos. 5,034,838 and 5,041,933, the function capable of selecting the print aspect ratio described in JP-A-5-1936, the function of printing information on a print described in JP-A-2-184835, JP-A-4-186335 and JP-A-6-79968, the index printing function described in JP-A-5-11353 and JP-A-5-232594, the attach/detaching function described in JP-A-6-148805, the splicing function described in JP-A-5-119461, and the cartridge magazine function described in JP-A-4-346346 and JP-A-5-19439.

The magnetic recording layer for use in the present invention is descried below.

The magnetic recording layer for use in the present invention is provided by coating an aqueous or organic solvent-base coating solution obtained by dispersing magnetic particles in a binder on a support.

The magnetic particle for use in the present invention includes ferromagnetic iron oxide (e.g., $\gamma$-$Fe_2O_3$), Co-coated $\gamma$-$Fe_2O_3$, Co-coated magnetite, Co-containing magnetite, ferromagnetic chromium dioxide, ferromagnetic metal, ferromagnetic alloy, hexagonal Ba ferrite, Sr ferrite, Pb ferrite and Ca ferrite. Among these, Co-coated ferromagnetic iron oxide such as Co-coated $\gamma$-$Fe_2O_3$ is preferred. The shape of the magnetic particle may be any of acicular, ellipsoidal, spherical, cubic and platy forms. The specific surface area as $S_{BET}$ is preferably 20 $m^2/g$ or more, more preferably 30 $m^2/g$ or more. The saturation magnetization ($\sigma s$) of the ferromagnetic material is preferably from $3.0\times10^4$ to $3.0\times10^5$ A/m, more preferably from $4.0\times10^4$ to $2.5\times10^5$ A/m. The ferromagnetic particle may be subjected to a surface treatment with either one or both of silica and alumina or with an organic material. Furthermore, the ferromagnetic particle may be subjected to a surface treatment with a silane coupling agent or a titanium coupling agent as described in JP-A-6-161032. Also, a magnetic particle having coated on the surface thereof an inorganic or organic material described in JP-A-4-259911 and JP-A-5-81652 may be used.

The binder used for the magnetic particle may be a thermoplastic resin, a thermosetting resin, a radiation-curable resin, a reactive resin, an acid, alkali or biodegradable polymer, a natural polymer (e.g., cellulose derivative, saccharide derivative) or a mixture thereof described in JP-A-4-219569. The above-described resin has a Tg of from −40° C. to 300° C. and a weight average molecular weight of from 2,000 to 1,000,000. Examples of the resin include vinyl-based copolymers, cellulose derivatives such as cellulose diacetate, cellulose triacetate, cellulose acetate propionate, cellulose acetate butyrate and cellulose tripropionate, acrylic resins and polyvinyl acetal resins. Gelatin is also preferably used. Among these, cellulose di(tri)acetate is preferred. The binder may cured by adding thereto an epoxy-based, aziridine-based or isocyanate-based cross-linking agent. Examples of the isocyanate-based cross-linking agent include isocyanates such as tolylenediisocyanate, 4,4'-diphenylmethanediisocyanate, hexa-methylenediisocyanate and xylylenediisocyanate, reaction products of an isocyanate described above with polyalcohol (e.g., a reaction product of 3 mol of tolylenediisocyanate with 1 mol of trimethylolpropane), and polyisocyanates obtained by the condensation of an isocyanate described above, and these are described, for example, in JP-A-6-59357.

The magnetic material is preferably dispersed in the binder by the method using a kneader, a pin-type mill or an annular-type mill described in JP-A-6-35092 and these may also be preferably used in combination. The dispersant described in JP-A-5-088283 and other known depressants may be used. The thickness of the magnetic recording layer is from 0.1 to 10 $\mu$m, preferably from 0.2 to 5 $\mu$m, more preferably from 0.3 to 3 $\mu$m. The weight ratio of the magnetic particle to the binder is preferably from 0.5:100 to 60:100, more preferably from 1:100 to 30:100. The coated amount of magnetic particles is from 0.005 to 3 $g/m^2$, preferably from 0.01 to 2 $g/m^2$, more preferably from 0.02 to 0.05 $g/m^2$. The magnetic recording layer preferably has a transmission yellow density of from 0.01 to 0.50, more preferably from 0.03 to 0.20, still more preferably from 0.04 to 0.15. The magnetic recording layer may be provided by coating or printing throughout the back surface of a photographic support or like stripes. For coating the magnetic recording layer, air doctor, blade, air knife, squeeze, soakage, reverse roller, transfer roller, gravure, kiss, cast, spray, dip, bar or extrusion may be used and the coating solution described in JP-A-5-341436 is preferably used.

The magnetic recording layer may be designed to have additional functions, for example, to improve lubricity, control curling, prevent electrostatic charge, prevent adhesion or abrade the head, or other functional layers may be provided to undertake these functions. At least one or more of particles is preferably an abrasive of an aspheric inorganic particle having a Moh's hardness of 5 or more. The composition of the aspheric inorganic particle is preferably an oxide such as aluminum oxide, chromium oxide, silicon dioxide, titanium dioxide and silicone carbide, a carbide such as silicon carbide and titanium carbide, or a fine particle of diamond or the like. The abrasive may be subjected to a surface treatment with a silane coupling agent or a titanium coupling agent. This abrasive particle may be added to a magnetic recording layer or may be overcoated on the magnetic recording layer (for example, as a protective layer or a lubricant layer). The binder used here may be selected from those described above and the same binder as in the magnetic recording layer is preferably used. The light-sensitive material having a magnetic recording layer is described in U.S. Pat. Nos. 5,336,589, 5,250,404, 5,229,259 and 5,215,874 and European Patent 466130.

The film support for use in the present invention is described below. In the present invention, any film support may be used, however, in order to more successfully bright out the effect of the present invention, a polyester support (PEN) is preferred. The polyester support is particularly described below, but the details thereon including the light-sensitive material, the processing, the cartridge and the experimental examples, which are referred to later, are described in *JIII Journal of Technical Disclosure* No. 94-6023 (Mar. 15, 1994). The polyester for use in the present invention essentially consists of a diol and an aromatic dicarboxylic acid. Examples of the aromatic dicarboxylic acid include 2,6-naphthalenedicarboxylic acid, 1,5-naphthalenedicarboxylic acid, 1,4-naphthalenedicarboxylic acid, 2,7-naphthalenedicarboxylic acid, terephthalic acid, isophthalic acid and phthalic acid, and examples of the diol include diethylene glycol, triethylene glycol, cyclohexanedimethanol, bisphenol A and biphenol. The polymer polymerized from these includes homopolymers such as polyethylene terephthalate, polyethylene naphthalate and polycyclohexanedimethanol terephthalate. Among these, preferred are polyesters containing from 50 to 100 mol % of 2,6-naphthalenedicarboxylic acid, and more preferred is polyethylene 2,6-naphthalate. The average molecular weight is approximately from 5,000 to 200,000. The polyester for use in the present invention has a Tg of 50° C. or more, more preferably 90° C. or more.

The polyester support is then preferably heat treated at a heat treatment temperature of from 40° C. to less than Tg, more preferably from (Tg −20° C.) to less than Tg, so as to refuse the curling habit. This heat treatment may be performed at a constant temperature within the above-described temperature range or may be performed while cooling. The heat treatment time is from 0.1 to 1,500 hours, more preferably from 0.5 to 200 hours. The support may be heat treated in a roll form or as a web under conveyance. The surface may be made uneven (for example, by coating electrically conductive inorganic fine particles such as $SnO_2$ or $Sb_2O_5$)) to improve the surface state. Also, it is preferred to make some designs, for example, to knurl the edge part to slightly increase the height only of the edge and thereby prevent cut copy at the core portion. The heat treatment may be performed at any stage after the formation of the support film, after the surface treatment, after the coating of a back layer (e.g., antistatic agent, slipping agent) or after the coating of an undercoat layer. The preferred stage is after the coating of an antistatic agent.

Into the polyester, an ultraviolet absorbent may be kneaded in. Or, for preventing light piping, a commercially available paint or pigment for polyester, such as Diaresin produced by Mitsubishi Chemicals Industries, Ltd. or Kayaset produced by Nippon Kayaku K. K., may be kneaded in so as to attain the purpose.

In the present invention, in order to bond the support to constituent layers of the light-sensitive material, a surface treatment is preferably performed. Examples of the surface activation treatment include chemical treatment, mechanical treatment, corona discharge treatment, flame treatment, ultraviolet light treatment, high frequency treatment, glow discharge treatment, active plasma treatment, laser treatment, mixed acid treatment and ozone oxidation treatment. Among these surface treatments, preferred are ultraviolet irradiation treatment, flame treatment, corona treatment and glow treatment. The undercoating method is described below. The undercoat may comprise a single layer or two or more layers. Examples of the binder for the undercoat layer include copolymers starting from a monomer selected from vinyl chloride, vinylidene chloride, butadiene, methacrylic acid, acrylic acid, itaconic acid and maleic acid anhydride, polyethyleneimine, epoxy resin, grafted gelatin, nitrocellulose and gelatin. Examples of the compound which expands the support include resorcin and p-chlorophenol. Examples of the gelatin hardening agent for use in the undercoat layer include chromic salts (e.g., chrome alum), aldehydes (e.g., formaldehyde, glutaraldehyde), isocyanates, active halogen compounds (e.g., 2,4-dichloro-6-hydroxy-S-triazine), epichlorohydrin resin and active vinyl sulfone compounds. Furthermore, the undercoat layer may contain a matting agent, for example, a fine particle of an inorganic material such as silica and titanium oxide, or a polymethyl methacrylate copolymer fine particle (of from 0.01 to 10 $\mu$m).

In the present invention, an antistatic agent is preferably used. Examples of the antistatic agent include polymers containing a carboxylic acid, a carboxylate or a sulfonate, cationic polymers, and ionic surface active agent compounds.

Most preferred antistatic agents are a fine particle of at least one crystalline metal oxide having a volume resistivity of $10^7$ Ω·cm or less, more preferably $10^5$ Ω·cm or less, and a particle size of from 0.001 to 1.0 $\mu$m selected from zinc oxide, titanium oxide, tin oxide, aluminum oxide, silica, $In_2O_3$, MgO, BaO, $MoO_3$ and $V_2O_5$, or a composite oxide thereof (e.g., Sb, P, B, In, S, Si, C), and a fine particle of a sol-like metal oxide or a composite oxide thereof. The content of the antistatic agent in the light-sensitive material is preferably from 5 to 500 mg/$m^2$, more preferably from 10 to 350 mg/$m^2$. The ratio of the electrically conductive crystalline oxide or a composite oxide thereof to the binder is preferably from 1/300 to 100/1, more preferably from 1/100 to 100/5.

The light-sensitive material of the present invention preferably has slipperiness. The slipping agent-containing layer is preferably provided on both the light-sensitive layer surface and the back surface. The slipperiness in terms of a coefficient of dynamic friction is preferably from 0.01 to 0.25. This value is determined when the light-sensitive material is transported at a speed of 60 cm/min (25° C., 60% RH) against a stainless steel ball having a diameter of 5 mm. In this evaluation, even when the other part material is changed to the light-sensitive layer surface, a value almost on the same level is obtained.

The slipping agent which can be used in the present invention includes polyorganosiloxane, higher fatty acid amide, higher fatty acid metal salts and esters of a higher fatty acid with a higher alcohol. Examples of the polyorganosiloxane which can be used include polydimethylsiloxane, polydiethylsiloxane, polystyrylmethylsiloxane and polymethylphenylsiloxane. The layer to which the slipping agent is added is preferably an outermost layer of the emulsion layer or a back layer. In particular, polydimethylsiloxane and esters having a long chain alkyl group are preferred.

The light-sensitive material of the present invention preferably contains a matting agent. The matting agent may be present on either one of the emulsion surface and the back surface but is preferably added to the outermost layer on the emulsion layer side. The matting agent may or may not be soluble in the processing solution and preferably, these two types of matting agents both are used in combination. Preferred examples thereof include polymethyl methacrylate, poly(methyl methacrylate/methacrylic acid=9/1 or 5/5 (by mol)) and particulate polystyrene. The particle size is preferably from 0.8 to 10 μm, the particle size distribution is preferably narrower, and 90% by number or more of all particles preferably have a size between 0.9 and 1.1 times the average particle size. In order to increase the matting property, fine particles of 0.8 μm or less are preferably added at the same time and examples thereof include polymethyl methacrylate (0.2 μm), poly(methyl methacrylate/methacrylic acid=9/1 (by mol), 0.3 μm), particulate polystyrene (0.25 μm) and colloidal silica (0.03 μm).

The light-sensitive material for use in the present invention may be sufficient if at least one light-sensitive layer is provided on a support. A typical example thereof is a silver halide photographic light-sensitive material comprising a support having thereon at least one light-sensitive layer consisting of a plurality of silver halide emulsion layers having substantially the same color sensitivity but different in the light sensitivity. The light-sensitive layer is a unit light-sensitive layer having color sensitivity to any of blue light, green light and red light. In the case of a multi-layer silver halide color photographic light-sensitive material, the unit light-sensitive layers are generally arranged in the order of a red-sensitive layer, a green-sensitive layer and a blue-sensitive layer from the support side. However, depending upon the purpose, this arrangement order may be reversed or a layer having different light sensitivity may be superposed between layers having the same color sensitivity. A light-insensitive layer may also be provided between the above-described silver halide light-sensitive layers or as an uppermost or lowermost layer. Those layers may contain a coupler, a DIR compound or a color mixing inhibitor which will be described later. The plurality of silver halide emulsion layers constituting each unit light-sensitive layer are preferably provided to arrange two layers of a high-sensitivity emulsion layer and a low-sensitivity emulsion layer such that the light sensitivity sequentially decreases toward the support as described in German Patent 1,121,470 and British Patent 923,045. Furthermore, it may also be possible to provide a low-sensitivity emulsion layer farther from the support and a high-sensitivity emulsion layer closer to the support as described in JP-A-57-112751, JP-A-62-200350, JP-A-62-206541 and JP-A-62-206543.

Specific examples of the layer arrangement from the remotest side from the support include orders such as a low-sensitivity blue-sensitive layer (BL)/a high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), BH/BL/GL/GH/RH/RL and BH/BL/GH/GL/RL/RH.

As described in JP-B-55-34932, the emulsion layers may be arranged in the order of a blue-sensitive layer/GH/RH/GL/RL from the remotest side from the support. Also, as described in JP-A-56-25738 and JP-A-62-63936, the emulsion layers may be arranged in the order of a blue-sensitive layer/GL/RL/GH/RH from the remotest side from the support.

In addition, an arrangement consisting of three layers different in the light sensitivity may be used as described in JP-B-49-15495, where a silver halide emulsion layer having highest light sensitivity is provided as an upper layer, a silver halide emulsion layer having light sensitivity lower than that of the upper layer is provided as a medium layer and a silver halide-emulsion layer having light sensitivity lower than that of the medium layer is provided as a lower layer so as to sequentially decrease the light sensitivity toward the support. Even in this structure consisting of three layers different in the light sensitivity, the layers having the same spectral sensitivity may be provided in the order of a medium-sensitivity emulsion layer/a high-sensitivity emulsion layer/a low-sensitivity emulsion layer from the remote side from the support as described in JP-A-59-202464.

In addition, those layers may also be provided in the order of a high-sensitivity emulsion layer/a low-sensitivity emulsion layer/a medium-sensitivity emulsion layer or a low-sensitivity emulsion layer/a medium-sensitivity emulsion layer/a high-sensitivity emulsion layer. The layer arrangement may be changed as described above also in the case where the unit light-sensitive layer consists of four or more layers.

In order to improve the color reproducibility, a donor layer (CL) having a spectral sensitivity distribution different from those of main light-sensitive layers such as BL, GL and RL and having an interlayer effect is preferably provided adjacent to or in the vicinity of a main light-sensitive layer as described in U.S. Pat. Nos. 4,663,271, 4,705,744 and 4,707,436, JP-A-62-160448 and JP-A-63-89850.

The processing method of the present invention can be applied to various light-sensitive materials for photographing. Examples thereof include color negative film, color reversal film and negative film for movie. Among these, the present invention is preferably applied to the color negative film and the color reversal film, more preferably to the color negative film.

One practical embodiment of the present invention is described below by referring to the drawings attached hereto.

FIG. 1 is a block diagram of a replenishing unit for replenishing a developer replenisher to a developing tank 2. Although not shown, a bleaching bath, a fixing bath, a stabilizing bath, a drying zone and the like are disposed and connected to the developing tank. The development processing apparatus is constituted by these respective processing units.

The development processing apparatus can develop both a high silver bromide light-sensitive material and a high silver chloride light-sensitive material, where with the increase in the processed amount (processing ratio) of the high silver chloride light-sensitive material, the amount of the developer replenisher supplied to the developing tank 2 is reduced and at the same time, the concentration thereof is increased. The replenishing amount and the concentration ratio of the replenisher are calculated by the formula described above.

In adjacent to the developing tank 2, replenishing tanks 6*a* to 6*c* and a diluting water tank 8 are disposed. In the replenishing tank 6*a* to 6*c*, thick replenishers 4*a*, 4*b* and 4*c* (agent A, agent B and agent C) are reserved, respectively, which thick replenishers are each diluted with a diluting water 14 and mixed each other to form a developer replenisher having a predetermined concentration. The thick replenishers 4*a* to 4*c* in the replenishing tanks 6*a* to 6*c* are supplied into the developing tank 2 each in a predetermined amount by pumps 18, 19 and 20 according to the processed amount of the light-sensitive material 16 processed in the developing tank 2. The water 14 in the diluting water tank 8 is fed to the developing tank 2 by a pump 22.

A replenishment controlling unit 24 comprises a sensor 26 for detecting the processed amount of the light-sensitive material 16, a memory 28 for storing the feeding amount of the diluting water 14 according to the processed amount of the light-sensitive material 16, a timer 30 for measuring the time, an arithmetic means 31 for performing various arithmetic operations, and a controlling means 32 connected thereto for controlling the driving of pumps 18 to 20 and 22 according to the processed amount.

To the controlling means 32, an input means 34 is connected, so that the processed amount of the light-sensitive material 16 can be manually input. For example, the number of rolls of the light-sensitive material 16 or the kind thereof can be input from input means 34 by means of keys and from such information, the processed amount can be set.

The sensor 26 is disposed in the vicinity of the light-sensitive material 16 which is transported into the developing tank 2, and detects the transported amount of the light-sensitive material 16 by a contact or non-contact system. The sensor 26 can also detect the width of the light-sensitive material 16 and from the width and the transported amount of the light-sensitive material 16, the processed area of the light-sensitive material 16 can be detected. For the sensor 26, an infrared sensor is preferably used.

The memory 28 stores as a look-up table (LUT) a feeding amount of the diluting water 14 to the developing tank 2 for obtaining proper replenishing amount and concentration of the developer replenisher according to the processed amount of the high silver chloride light-sensitive material 16.

The feeding amount of the diluting water 14 into the developing tank 2 is set to decrease as the processing ratio of the high silver chloride light-sensitive material 16 increases. For example, in the case where only a high silver bromide light-sensitive material 16 is processed, the replenishing amount of the developer solution is set such that the agent A is 24 ml/m$^2$, the agent B is 3.4 ml/m$^2$, the agent C is 12.6 ml/m$^2$ and the water is 328 ml/m$^2$ (total: 368 ml), and the concentration is set to 1, then, when the processing ratio of the high silver chloride light-sensitive material 16 reaches 5%, the proper replenishing amount of the developer replenisher is 368×0.95=350 ml/m$^2$ and the proper concentration is 1.05. Therefore, a feeding amount of the diluting water 14 for giving a concentration of 1.05 at the mixing is stored (310 ml/m$^2$).

Similarly, when the processing ratio of the high silver chloride light-sensitive material 16 reaches 10%, the proper replenishing amount of the developer replenisher is 331 ml/m$^2$ and the proper concentration is 1.18, therefore, a feeding amount of the diluting water 14 for giving a concentration of 1.18 at the mixing is stored (291 ml/m$^2$).

In the memory 28, a calculation formula for calculating a proper concentration of the developer replenisher 4 according to the processing ratio of the high silver chloride light-sensitive material 16 is stored.

The controlling means 32 calculates the processed area using the arithmetic means 31 from the width and the transported amount of the high silver chloride light-sensitive material 16 detected by the sensor 26. The processed area calculated is accumulated and stored in the memory 28. The controlling unit 32 reads from the memory 28 the information on the diluting water 14 for obtaining proper concentration and replenishing amount of the developer replenisher according to the processed area, namely, processed amount of the high silver chloride light-sensitive material 16, and drives the pump 22 to feed a proper amount of diluting water 14.

The control for changing the concentration of the developer replenisher and the control for changing the replenishing amount are performed by changing the replenishing amount of the diluting water 14 when the thick replenisher 4 and the diluting water 14 are supplied to the developing tank 2. Accordingly, the total replenishing amount in once mixing is a total of the amounts of thick replenishers 4*a* to 4*c* supplied from the replenishing tanks 6*a* to 6*c* into the developing tank 2 and the amount of water 14 supplied from the diluting water tank 8 into the developing tank 2.

Figure 2:
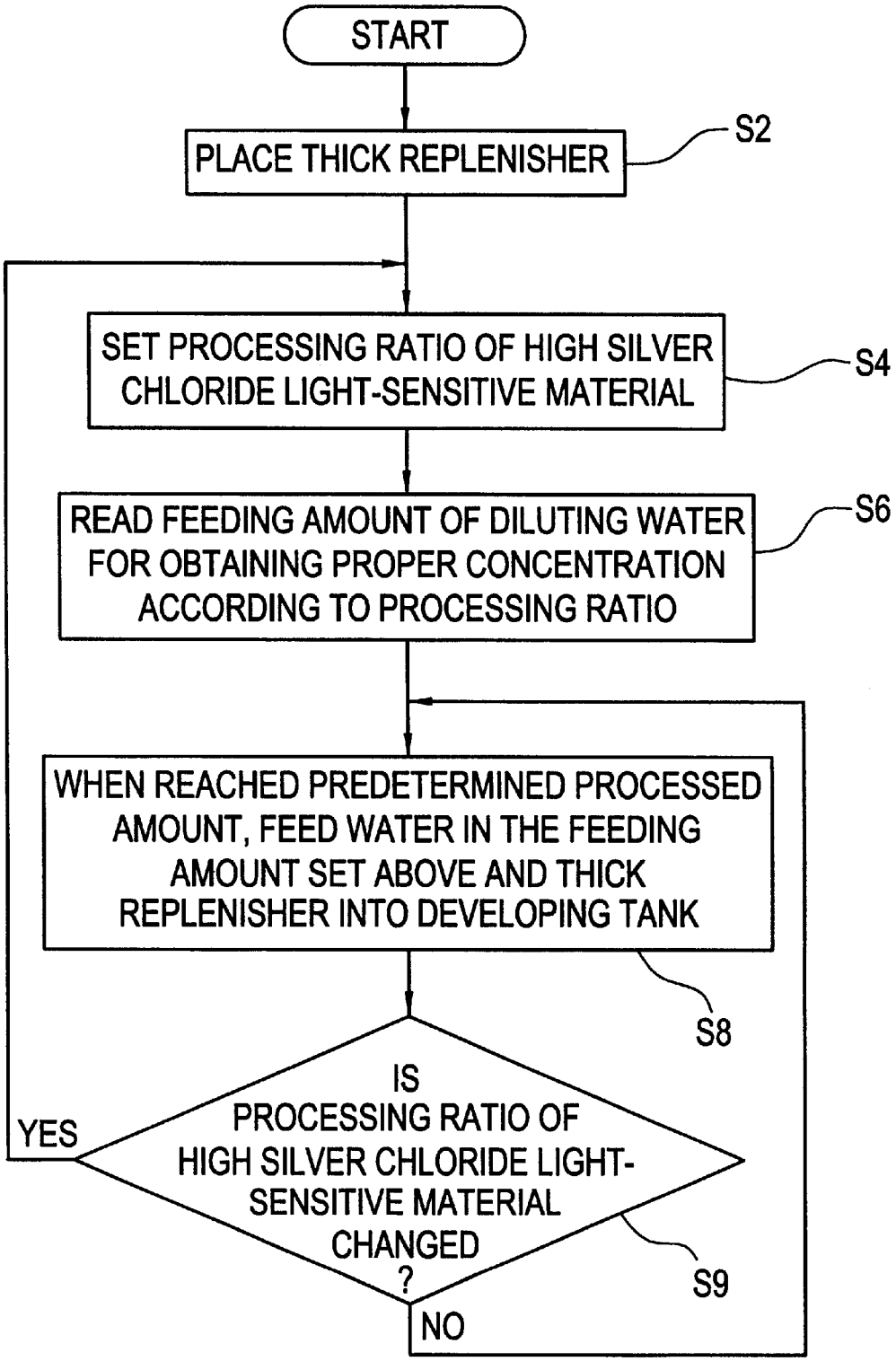
FIG. 2 is a flow chart showing the replenishment control.

The replenishment control including the control for changing the concentration and the replenishing amount by the control means 31 is described below by referring to FIG. 2. The thick replenisher 4 and the diluting water 14 are fed to the developing tank 2 whenever a predetermined amount of the light-sensitive material processed.

First, replenishing tanks 6*a* to 6*c* reserving the thick replenisher are disposed and flow lines each having provided on the way of passage a pump 18, 19 or 20 connect the replenishing tanks 6*a* to 6*c* with the developing tank 2 (S2). Then, the processed amount of the high silver chloride light-sensitive material 16 is set by the sensor 26 or the input means 34 (S4). Subsequently, a feeding amount of the diluting water 14 for obtaining a proper concentration of the developer replenisher in correspondence to the processed amount set by the sensor 26 or the input means 34 is read out from the memory 28 (S6). When a predetermined amount of the developed light-sensitive material 16 is detected, the pump 22 is driven to ensure the feeding amount read out from the memory 28 and thereby feed the diluting water 14 into the developing tank 2, and at the same time, pumps 18 to 20 are driven to supply the thick replenishers 4*a*, 4*b* and 4*c* into the developing tank 2 (S8). Thereafter, whether the processed amount of the high silver chloride light-sensitive material is changed is judged.

If changed, return to the step S4 for setting the processing amount of the high silver chloride light-sensitive material and if not changed, return to the step S8 for feeding the thick replenisher into the developing tank (S9).

According to this control, as the processing ratio of the high silver chloride light-sensitive material 16 becomes higher, the concentration of the developer solution supplied into the developing tank 2 is substantially elevated and at the same time, the replenishing amount thereof is reduced. The total of the amounts of the thick replenishers 4*a* to 4*c* fed from the replenishing tanks 6*a* to 6*c* and the amount of water 14 fed from the diluting water tank 8 is the replenishing amount of the developer replenisher in once mixing.

Figure 3:
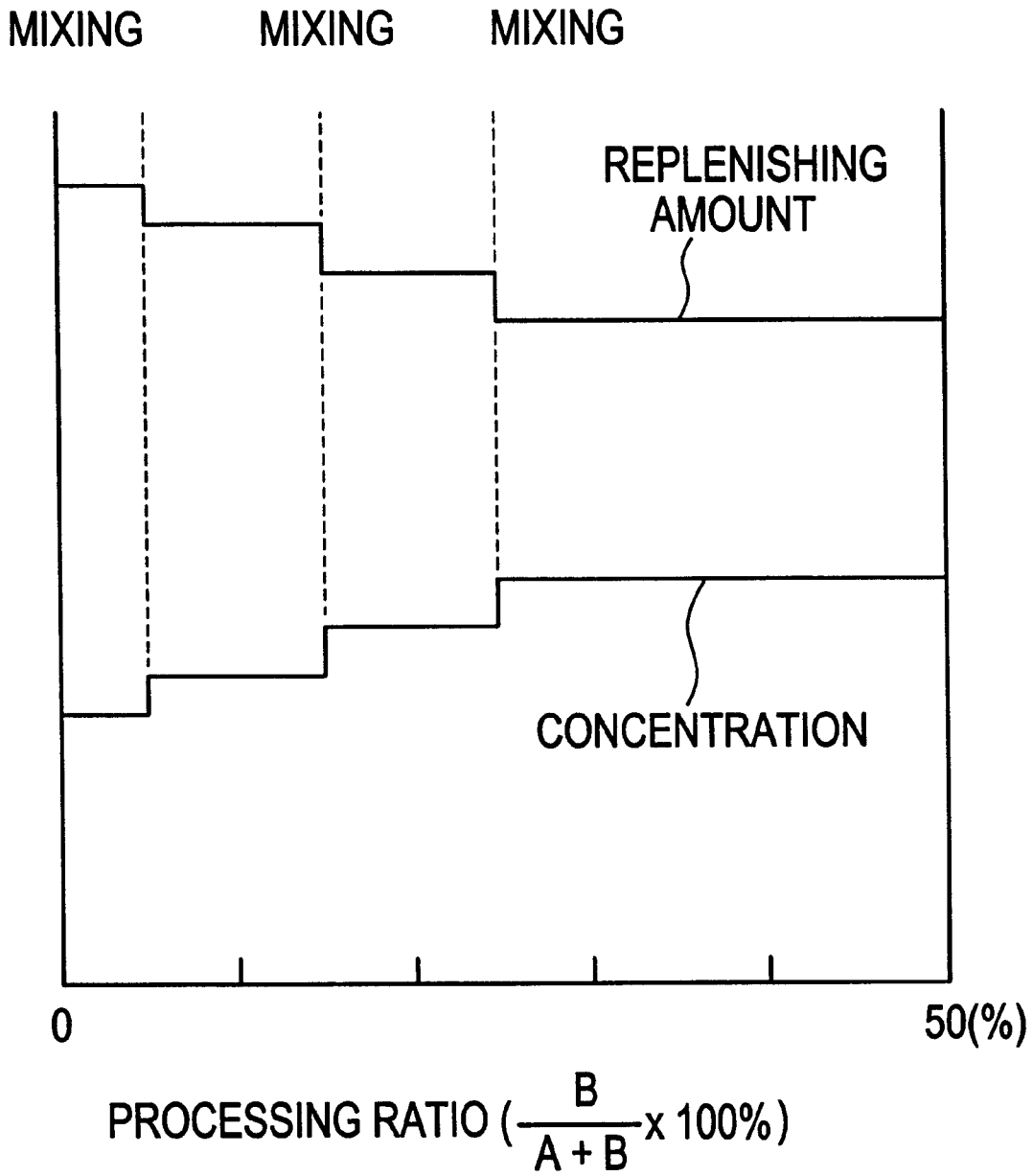
FIG. 3 is a graph showing the relationship between the replenishing amount and the concentration according to the processing ratio of a high silver chloride light-sensitive material.

As shown in FIG. 3 which is a graph showing the relationship between the replenishing amount and the concentration of the developer replenisher, with the increase in the processing ratio of the high silver chloride light-sensitive material 16, the replenishing amount in once mixing decreases and at this time, the concentration of the developer replenisher becomes high. As such, resulting of the reduction in the replenishing amount, the liquid amount in the developing tank 2 decreases, whereby the bromide ion concentration in the developer 36 can be maintained at a necessary value without undergoing any reduction. Furthermore, even if the replenishing amount of the developer replenisher is reduced, the concentration is increased, therefore, the developing agent and the like can be properly supplied each in a necessary amount.

As described in the foregoing pages, even in the process of allowing the processing ratio of the high silver chloride light-sensitive material 16 to increase, the bromide ion concentration and the concentrations of the developing agent and the like in the developer 36 are maintained at respective proper values, therefore, both a high silver bromide light-sensitive material and a high silver chloride light-sensitive material can be satisfactorily processed.

Incidentally, FIG. 3 shows one example of the characteristics and the reduction ratio of the replenishing amount and the increase ratio of the concentration are by no means limited to the characteristics shown in the Figure. The replenishing amount and the concentration each may not be stepwise decreased or increased or may be linearly decreased or increased Another practical embodiment of the present invention is described below by referring to the drawings attached hereto.

Figure 4:
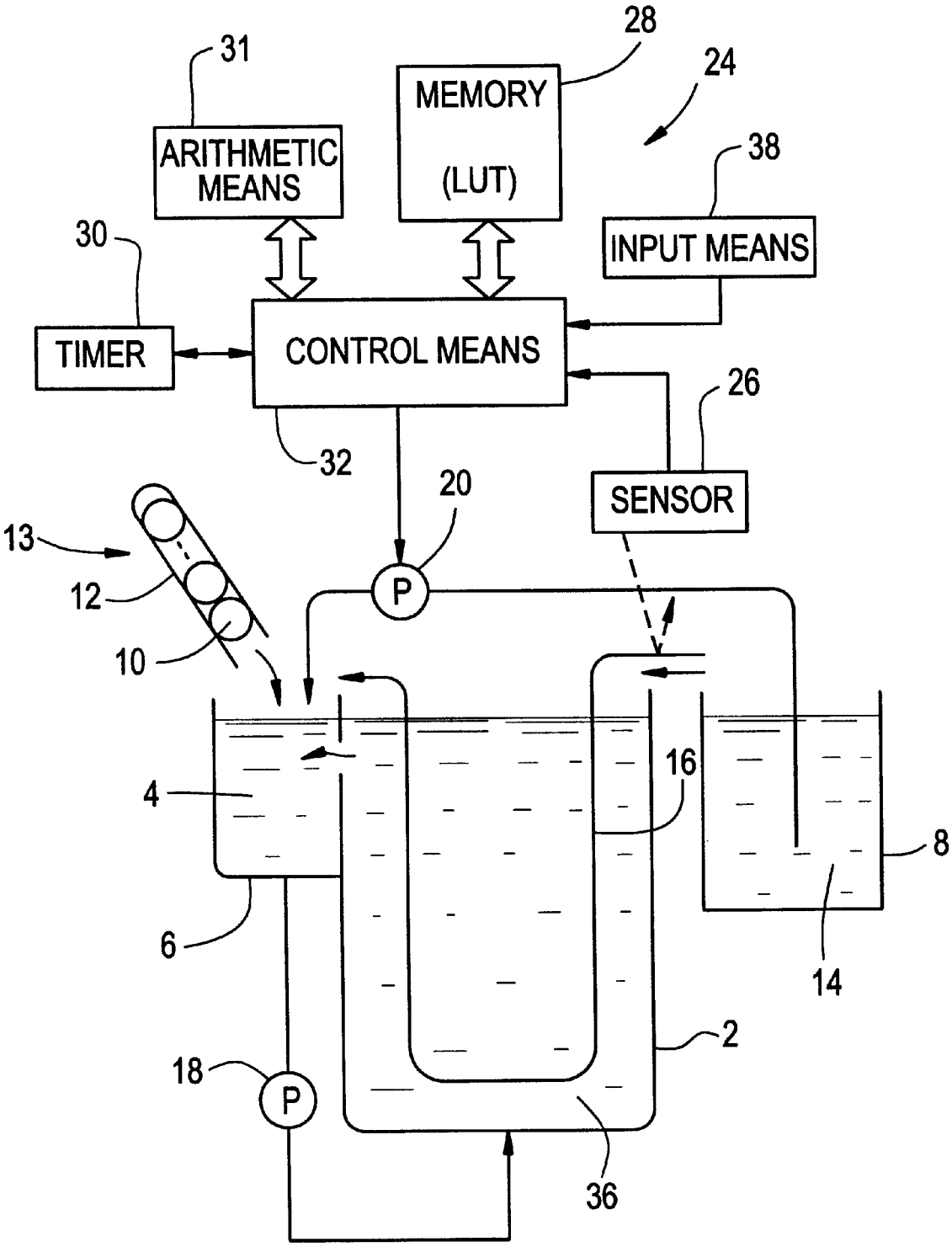
FIG. 4 is a block diagram of a replenishing unit.

FIG. 4 is a block diagram of a replenishing unit for replenishing a developer replenisher 4 to a developing tank 2. Although not shown, a bleaching bath, a fixing bath, a stabilizing bath, a drying zone and the like are disposed and connected to the developing tank. The development processing apparatus is constituted by these respective processing units.

The development processing apparatus can develop both a high silver bromide light-sensitive material and a high silver chloride light-sensitive material, where with the increase in the processed amount (processing ratio) of the high silver chloride light-sensitive material, the amount of the developer replenisher 4 supplied to the developing tank 2 is reduced and at the same time, the concentration thereof is increased.

In the lateral surface of the developing tank 2, a replenishing tank 6 into which the developer 36 in the developing tank can flow is provided and also a diluting water tank 8 is adjacently disposed. A solid processing agent 10 is automatically fed from a container 12 constituting a solid processing agent feeding unit 13 into the replenisher tank 6. For the solid mixed processing agent feeding unit 13, various known devices may be used. Into an auxiliary tank 6, the solid processing agent 10 is charged at predetermined intervals and also water 14 is fed to prepare a replenisher 4 having a substantially predetermined concentration. The replenisher 4 prepared and supplied in the auxiliary tank 6 is mixed into the developing tank 2 by a pump 18 for the circulation. The water 14 in the diluting water tank 8 is fed to the auxiliary tank 6 by a pump 20.

A replenishment controlling unit 24 comprises a sensor 26 as a processed amount setting means for detecting the processed amount of the light-sensitive material 16, a memory 28 for storing the feeding amount of the water 14 according to the processed amount of the light-sensitive material 16, a timer 30 for measuring the time, an arithmetic means 31 for performing various arithmetic operations, and a controlling means 32 connected thereto for controlling the driving of the pump 20 according to the processed amount.

To the controlling means 32, an input means 38 is connected as a processed amount setting means, so that the processed amount of the light-sensitive material 16 can be manually input. For example, the number of rolls of the light-sensitive material 16 or the kind thereof can be input from the input means 38 by means of keys and from such information, the processed amount can be set.

The sensor 26 is disposed in the vicinity of the light-sensitive material 16 which is transported into the developing tank 2, and detects the transported amount of the light-sensitive material 16 by a contact or non-contact system. The sensor 26 can also detect the width of the light-sensitive material 16 and from the width and the transported amount of the light-sensitive material 16, the processed area of the light-sensitive material 16 can be detected. For the sensor 26, an infrared sensor is preferably used.

The memory 28 stores as a look-up table (LUT) a feeding amount of the diluting water 14 to the developing tank 2 for obtaining proper replenishing amount and concentration of the replenisher 4 according to the processed amount of the high silver chloride light-sensitive material 16.

The feeding amount of the water 14 into the auxiliary tank 6 is set to decrease as the processing ratio of the high silver chloride light-sensitive material 16 increases. For example, in the case where only a high silver bromide light-sensitive material 16 is processed, the replenishing amount is set to 340 ml/m$^2$ and the concentration is set to 1, then, when the processing ratio of the high silver chloride light-sensitive material 16 reaches 5%, the proper replenishing amount of the replenisher 4 is 323 ml/m$^2$ and the proper concentration is 1.05. Therefore, a feeding amount of the diluting water 14 for giving a concentration of 1.05 at the mixing is stored.

Similarly, when the processing ratio of the high silver chloride light-sensitive material 16 reaches 10%, the proper replenishing amount of the replenisher 4 is 289 ml/m$^2$ and the proper concentration is 1.18, therefore, a feeding amount of the diluting water 14 for giving a concentration of 1.18 at the mixing is stored.

In the memory 28, a calculation formula for calculating a proper concentration of the replenisher 4 according to the processing ratio of the high silver chloride light-sensitive material 16 is stored.

The controlling means 32 calculates the processed area using the arithmetic means 31 from the width and the transported amount of the high silver chloride light-sensitive material 16 detected by the sensor 26. The processed area calculated is accumulated and stored in the memory 28. The controlling unit reads from the memory 28 the information on the water 14 for obtaining proper concentration and replenishing amount of the replenisher according to the processed area, namely, processed amount of the high silver chloride light-sensitive material 16, and drives the pump 20 to feed a proper amount of water 14.

Figure 5:
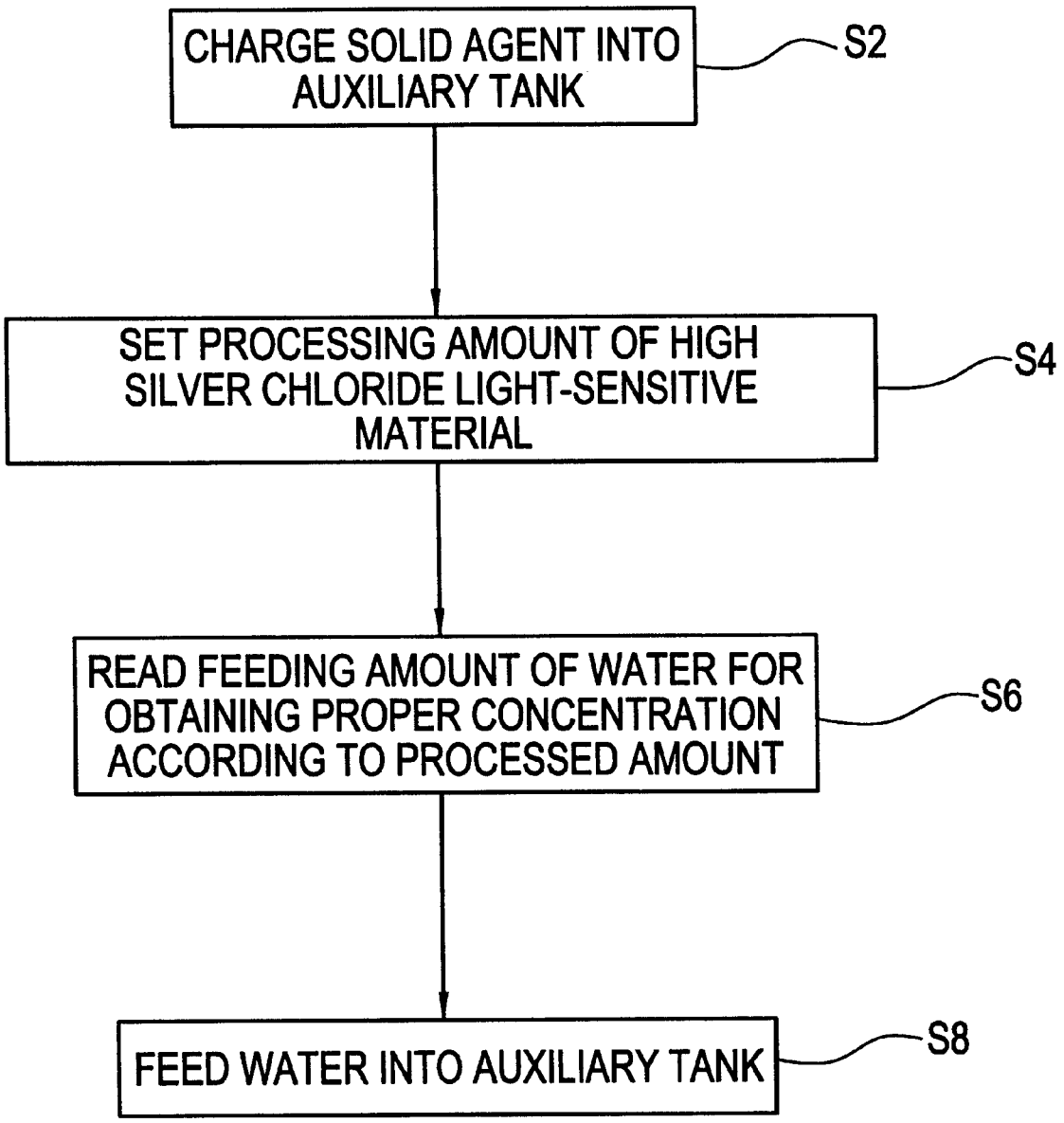
FIG. 5 is a flow chart showing the concentration change control.

The replenishment control by the control means 32 is described below by referring to FIG. 5. FIG. 5 is a flow chart showing the control for changing the concentration of the replenisher.

First, the solid processing agent 10 is charged into the auxiliary tank 6 (S2). Then, the processed amount of the high silver chloride light-sensitive material 16 is set by the sensor 26 or the input means 38 (S4). Subsequently, a feeding amount of the water 14 for obtaining a proper concentration of the replenisher 4 in correspondence to the processed amount set by the sensor 26 is read out from the memory 28 (S6). Thereafter, the pump 20 is driven to obtain the feeding amount read out and thereby feed the water 14 into the auxiliary tank 6 (S8).

According to this control, as the processing ratio of the high silver chloride light-sensitive material 16 becomes higher, the concentration of the solution mixed is elevated and also as the processing ratio of the high silver chloride light-sensitive material 16 becomes higher, a replenisher 4 in a higher concentration is supplied into the developing tank 2 via pump 18.

Figure 6:
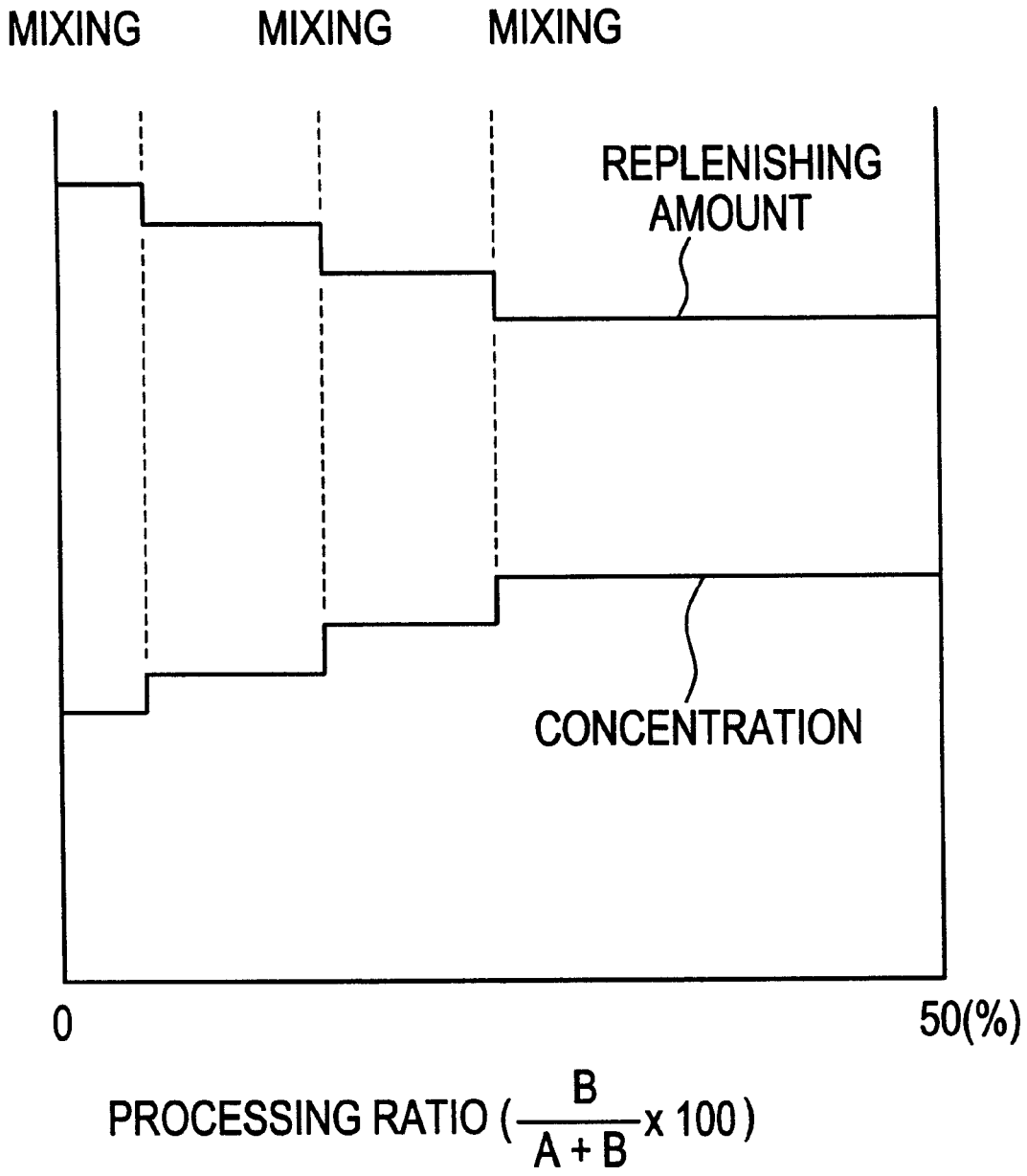
FIG. 6 is a graph showing the relationship between the replenishing amount and the concentration according to the processing ratio of a high silver chloride light-sensitive material.

As shown in FIG. 6 which is a graph showing the relationship between the replenishing amount and the concentration of the replenisher 4, with the increase in the processing ratio of the high silver chloride light-sensitive material 16, the replenishing amount in once mixing decreases and at this time, the concentration of the replenisher 4 becomes high. As such, resulting of the reduction in the replenishing amount, the liquid amount in the developing tank 2 decreases, whereby the bromide ion concentration in the developer 36 can be maintained at a necessary value without undergoing any reduction. Furthermore, even if the replenishing amount of the replenisher 4 is reduced, the concentration is increased, therefore, the developing agent and the like can be properly supplied each in a necessary amount.

As described in the foregoing pages, even in the process of allowing the processing ratio of the high silver chloride light-sensitive material 16 to increase, the bromide ion concentration and the concentrations of the developing agent and the like in the developer 36 are maintained at respective proper values, therefore, both a high silver bromide light-sensitive material and a high silver chloride light-sensitive material can be satisfactorily processed.

Incidentally, FIG. 6 shows one example of the characteristics and the reduction ratio of the replenishing amount and the increase ratio of the concentration are by no means limited to the characteristics shown in the Figure, and various modifications may be made.

For example, in the above-described practical embodiment, the control is performed such that the replenishing amount of water supplied in once mixing is made smaller than that at the last time mixing to reduce the replenishing amount. However, without changing the feeding amount of water whenever one solid processing agent is charged, the control may be performed, for example, in such a way that the replenishing amount of water is reduced after a plurality of solid processing agents are charged and the replenishing amount of water is further reduced after a plurality of solid processing agents are further charged. This is a control of stepwise changing the replenishing amount and the concentration whenever a plurality of solid processing agents are charged. More specifically, the water is charged in a constant amount based on the solid processing agent until a certain number of solid processing agents are charged and when the number of solid processing agents reached a predetermined value, the charging amount of water is reduced, so that the replenishing amount and the concentration can be stepwise decreased or increased.

Furthermore, without employing a system of feeding water into the auxiliary tank only after the solid processing agent is charged, the water may be continuously fed, in other words, by adjusting the integrated feeding amount of water continuously fed, the replenishing amount may be reduced or the concentration may be increased.

In the practical embodiments described above, the solid processing agent used is a tablet but the form of the processing agent is not limited to the tablet. Although specific properties and advantageous points are not described, a system of directly charging a powdery processing agent into the auxiliary tank used for the apparatus described, for example, in JP-A-4-213454 may also be employed.

Still another practical embodiment of the present invention is described below by referring to the drawings attached hereto.

Figure 7:
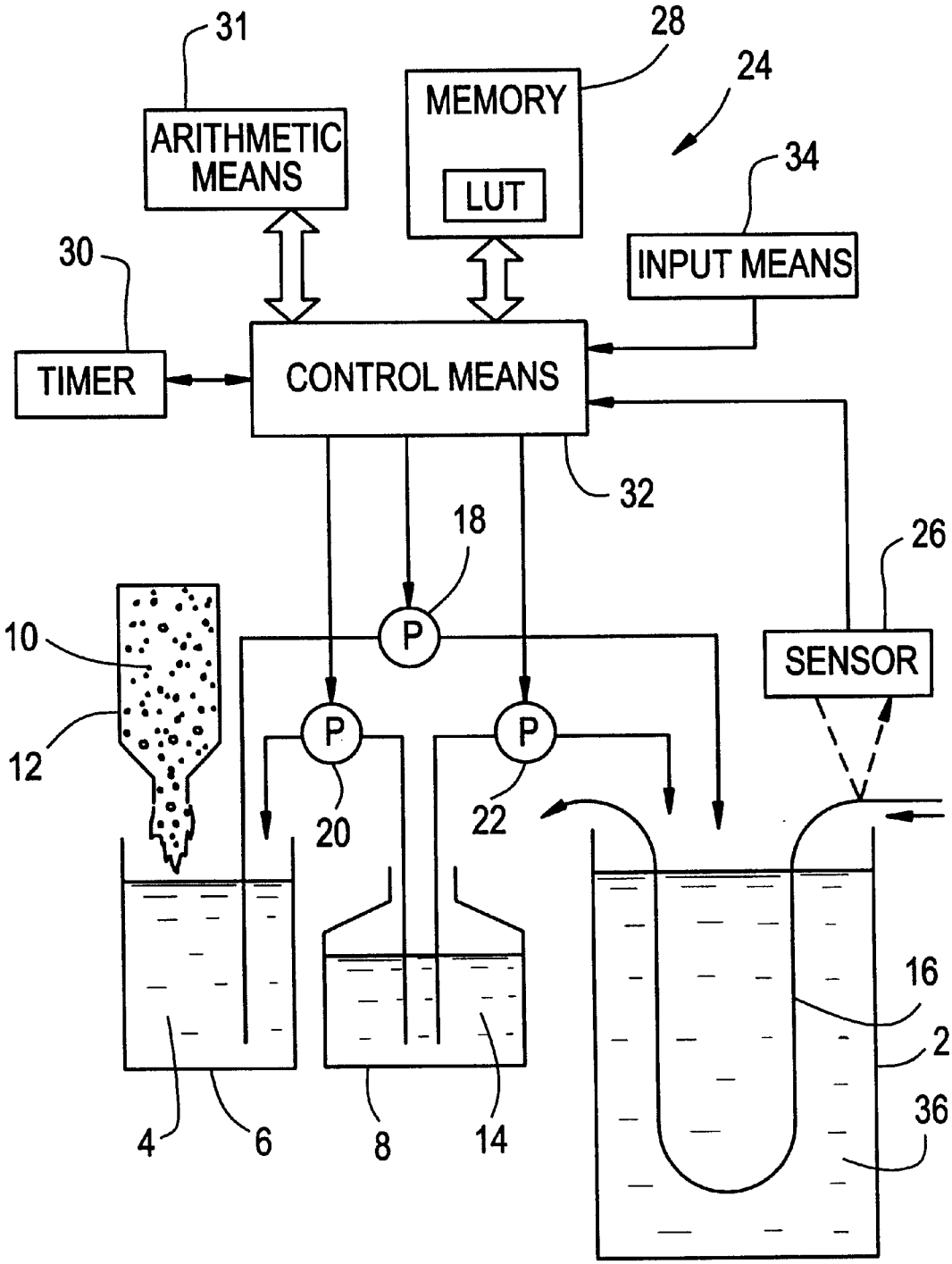
FIG. 7 is a block diagram of a replenishing unit.

FIG. 7 is a block diagram of a replenishing unit for replenishing a developer replenisher 4 to a developing tank 2. Although not shown, a bleaching bath, a fixing bath, a stabilizing bath, a drying zone and the like are disposed and connected to the developing tank. The development processing apparatus is constituted by these respective processing units.

The development processing apparatus can develop both a high silver bromide light-sensitive material and a high silver chloride light-sensitive material, where with the increase in the processed amount (processing ratio) of the high silver chloride light-sensitive material, the amount of the developer replenisher 4 supplied to the developing tank 2 is reduced and at the same time, the concentration thereof is increased. The replenishing amount and the concentration ratio of the replenisher 4 are calculated by the formula described above.

In adjacent to the developing tank 2, a replenisher tank 6 and a dissolving water tank 8 are disposed. In this practical embodiment, a concentrated solution is used as the mixed processing agent for the developer replenisher. The mixed processing agent 10 for the developer replenisher is manually or automatically fed from a container 12 into the replenisher tank 6. In the replenisher tank 6, the mixed processing agent 10 for the developer replenisher is charged and also diluting water 14 is fed, as a result, a replenisher 4 having a predetermined concentration is prepared and reserved. The replenisher 4 prepared in the replenisher tank 6 is supplied in a predetermined amount into the developing tan 2 by a pump 18 according to the processed amount of the light-sensitive material 16 processed in the developing tank 2. The water 14 in the dissolving water tank 8 is fed to the replenisher thank 6 and the developing tank 2 by pumps 20 and 22, respectively.

A replenishment controlling unit 24 comprises a sensor 26 for detecting the processed amount of the light-sensitive material 16, a memory 28 for storing the feeding amount of the dissolving water 14 according to the processed amount of the light-sensitive material 16, a timer 30 for measuring the time, an arithmetic means 31 for performing various arithmetic operations, and a controlling means 32 connected thereto for controlling the driving of pumps 18, 20 and 22 according to the processed amount or with the lapse of time.

To the controlling means 32, an input means 34 is connected, so that the processed amount of the light-sensitive material 16 can be manually input. For example, the number of rolls of the light-sensitive material 16 or the kind thereof can be input from the input means 34 by means of keys and from such information, the processed amount can be set.

The sensor 26 is disposed in the vicinity of the light-sensitive material 16 which is transported into the developing tank 2, and detects the transported amount of the light-sensitive material 16 by a contact or non-contact system. The sensor 26 can also detect the width of the light-sensitive material 16 and from the width and the transported amount of the light-sensitive material 16, the processed area of the light-sensitive material 16 can be detected. For the sensor 26, an infrared sensor is preferably used.

The memory 28 stores as a look-up table (LUT) a feeding amount of the dissolving water 14 to the replenisher tank 6 for obtaining a proper concentration of the replenisher 4 according to the processed amount of the high silver chloride light-sensitive material 16 and a proper replenishing amount of the replenisher 4 according to the processed amount of the high silver chloride light-sensitive material 16.

The feeding amount of the dissolving water 14 into the replenisher tank 2 is set to decrease as the processing ratio of the high silver chloride light-sensitive material 16 increases. For example, in the case where only a high silver bromide light-sensitive material 16 is processed, the replenishing amount is set to 340 ml/m$^2$ and the concentration is set to 1, then, when the processing ratio of the high silver chloride light-sensitive material 16 reaches 5%, the proper replenishing amount of the replenisher 4 is 323 ml/m$^2$ and the proper concentration is 1.05. Therefore, a feeding amount of the dissolving water 14 for giving a concentration of 1.05 at the mixing is stored.

Similarly, when the processing ratio of the high silver chloride light-sensitive material 16 reaches 10%, the proper replenishing amount of the replenisher 4 is 289 ml/m$^2$ and the proper concentration is 1.18, therefore, a feeding amount of the dissolving water 14 for giving a concentration of 1.18 at the mixing is stored.

In the memory 28, a calculation formula for calculating a proper concentration of the replenisher 4 according to the processing ratio of the high silver chloride light-sensitive material 16 is stored.

The controlling means 32 calculates the processed area using the arithmetic means 31 from the width and the transported amount of the high silver chloride light-sensitive material 16 detected by the sensor 26. The processed area calculated is accumulated and stored in the memory 28. The controlling unit 32 reads from the memory 28 the information on the dissolving water 14 for obtaining proper concentration of the replenisher according to the processed area, namely, processed amount of the high silver chloride light-sensitive material 16, and drives the pump 20 to feed a proper amount of dissolving water 14.

The control for changing the concentration of the replenisher 4 is performed at the mixing of the replenisher 4 and the control for changing the replenishing amount of the replenisher 4 is performed by changing the replenishing amount when the replenisher 4 is supplied to the developing tank 2.

The dissolving water in the dissolving water tank 8 is appropriately supplied to the developing tank 2 by a pump 22 so as to compensate for the water reduced due to evaporation from the developer 36 in the developing tank 2.

Figure 8:
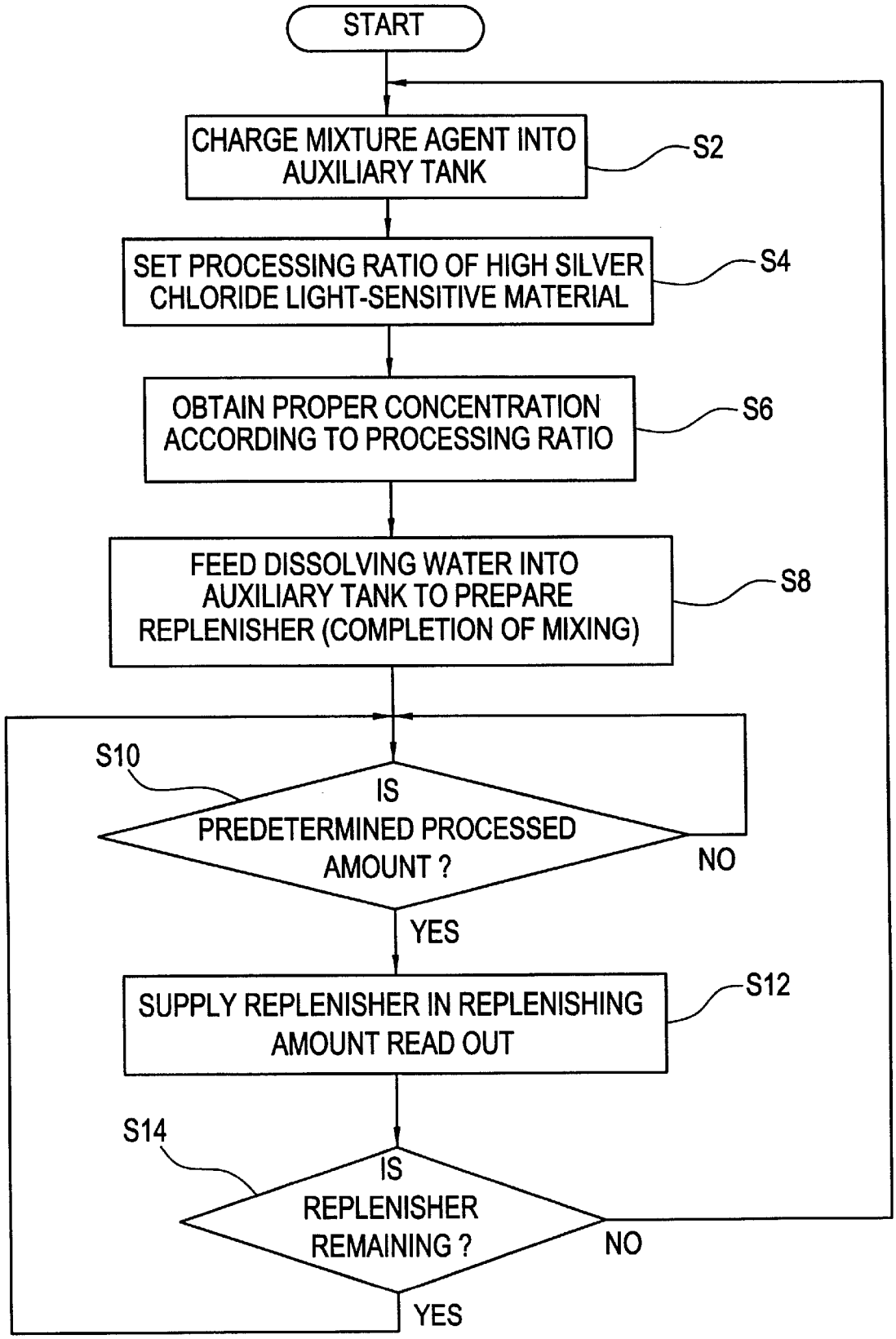
FIG. 8 is a flow chart showing the concentration change control.

The replenishment control by the control means 32 is described below by referring to FIG. 8. FIG. 8 is a flow chart showing the control for changing the concentration of the replenisher.

When the replenisher 4 in the replenisher tank 6 is emptied, the mixing of the replenisher 4 starts. In the control for preparing the replenisher 4, a mixed processing agent 10 is first charged into a replenisher tank 6 (S2).

Then, the processed amount of the high silver chloride light-sensitive material 16 is set by the sensor 26 or the input means 34 (S4).

Subsequently, a feeding amount of the dissolving water 14 for obtaining a proper concentration of the replenisher 4 in correspondence to the processed amount set by the sensor 26 or the input means 34 and a proper replenishing amount of the replenisher are read out from the memory 28 (S6).

Thereafter, the pump 20 is driven to ensure the feeding amount read out and thereby feed the dissolving water 14 into the replenisher tank 6, thereby completing the mixing (s8). Then, in order to decide the timing of the replenishment, whether the processed amount of the light-sensitive material 16 reaches the predetermined amount is judged (S10).

In the step S10, when the processed amount of the light-sensitive material 16 does not reach the processed amount, do not perform the replenishment and again return to the step 10 for deciding the timing of the replenishment. In the step S10, when the processed amount of the light-sensitive material 16 reaches the predetermined amount, a proper replenishing amount of the replenisher 4 is supplied to the developing tank 2 according to the processed amount read out in the step 6 (S12).

The amount of the replenisher 4 supplied here per the unit processed amount is smaller than the replenishing amount of the replenisher 4 mixed last time and with the increase in the concentration of the replenisher 4 at the mixing, the replenishing amount of the replenisher 4 per the unit processed amount decreases.

Thereafter, whether the replenisher remains in the replenisher tank in a predetermined amount and does not require the next time mixing is judged (S14). In the step S14, when the replenisher 4 remains in the above-described predetermined amount, return to the step S10 for judging the timing of the replenishment. In the step S14, when the replenisher 4 does not remain in the predetermined amount, mixing of the replenisher is necessary, therefore, return to the step S2 and perform the next time mixing of the replenisher.

According to this control, as the processing ratio of the high silver chloride light-sensitive material 16 becomes higher, the concentration of the replenisher prepared is elevated, therefore, as the processing ratio of the high silver chloride light-sensitive material 16 becomes higher, a replenisher 4 having a higher concentration is supplied.

Furthermore, according to this control, as the processing ratio of the high silver chloride light-sensitive material 16 becomes higher, the replenishing amount of the replenisher according to the processed amount becomes smaller, as a result, the developer amount in the developing tank 2 decreases and the bromide ion concentration increases.

As shown in FIG. 9 which is a graph showing the relationship between the replenishing amount and the concentration of the replenisher, with the increase in the processing ratio of the high silver chloride light-sensitive material 16, the replenishing amount in once mixing decreases and at this time, the concentration of the replenisher 4 becomes high. As such, resulting of the reduction in the replenishing amount, the liquid amount in the developing tank 2 decreases, whereby the bromide ion concentration in the developer 36 can be maintained at a necessary value without undergoing any reduction. Furthermore, even if the replenishing amount of the replenisher 4 is reduced, the concentration of the replenisher is increased, therefore, the developing agent, alkali and the like can be properly supplied each in a necessary amount.

As described in the foregoing pages, even in the process of allowing the processing ratio of the high silver chloride light-sensitive material 16 to increase, the bromide ion concentration and the concentrations of the developing agent, alkali and the like in the developer 36 are maintained at respective proper values, therefore, both a high silver bromide light-sensitive material and a high silver chloride light-sensitive material can be satisfactorily processed.

Incidentally, FIG. 9 shows one example of the characteristics and the reduction ratio of the replenishing amount and the increase ratio of the concentration are by no means limited to the characteristics shown in the Figure. The replenishing amount and the concentration each may not be stepwise decreased or increased or may be linearly decreased or increased.

Furthermore, in the above-descried practical embodiment, the control is performed such that the unit replenishing amount of the replenisher supplied in once mixing is made smaller than that at the last time mixing to reduce the replenishing amount. However, the replenishing amount may be reduced by increasing the unit processed amount used for deciding the timing of the replenishment and thereby extending the replenishing interval.

EXAMPLES

The present invention is described below in greater detail by referring to the Examples, but the present invention should not be construed as being limited thereto.

Example I-1

(1) Construction Material and the Like of Support

The supports used in this Example each was prepared as follows.

PEN

100 Parts by weight of a commercially available poly (ethylene-2,6-naphthalate) polymer and 2 parts by weight of Tinuvin P.326 (produced by Geigy) as an ultraviolet absorbent were dried by an ordinary method, melted at 300° C., extruded from a T-die, stretched longitudinally at 140° C. to 3.3 times, then stretched transversely at 130° C. to 3.3 times, and heat fixed at 250° C. for 6 seconds. The PEN film obtained had a glass transition point temperature of 120° C.

TAC

Triacetyl cellulose was manufactured by a 15% band method according to an ordinary solution casting method under the conditions such that the methylene chloride/methanol ratio was 82/8 (by weight), TAC concentration was 13% and the plasticizer was TPP/BDP of 2/1 (TPP: triphenyl phosphate, BDP: biphenyl diphenyl phosphate).

A sample using the heat-treated PEN (APEN) support was designated as Sample 101 and a sample using TAC support was designated as Sample 102.

(2) Coating of Undercoat Layer

Both surfaces of each support obtained above were subjected to a corona discharge treatment and then an undercoating solution having the following composition was coated to provide an undercoat layer on the side of high temperature at the time of stretching. The corona discharge treatment was applied using a solid state corona treatment machine, Model 6KVA, manufactured by Pillar, on the support having a width of 30 cm at a rate of 20 m/min: At this time, from the current and voltage read out, the subject was treated at 0.375 KV·A·min/$m^2$. The discharge frequency at the treatment was 9.6 KHz and the gap clearance between the electrode and the dielectric roll was 1.6 mm.

| | |
|---|---|
| Gelatin | 3 g |
| Distilled water | 250 ml |
| Sodium α-sulfodi-2-ethylhexylsuccinate | 0.05 g |
| Formaldehyde | 0.02 g |

In the TAC support, an undercoat layer having the following composition was provided

| | |
|---|---|
| Gelatin | 0.2 g |
| Salicylic acid | 0.1 g |
| Methanol | 15 ml |
| Acetone | 85 ml |
| Formaldehyde | 0.01 g |

(3) Coating of Back Layers

On one surface of the undercoated support prepared in (2), the following first to third back layers were coated.

The back layer obtained had a coercive force of 960 Oe.

| a) First Back Layer | |
|---|---|
| Fine powder of Co-containing needle-like γ-iron oxide (contained as a dispersion in gelatin; average particle diameter: 0.08 μm) | 0.2 g/$m^2$ |
| Gelatin | 3 g/$m^2$ |
| Compound shown in Chem. 1 below | 0.1 g/$m^2$ |
| Compound shown in Chem. 2 below | 0.02 g/$m^2$ |
| Poly(ethyl acrylate) (average diameter: 0.08 μm) | 1 g/$m^2$ |

$(CH_2{=}CHSO_2NHCH_2CH_2NH)_2CO$

-continued

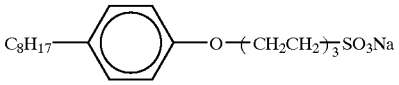

| b) Second Back Layer | |
|---|---|
| Gelatin | 0.5 g/$m^2$ |
| Electrically conductive material [$S_nO_2/Sb_2O_3$ (9:1), particle diameter: 15 μm) | 0.16 g/$m^2$ |
| Sodium dodecylbenzenesulfonate | 0.5 g/$m^2$ |
| **c) Third Back Layer** | |
| Gelatin | 0.5 g/$m^2$ |
| Polymethyl methacrylate (average particle diameter: 1.5 μm) | 0.02 g/$m^2$ |
| Cetyl stearate (dispersed in sodium dodecylbenzenesulfonate) | 0.01 g/$m^2$ |
| Sodium di(2-ethylhexyl)sulfosuccinate | 0.01 g/$m^2$ |
| Compound shown below | 0.01 g/$m^2$ |

$C_8F_{17}SO_2N(C_3H_7)(CH_2CH_2O)_4(CH_2)_4SO_3Na$ (4) Heat Treatment of Support After the undercoat layer and the back layers were provided as above, the support was dried, taken up and heat treated at 110° C. for 48 hours.

On each of two kinds of the supports prepared above, a light-sensitive layer shown in (5) was coated to prepare a light-sensitive material. The light-sensitive material using the PEN support was designated as Sample 101 and the light-sensitive material using the TAC support was designated as Sample 102.

(5) Preparation of Light-Sensitive Layer

Main materials used in each layer are classified as follows:

ExC: cyan coupler

ExM: magenta coupler

ExY: yellow coupler

ExS: sensitizing dye

UV: ultraviolet absorbent

HBS: high-boiling point organic solvent

H: gelatin hardening agent

Numerals corresponding to respective components each shows a coated amount expressed by the unit of g/$m^2$. In case of silver halide, the coated amount is shown in terms of silver. With respect to the sensitizing dyes, the coated amount is shown by the unit of mol per mol of silver halide in the same layer.

| First Layer (antihalation layer) | |
|---|---|
| Black colloidal silver as silver | 0.09 |
| Gelatin | 1.60 |
| ExM-1 | 0.12 |
| ExF-1 | $2.0 \times 10^{-3}$ |
| Solid Disperse Dye ExF-2 | 0.030 |
| Solid Disperse Dye ExF-3 | 0.040 |
| HBS-1 | 0.15 |
| HBS-2 | 0.02 |
| **Second Layer (interlayer)** | |
| Silver Iodobromide Emulsion M as silver | 0.05 |
| ExC-2 | 0.04 |
| Polyethylacrylate latex | 0.20 |
| Gelatin | 1.04 |

-continued

| | |
|---|---|
| Third Layer (low-sensitivity red-sensitive emulsion layer) | |
| Silver Iodobromide Emulsion A as silver | 0.20 |
| Silver Iodobromide Emulsion B as silver | 0.20 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| Fourth Layer (medium-sensitivity red-sensitive emulsion layer) | |
| Silver Iodobromide Emulsion C as silver | 0.60 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| Fifth Layer (high-sensitivity red-sensitive emulsion layer) | |
| Silver Iodobromide Emulsion D as silver | 1.10 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| Sixth Layer (interlayer) | |
| Cpd-1 | 0.090 |
| Solid Disperse Dye ExF-4 | 0.030 |
| HBS-1 | 0.050 |
| Polyethylacrylate latex | 0.15 |
| Gelatin | 1.10 |
| Seventh Layer (low-sensitivity green-sensitive emulsion layer) | |
| Silver Iodobromide Emulsion E as silver | 0.10 |
| Silver Iodobromide Emulsion F as silver | 0.10 |
| Silver Iodobromide Emulsion G as silver | 0.10 |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Eighth Layer (medium-sensitivity green-sensitive emulsion layer) | |
| Silver Iodobromide Emulsion H as silver | 0.80 |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |

-continued

| | |
|---|---|
| ExY-5 | 0.040 |
| HBS-1 | 0.13 |
| HBS-3 | $4.0 \times 10^{-3}$ |
| Gelatin | 0.80 |
| Ninth Layer (high-sensitivity green-sensitive emulsion layer) | |
| Silver Iodobromide Emulsion I as silver | 1.00 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethylacrylate latex | 0.15 |
| Gelatin | 1.33 |
| Tenth Layer (yellow filter layer) | |
| Yellow colloidal silver as silver | 0.015 |
| Cpd-1 | 0.16 |
| Solid Disperse Dye ExF-5 | 0.060 |
| Solid Disperse Dye ExF-6 | 0.060 |
| Oil-soluble Dye ExF-7 | 0.010 |
| HBS-1 | 0.60 |
| Gelatin | 0.60 |
| Eleventh Layer (low-sensitivity blue-sensitive emulsion layer) | |
| Silver Iodobromide Emulsion J as silver | 0.07 |
| Silver Iodobromide Emulsion K as silver | 0.07 |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| Twelfth Layer (high-sensitivity blue-sensitive emulsion layer) | |
| Silver Iodobromide Emulsion L as silver | 0.80 |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Thirteenth Layer (first protective layer) | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |
| Fourteenth Layer (second protective layer) | |
| Silver Iodobromide Emulsion M as silver | 0.10 |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

In order to attain good preservability, processability, pressure resistance, antifungal/bactericidal property, antistatic property and coatability, W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, iron salt, lead slat, gold salt, platinum salt, palladium salt, iridium salt or rhodium salt was appropriately added to each layer.

TABLE I-1

| | Average AgI Content (%) | Coefficient of Variation of AgI Content in Grains (%) | Average Grain Size, Equivalent-Sphere Diameter (Fm) | Coefficient of Variation of Grain Size (%) | Projected Area Diameter, Equivalent-Circle Diameter (Fm) | Diameter/ Thickness Ratio |
|---|---|---|---|---|---|---|
| Emulsion A | 1.7 | 10 | 0.46 | 15 | 0.56 | 5.5 |
| Emulsion B | 3.5 | 15 | 0.57 | 20 | 0.78 | 4.0 |
| Emulsion C | 8.9 | 25 | 0.66 | 25 | 0.87 | 5.8 |
| Emulsion D | 8.9 | 18 | 0.84 | 26 | 1.03 | 3.7 |
| Emulsion E | 1.7 | 10 | 0.46 | 15 | 0.56 | 5.5 |
| Emulsion F | 3.5 | 15 | 0.57 | 20 | 0.78 | 4.0 |
| Emulsion G | 8.8 | 25 | 0.61 | 23 | 0.77 | 4.4 |
| Emulsion H | 8.8 | 25 | 0.61 | 23 | 0.77 | 4.4 |
| Emulsion I | 8.9 | 18 | 0.84 | 26 | 1.03 | 3.7 |
| Emulsion J | 1.7 | 10 | 0.46 | 15 | 0.50 | 4.2 |
| Emulsion K | 8.8 | 18 | 0.64 | 23 | 0.85 | 5.2 |
| Emulsion L | 14.0 | 25 | 1.28 | 26 | 1.46 | 3.5 |
| Emulsion M | 1.0 | — | 0.07 | 15 | — | 1 |

In Table I-1, (1) Emulsions J to L were subjected to reduction sensitization at the preparation of grains using thiourea dioxide and thiosulfonic acid according to the Example of JP-A-2-191938;

(2) Emulsions A to I were subjected to gold sensitization, sulfur sensitization and selenium sensitization in the presence of the spectral sensitizing dyes described in respective light-sensitive layers and sodium thiocyanate according to the Example of JP-A-3-237450;

(3) in the preparation of tabular grains, a low molecular weight gelatin was used according to the Example of JP-A-1-158426;

(4) in the tabular grain, dislocation lines were observed through a high-pressure electron microscope as described in JP-A-3-237450; and (5) Emulsion L is a double structure grain having an internal high iodide core described in JP-A-60-143331.

Preparation of Dispersion of Organic Solid Disperse Dye

ExF-2 shown below was dispersed in the following manner. Namely, 21.7 ml of water, 3 ml of a 5% aqueous solution of sodium p-octylphenoxyethoxyethoxyethane-sulfonate and 0.5 g of a 5% aqueous solution of p-octylphenoxypolyoxyethylene ether (polymerization degree: 10) were poured in a 700 ml-volume pot mill, thereto 5.0 g of Dye ExF-2 and 500 ml of zirconium oxide beads (diameter 1 mm) were added and the contents were dispersed for 2 hours. The dispersion was performed using a BO-type vibrating ball mill manufactured by Chuo Koki K. K. After the dispersion, the contents were taken out and thereto 8 g of a 12.5% aqueous gelatin solution was added and beads were removed by filtration to obtain a gelatin dispersion of the dye. The dye fine particles had an average particle size of 0.44 μm.

In the same manner, solid dispersions of ExF-3, ExF-4 and ExF-6 were obtained. The dye fine particles had an average particle size of 0.24 μm, 0.45 μm and 0.52 μm, respectively. ExF-5 was dispersed by the microprecipitation dispersing method described in Example 1 of European Patent Application (EP) No. 549,489A. The average particle size thereof was 0.06 μm.

The compounds used are shown below.

ExC-1

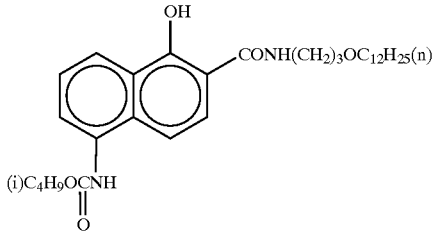

ExC-2

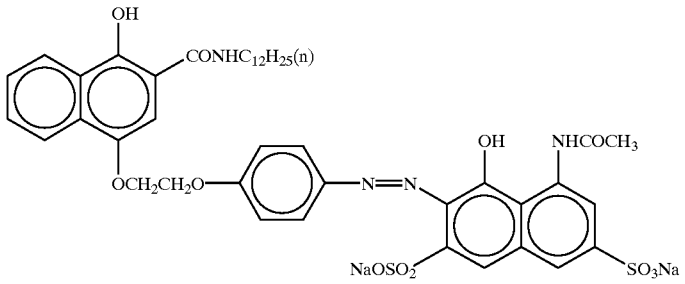

-continued
ExC-3
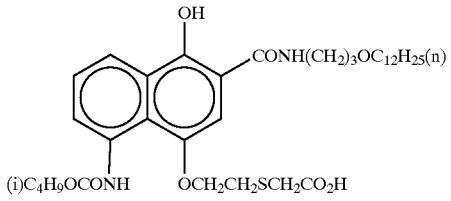
ExC-4
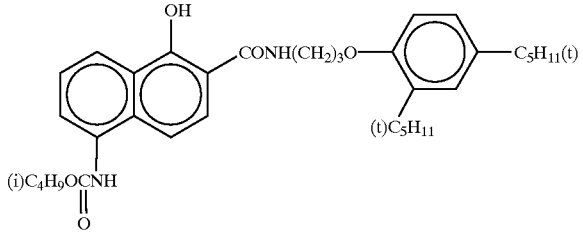
ExC-5
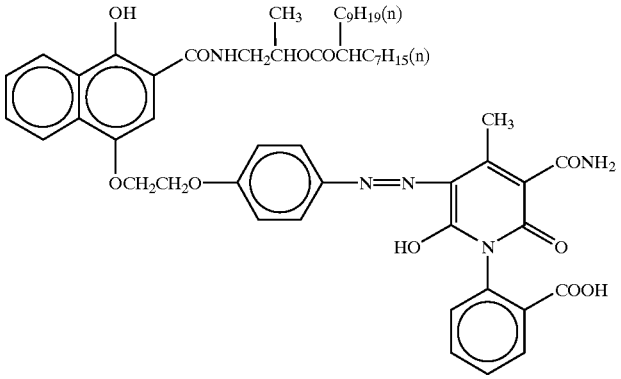
ExC-6
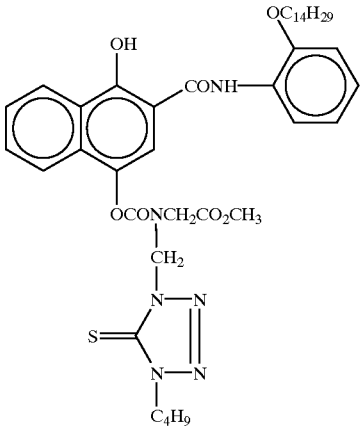
ExC-7
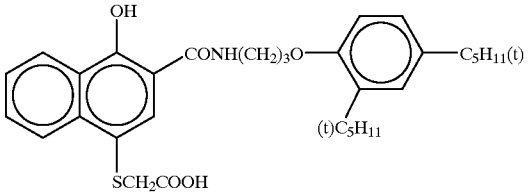

-continued
ExC-8
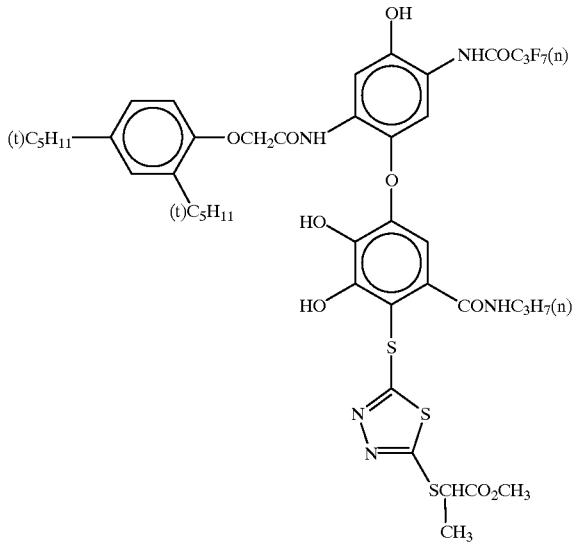
ExM-1
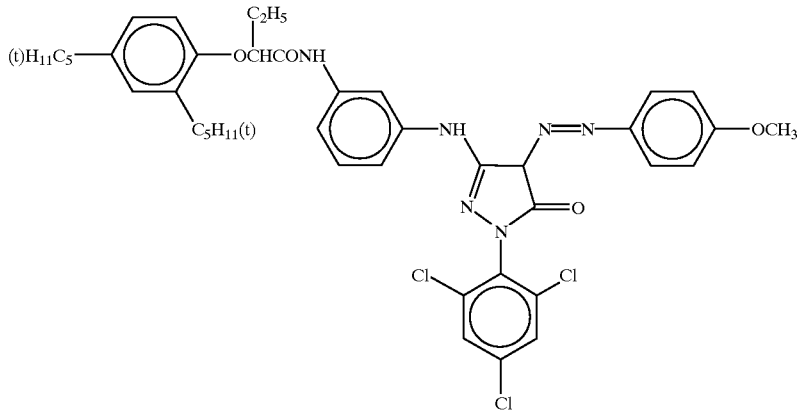
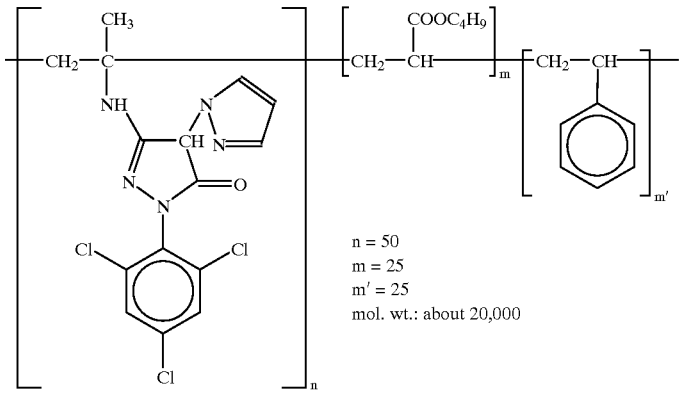

-continued
ExM-3
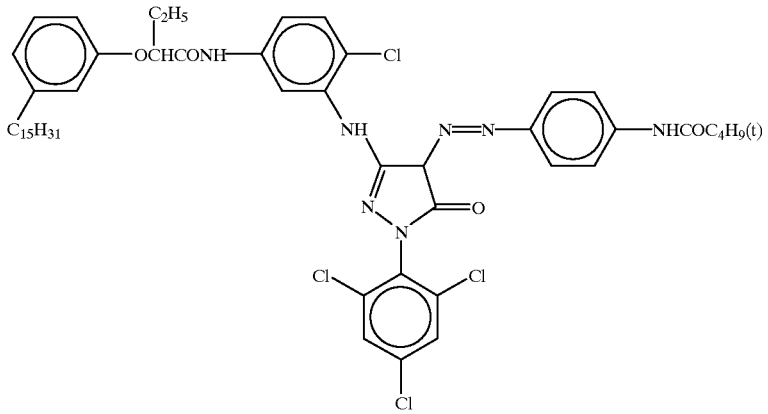
ExM-4
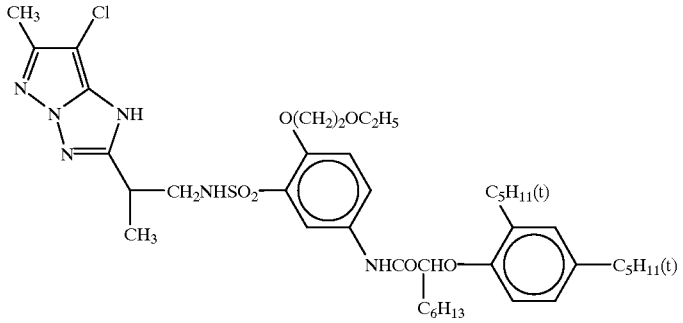
ExM-5
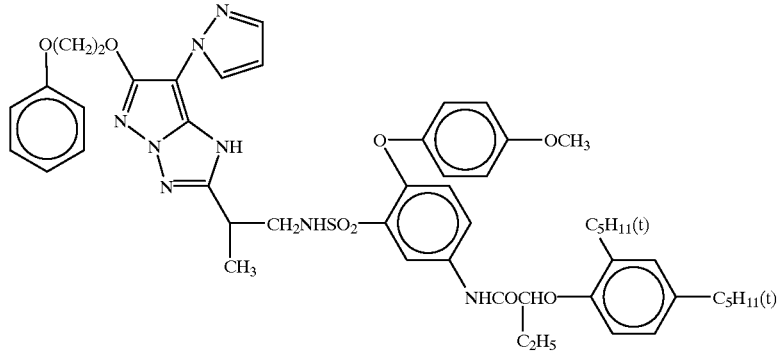
ExY-1
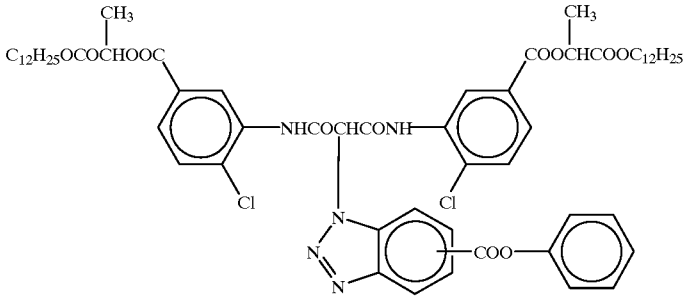

-continued
ExY-2
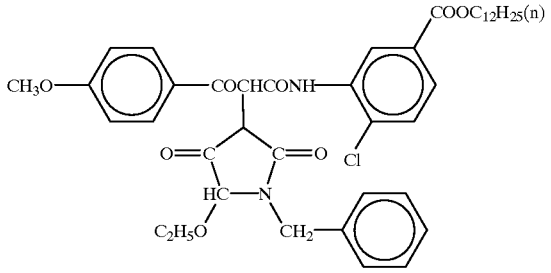
ExY-3
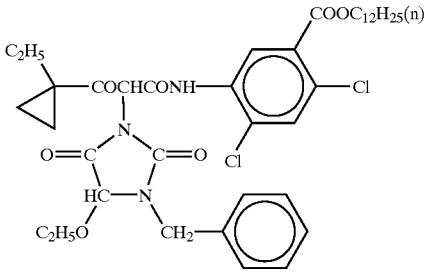
ExY-4
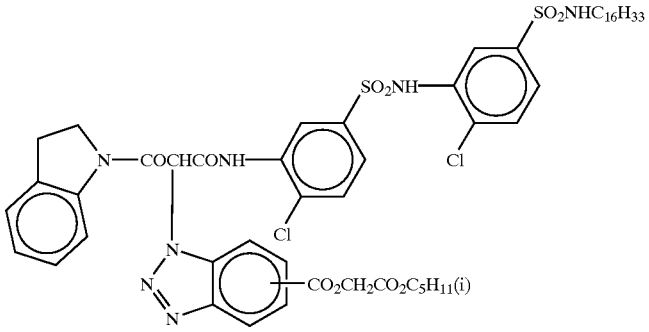
ExY-5
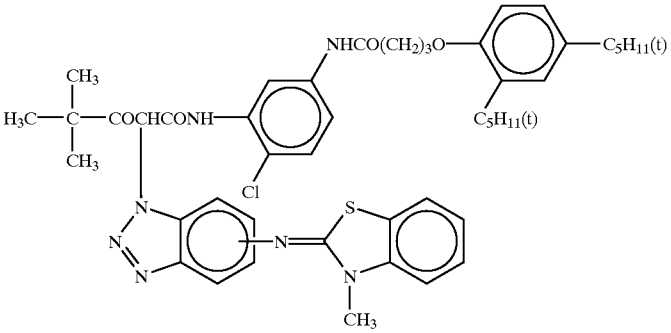
ExF-1
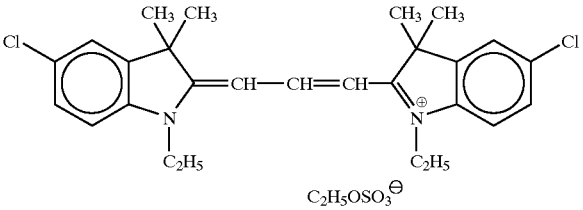

-continued
ExF-2
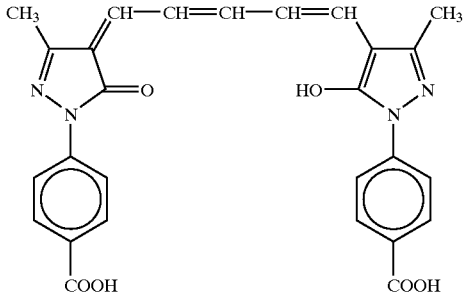
ExF-3
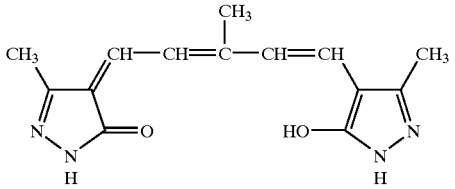
ExF-4
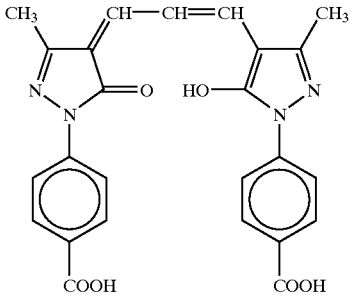
ExF-5
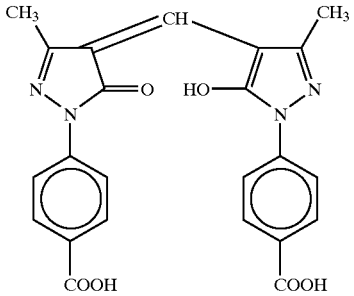
ExF-6
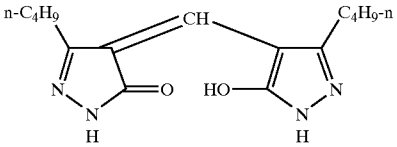
ExF-7
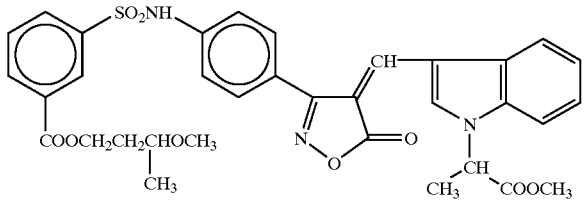

-continued
Cpd-1
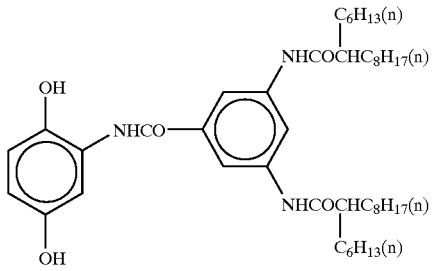
Cpd-2
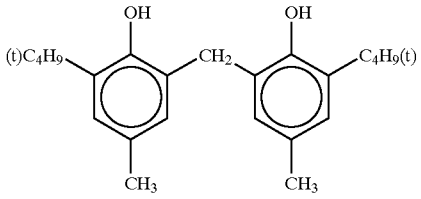
Cpd-3
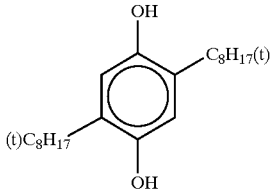
UV-1
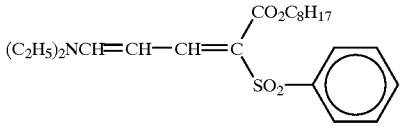
UV-2
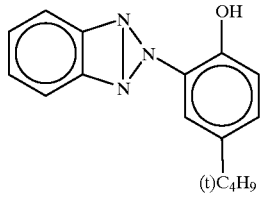
UV-3
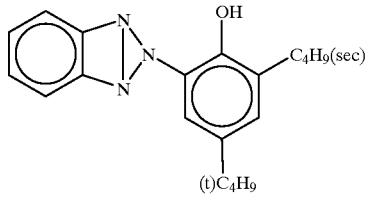
HBS-1
Tricresyl phosphate
HBS-2
Di-n-butyl phthalate
HBS-3
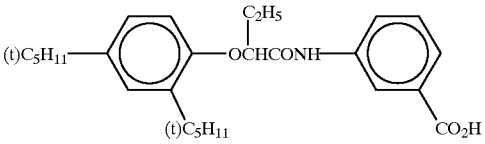
HBS-4
Tri(2-ethylhexyl) phosphate -continued
ExS-1
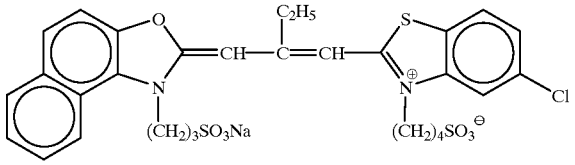
ExS-2
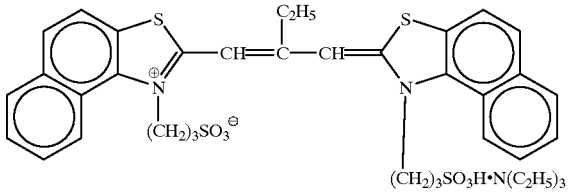
ExS-3
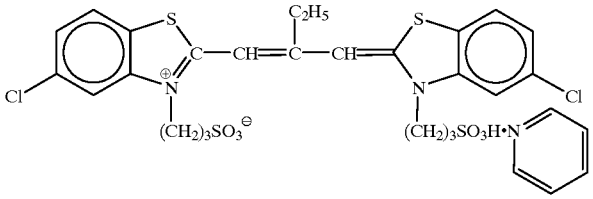
ExS-4
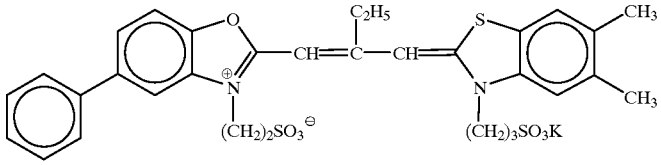
ExS-5
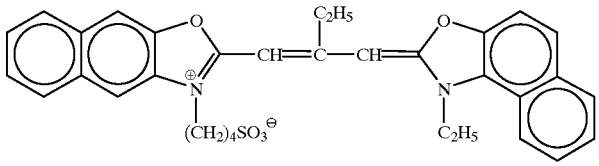
ExS-6
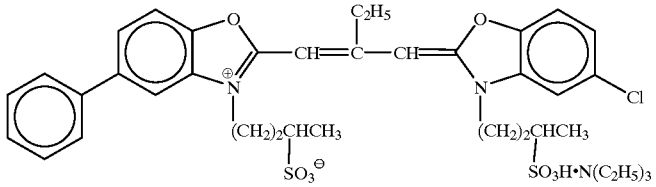
ExS-7
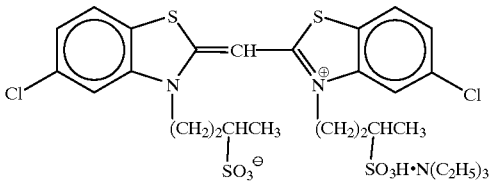
S-1
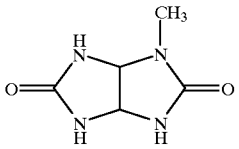
H-1
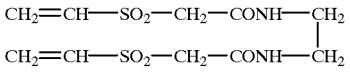

-continued
B-1
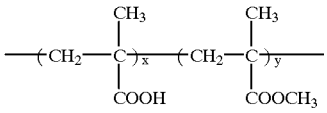
x/y = 10/90
B-2
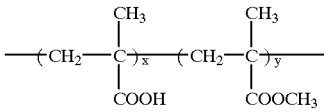
x/y = 40/60
B-3
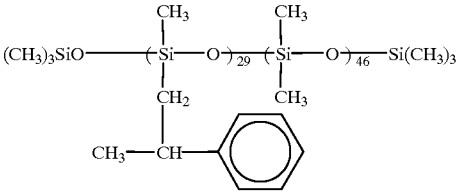
B-4
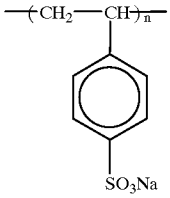
B-5
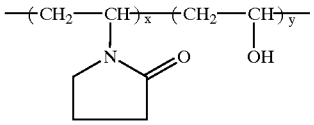
x/y = 70/30
B-6
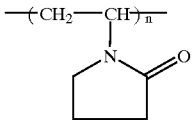
(mol. wt. *10,000)
W-1
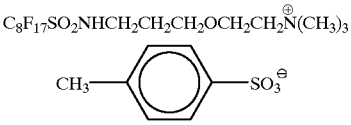
W-2
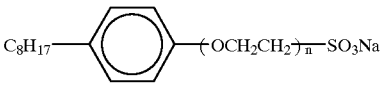
n = 2 ~ 4
W-3
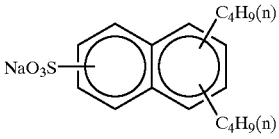
F-1
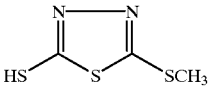

-continued
F-2
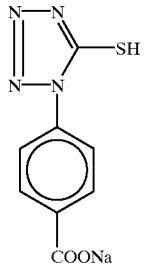
F-3
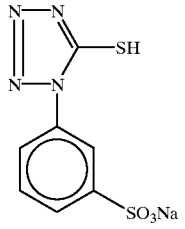
F-4
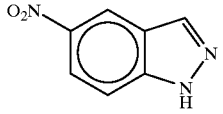
F-5
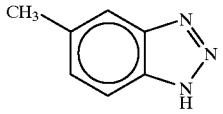
F-6
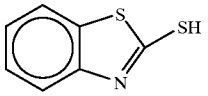
F-7
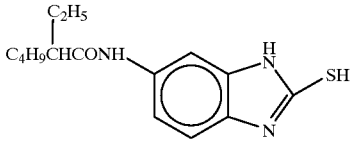
F-8
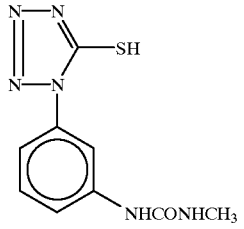
F-9
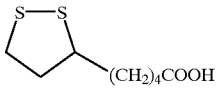
F-10
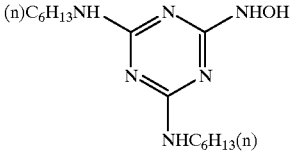

-continued

F-11

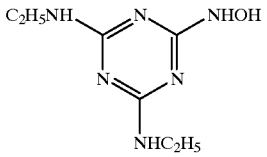

F-12

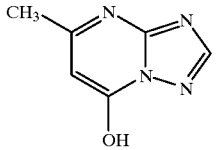

F-13

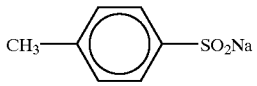

F-14

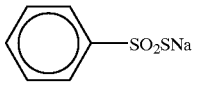

F-15

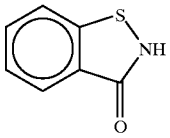

F-16

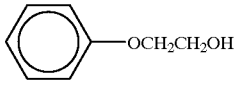

F-17

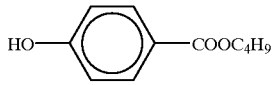

Preparation of Sample 101A

Each of the thus-prepared light-sensitive materials was cut into a size of 24 mm (width)×160 cm. At the portion 0.7 mm inside from the cross direction on one side in the length direction of the light-sensitive material, two perforations of 2 mm-square were provided at a distance of 5.8 mm. A pair of two perforations was provided at a distance of 32 mm. Then, each film was housed in a plastic-made film cartridge described in FIGS. 1 to 7 of U.S. Pat. No. 5,296,887 (Sample 101A).

Preparation of Sample 101B

Samples were prepared in the same manner as Sample 101A by changing the emulsion from a silver iodobromide emulsion to a high silver chloride tabular emulsion having (100) faces and designated as Sample 101B.

TABLE I-2

| Emulsion | Shape of Grain | Silver Chloride Content (mol %) | Silver Bromide Localized on Surface (mol %) | Equivalent-Sphere Average Grain Size (μm) | Average Aspect Ratio | Equivalent-Circle Projected Area Diameter (μm) | Coefficient of Variation of Grain Size Distribution (%) |
|---|---|---|---|---|---|---|---|
| A' | rectangular parellelogram, tabular | 99.3 | 0.7 | 0.55 | 6.5 | 0.66 | 15 |
| B' | rectangular parellelogram, tabular | 99.3 | 0.7 | 0.59 | 5.5 | 0.88 | 20 |
| C' | rectangular parellelogram, tabular | 99.3 | 0.7 | 0.69 | 6.8 | 0.65 | 25 |
| D' | rectangular parellelogram, tabular | 99.4 | 0.6 | 0.90 | 4.9 | 0.94 | 25 |
| E' | rectangular parellelogram, tabular | 99.2 | 0.8 | 0.43 | 5.8 | 0.66 | 15 |

TABLE I-2-continued

| Emulsion | Shape of Grain | Silver Chloride Content (mol %) | Silver Bromide Localized on Surface (mol %) | Equivalent-Sphere Average Grain Size (μm) | Average Aspect Ratio | Equivalent-Circle Projected Area Diameter (μm) | Coefficient of Variation of Grain Size Distribution (%) |
|---|---|---|---|---|---|---|---|
| F' | rectangular parellelogram, tabular | 99.5 | 0.5 | 0.53 | 5.0 | 0.73 | 20 |
| G' | rectangular parellelogram, tabular | 99.3 | 0.7 | 0.71 | 6.4 | 0.75 | 22 |
| H' | rectangular parellelogram, tabular | 99.3 | 0.7 | 0.71 | 6.4 | 0.75 | 22 |
| I' | rectangular parellelogram, tabular | 99.6 | 0.4 | 0.98 | 4.7 | 1.05 | 29 |
| J' | rectangular parellelogram, tabular | 99.8 | 0.2 | 0.47 | 5.3 | 0.53 | 17 |
| K' | rectangular parellelogram, tabular | 99.3 | 0.7 | 0.65 | 5.2 | 0.95 | 25 |
| L' | rectangular parellelogram, tabular | 99.5 | 0.5 | 1.38 | 4.5 | 1.40 | 25 |
| M' | rectangular parellelogram, tabular | 99.9 | 0.1 | 0.44 | 4.0 | 1.03 | 15 |

In Table I-2, (1) Emulsions J' to M' were subjected to reduction sensitization at the preparation of grains using thiourea dioxide and thiosulfonic acid according to Example 1 of JP-A-2-191938;

(2) Emulsions A' to M' were subjected to gold sensitization, sulfur sensitization and selenium sensitization in the presence of the spectral sensitizing dyes described in respective light-sensitive layers and sodium thiocyanate according to Example 1 of JP-A-3-237450; and (3) tabular grains were prepared according to Example 1 of U.S. Pat. No. 5,264,337, where a silver chloride fine grain emulsion was dislocated and tabular grains having (100) faces were obtained.

Preparation of Sample 101C

According to the preparation method of the emulsion of Sample 304 in Example 3 of JP-A-64-6941, a high silver chloride cubic grain emulsion having (100) faces was prepared. Samples were prepared in the same manner as Sample 101B except for changing Emulsions A' to L' of Sample 101B to Emulsions A" to L". The emulsions used are shown in Table I-3.

The thus-obtained samples were designated as Sample 101C.

TABLE I-3

| Emulsion | Shape of Grain | Silver Chloride Content (mol %) | Silver Bromide Localized on Surface (mol %) | Equivalent-Sphere Average Grain Size (μm) | Coefficient of Variation of Grain Size Distribution (%) |
|---|---|---|---|---|---|
| A" | cubic | 98.0 | 2.0 | 0.50 | 15 |
| B" | cubic | 98.0 | 2.0 | 0.50 | 15 |
| C" | cubic | 98.0 | 2.0 | 0.60 | 20 |
| D" | cubic | 98.0 | 2.0 | 0.70 | 20 |
| E" | cubic | 99.0 | 1.0 | 0.50 | 18 |
| F" | cubic | 99.0 | 1.0 | 0.50 | 18 |
| G" | cubic | 99.0 | 1.0 | 0.50 | 18 |
| H" | cubic | 99.0 | 1.0 | 0.50 | 18 |
| I" | cubic | 99.0 | 1.0 | 0.60 | 18 |
| J" | cubic | 98.0 | 2.0 | 0.40 | 15 |
| K" | cubic | 98.0 | 2.0 | 0.40 | 20 |
| L" | cubic | 98.0 | 2.0 | 0.85 | 25 |
| M" | cubic | 100.0 | 0.0 | 0.07 | 15 |

Preparation of Sample 101D

According to the preparation method of the emulsion in Example 5 of JP-A-63-212932, a high silver chloride octahedral grain emulsion having (111) faces was prepared. Samples were prepared in the same manner as Sample 101B except for changing Emulsions A' to M' of Sample 101B to Emulsions A''' to M'''. The emulsions used are shown in Table I-4.

The thus-obtained samples were designated as Sample 101 D.

TABLE I-4

| Emulsion | Shape of Grain | Silver Chloride Content (mol %) | Silver Bromide Localized on Surface (mol %) | Equivalent-Sphere Average Grain Size (μm) | Coefficient of Variation of Grain Size Distribution (%) |
|---|---|---|---|---|---|
| A''' | Octahedral | 100.0 | 0.0 | 0.50 | 13 |
| B''' | Octahedral | 100.0 | 0.0 | 0.50 | 13 |
| C''' | Octahedral | 100.0 | 0.0 | 0.80 | 12 |
| D''' | Octahedral | 100.0 | 0.0 | 0.80 | 12 |
| E''' | Octahedral | 100.0 | 0.0 | 0.40 | 10 |
| F''' | Octahedral | 100.0 | 0.0 | 0.40 | 10 |
| G''' | Octahedral | 100.0 | 0.0 | 0.40 | 10 |
| H''' | Octahedral | 100.0 | 0.0 | 0.60 | 10 |
| I''' | Octahedral | 100.0 | 0.0 | 0.70 | 10 |
| J''' | Cubic | 100.0 | 0.0 | 0.45 | 13 |
| K''' | Cubic | 100.0 | 0.0 | 0.45 | 13 |
| L''' | Cubic | 100.0 | 0.0 | 0.80 | 10 |
| M''' | Cubic | 100.0 | 0.0 | 0.07 | 14 |

Preparation of Sample 102A and Sample 102B

Samples were prepared by changing only the support of each of Sample 101A and Sample 101B to TAC, and designated as Samples 102A and 102B.

(6) Development and Evaluation

Using the samples prepared above, a portrait was taken by a camera for use in the processing in a running test, namely, a test of continuously developing a large amount of light-sensitive material. Furthermore, in order to evaluate the photographic properties, a sensitometry sample was prepared by exposing a light-sensitive material at a color temperature of 4800 K and 20 cms through a gray optical wedge for the sensitometry. Then, a continuous processing was performed using the processing steps and processing solutions shown below while replenishing the solution by a commercially available cine-type small automatic developing machine for color negative films. The development processing was performed using as the standard formulation the following formulation designed for the processing exclusive to high silver bromide light-sensitive materials (Sample 101A) by varying the replenishing amount and the concentration of the replenisher according to the mixing ratio of the high silver chloride light-sensitive materials (Sample 101B) as shown in Table I-5. The development processing performed was a so-called running processing and 500 rolls in total of Sample 101A and Sample 101B were processed. The finish photographic properties were examined by the sensitometry during the stationary operation of continuously developing a large amount of light-sensitive material as in actual processing. For the sensitometry, the density of the developed sensitometry sample was measured by a densitometer in accordance with the International Standard (ISO 5-2 and ISO 5-3) and the sensitivity and the minimum density (Dmin) were measured according to the sensitometry method for color negative films provided in the International Standard (ISO 5800).

Sample 101A using the high silver bromide emulsion and Sample 101B using the high silver chloride emulsion were processed in mixture by varying the ratio therebetween as shown in Table I-5. The change in the photographic properties was examined by developing the sensitometry sample prepared above at the start and at the end of the running test and shown by the change in the yellow minimum density (ΔDBmin) and the change in the magenta sensitivity (ΔlogE).

For the developer replenisher, a standard developer according to the following formulation designed for the processing of Sample 101A was used as a base and in the test, the replenishing amount and the concentration of the replenisher were changed to various levels shown in Table I-5. The evaluation results of the developed sensitometry sample obtained are shown together in Table I-5.

In Table I-5, Test 1 where Sample 101A was processed under the standard development conditions was the control for each of Sample 101B and Sample 101A, and the evaluation results are shown relatively to the evaluation values of this sample.

The processing steps and the composition of each processing solution are shown below.

(Processing Step)

| Step | Processing Time | Processing Temperature (° C.) | Replenishing Amount* (ml) | Tank Volume (l) |
|---|---|---|---|---|
| Color development | 3 min 5 sec | 38.0 | see Table I-5 | 4 |
| Bleaching | 50 sec | 38.0 | 130 | 1 |
| Fixing (1) | 50 sec | 38.0 | — | 1 |
| Fixing (2) | 50 sec | 38.0 | 200 | 1 |
| Water washing | 30 sec | 38.0 | 450 | 0.5 |
| Stabilization (1) | 20 sec | 38.0 | — | 0.5 |
| Stabilization (2) | 20 sec | 38.0 | 390 | 0.5 |
| Drying | 1 min 30 sec | 60 | | |

*Replenishing amount was per 1 $m^2$ of the light-sensitive material

The stabilizing solution was in a countercurrent system of from (2) to (1) and the overflow solution of washing water was all introduced into the fixing (2). The fixing solution was also passed from (2) to (1) connected by the countercurrent piping. The amount of the developer carried over into the bleaching step, the amount of the bleaching solution carried over into the fixing step, and the amount of the fixing solution carried over into the water washing step were 65 ml, 52 ml and 52 ml, respectively, per 1 $m^2$ of the light-sensitive material. The cross-over time was 6 seconds in each interval and this time was included in the processing time of the previous step.

The composition of each processing solution is shown below.

The formulation of the developer replenisher was the standard formulation, namely, designed on the condition that only Sample 101A was processed, which corresponded to the case in Table I-5 where the concentration of the replenisher was 1.0. Along the increase in the mixing ratio of Sample 101B, the prepared amount (l) was changed as shown in the parenthesis in Table I-5 without changing the amounts of chemicals in that formulation, whereby the concentration was changed as shown in Table I-5.

| (Color Developer Tank Solution) | Tank Solution (g) |
|---|---|
| Diethylenetriaminepentaacetic acid | 2.0 |
| 1-Hydroxyethylidene-1,1-diphosphonic acid | 2.0 |
| Sodium sulfite | 3.9 |
| Potassium carbonate | 37.5 |
| Potassium bromide | 1.4 |
| Potassium iodide | 1.3 mg |
| Disodium N,N-bis(2-sulfonatoethyl)-hydroxylamine | 2.0 |
| Hydroxylamine sulfate | 2.4 |
| 2-Methyl-4-[N-ethyl-N-(β-hydroxyethyl)-amino]aniline sulfate | 4.5 |
| Water to make | 1.0 l |
| pH (adjusted by potassium hydroxide and sulfuric acid) | 10.05 |

[0154]

(Color Developer Replenisher)

| | |
|---|---|
| Diethylenetriaminepentaacetic acid | 2.0 |
| 1-Hydroxyethylidene-1,1-diphosphonic acid | 2.0 |
| Sodium sulfite | 6.5 |
| Potassium carbonate | 39.0 |
| Potassium bromide | 0 |
| Potassium iodide | — |
| Disodium N,N-bis(2-sulfonatoethyl)-hydroxylamine | 3.0 |
| Hydroxylamine sulfate | 4.5 |
| 2-Methyl-4-[N-ethyl-N-(β-hydroxyethyl)-amino]aniline sulfate | 8.3 |
| Water to make | 1.0 l |
| pH (adjusted by potassium hydroxide and sulfuric acid) | 10.05 |

| (Bleaching Solution) | Tank Solution (g) | Replenisher (g) |
|---|---|---|
| Ammonium 1,3-diaminopropane-tetraacetato ferrate monohydrate | 118 | 180 |
| Ammonium bromide | 80 | 115 |
| Ammonium nitrate | 14 | 21 |
| Succinic acid | 40 | 60 |
| Maleic acid | 33 | so |
| Water to make | 1.0 l | 1.0 l |
| pH (adjusted by aqueous ammonia) | 4.4 | 4.0 |

| (Fixing Solution) | Tank Solution (g) | Replenisher (g) |
|---|---|---|
| Ammonium methanesulfinate | 10 | 30 |
| Ammonium methanethiosulfonate | 4 | 12 |
| Aqueous solution of ammonium thiosulfate (700 g/l) | 280 ml | 840 ml |
| Imidazole | 7 | 20 |
| Ethylenediaminetetraacetic acid | 15 | 45 |
| Water to make | 1.0 l | 1.0 l |
| pH (adjusted by aqueous ammonia and acetic acid) | 7.4 | 7.45 |

(Washing Water)

Tap water was passed through a mixed bed column filled with an H-type strongly acidic cation exchange resin (Amberlite IR-120B, produced by Rhom and Haas) and an OH-type strongly basic anion exchange resin (Amberlite IR-400, produced by the same company) to reduce the calcium and magnesium ion concentrations each to 3 mg/l or less and then thereto 20 mg/l of sodium isocyanurate dichloride and 150 mg/l of sodium sulfate were added. The resulting solution had a pH of from 6.5 to 7.5.

(Stabilizing Solution)
The tank solution and the replenisher were common.

| | (unit: g) |
|---|---|
| Sodium p-toluenesulfinate | 0.03 |
| Polyoxyethylene-p-monononylphenyl ether (average polymerization degree: 10) | 0.2 |
| Disodium ethylenediaminetetraacetate | 0.05 |
| 1,2,4-Triazole | 1.3 |
| 1,4-Bis(1,2,4-triazol-1-ylmethyl)piperazine | 0.75 |
| 1,2-Benzisothiazolin-3-one | 0.10 |
| Water to make | 1.0 l |
| pH | 8.5 |

The results are shown in Table I-5.

TABLE I-5

| | Processed Amount | | | Replenisher | | Photographic Properties | | | | |
|---|---|---|---|---|---|---|---|---|---|---|
| | | | | | Concentration | ΔDBmin | | ΔLogE | | |
| Test | 101A (rolls) | 101B (rolls) | Mixing Ratio (%) | Replenishing Amount (ml/m²) | (amount of prepared liquid, ml/m²) | 101A | 101B | 101A | 101B | Remarks |
| 1 | 500 | 0 | 0 | 340 | 1.0 (1.01) | 0 | — | 0 | — | Reference Example |
| 2 | 475 | 25 | 5 | 323 | 1.05 (0.95) | −0.01 | −0.01 | −0.02 | −0.02 | Invention |
| 3 | 425 | 75 | 15 | 289 | 1.18 (0.85) | 0 | 0 | −0.01 | −0.01 | " |
| 4 | 375 | 125 | 25 | 255 | 1.33 (0.75) | −0.01 | −0.01 | 0 | −0.01 | " |
| 5 | 250 | 250 | 50 | 170 | 1.33 (0.75) | +0.02 | +0.02 | +0.03 | +0.04 | " |
| 6 | 425 | 75 | 15 | 340 | 1.0 (1.0) | +0.06 | 0.05 | +0.06 | +0.08 | Comparison |
| 7 | 375 | 125 | 25 | 340 | 1.0 (1.0) | 0.08 | 0.07 | +0.08 | +0.10 | " |
| 8 | 250 | 250 | 50 | 340 | 1.0 (1.0) | +0.12 | +0.10 | +0.12 | +0.13 | " |

TABLE I-5-continued

| Test | Processed Amount 101A (rolls) | Processed Amount 101B (rolls) | Mixing Ratio (%) | Replenisher Replenishing Amount (ml/m²) | Replenisher Concentration (amount of prepared liquid, ml/m²) | Photographic Properties ΔDBmin 101A | ΔDBmin 101B | ΔLogE 101A | ΔLogE 101B | Remarks |
|---|---|---|---|---|---|---|---|---|---|---|
| 9 | 375 | 125 | 25 | 255 | 1.0 (1.0) | −0.04 | −0.05 | −0.08 | −0.09 | " |
| 10 | 375 | 125 | 25 | 340 | 1.33 (0.75) | +0.15 | +0.15 | +0.15 | +0.16 | " |

Note:
1. The mixing ratio is the ratio (%) by number of 101B in all processed rolls.
2. The concentration of the replenisher is shown by the concentration ratio to the standard replenisher; the numeral in ( ) is the amount of replenisher prepared from the standard replenishing agent in a formulation amount of 1 L.

As seen from Table I-5, in Tests 2 to 5 using the replenishing method of the present invention, both the bromide ion concentration and the color developing agent concentration were kept in respective allowable ranges. In other words, the high silver bromide Sample 101A and the high silver chloride Sample 101B both underwent almost no change in the photographic properties during the running test and could stably exhibit the capability similarly to Test 1. On the other hand, as shown in Tests 6, 7 and 8 for comparison, when the replenishing amount and the concentration of the replenisher were not changed, the minimum density (Dmin) and the sensitivity greatly changed. Furthermore, as shown in Test 9, when only the replenishing amount was changed, two kinds of films could not be processed in mixture. Also, as shown in Test 10, when only the concentration of the replenisher was changed, the capability could not be maintained.

The minimum density (Dmin) was measured by the blue filter optical density (DBmin) because of its most outstanding appearance, but the value thereof is referred to as "Dmin" following the common use.

Example I-2

Tests 11 to 20 were performed under the same conditions as in Tests 1 to 10 of Example I-1 except for changing the film of Example I-1 to the film 102A or 102B using a TAC support. The results were the same as in Example I-1. That is, under the conditions of the present invention (Tests 12 to 15 corresponding to Tests 2 to 5), the minimum density (Dmin) and the sensitivity both were within their allowable ranges, and under the conditions of Comparative Examples (Tests 16 to 20 corresponding to Tests 6 to 10), the minimum density (Dmin) and the sensitivity greatly fluctuated from respective standards.

Example I-3

According to Example I-1, Samples 101A, 101B, 101C and 101D were processed in mixture. Samples 101B, 101C and 101D are described together in the portion referring to the emulsion structure of Example I-1. A running test was performed in the same manner as in Example I-1 except for changing the mixing ratio of these samples as shown in Table I-6 and also changing the replenishing amount and the replenisher concentration as shown in Table I-6. Then, changes in the minimum density and the sensitivity were determined. The results are also shown together in Table I-6.

As seen from these results, even when the material was changed to the high silver chloride light-sensitive material (samples of film B type), in all of Tests 22 to 24 according to the method of the present invention, the running capability could be stably obtained. Particularly, most referred results could be obtained in Sample 101B comprising tabular grains having (100) faces. On the other hand, in Comparative Examples (Tests 25 to 28) where the replenishing amount and the concentration of the replenisher were not changed or only the replenishing amount was changed, the minimum density (Dmin) or the sensitivity greatly fluctuated from the standard. Test 21 is a reference test where only Sample 101A was developed and the results in Table I-6 are shown relatively to the characteristic values obtained in Test 21.

TABLE I-6

| Test | Processed Amount (rolls) 101A | 101B | 101C | 101D | Replenisher Replenishing Amount (ml/m²) | Concentration | Photographic Properties ΔDBmin 101A | ΔDBmin 101B | ΔDBmin 101C | ΔDBmin 101D | ΔLogE 101A | ΔLogE 101B | ΔLogE 101C | ΔLogE 101D | Remarks |
|---|---|---|---|---|---|---|---|---|---|---|---|---|---|---|---|
| 21 | 500 | — | — | — | 340 | 1.0 | 0 | — | — | — | 0 | — | — | — | Reference Example |
| 22 | 375 | 125 | — | — | 255 | 1.33 | −0.01 | −0.01 | — | — | 0 | −0.01 | — | — | Invention |
| 23 | 375 | — | 125 | — | " | " | −0.01 | — | −0.03 | — | 0 | — | −0.03 | — | " |
| 24 | 375 | — | — | 125 | " | " | −0.01 | — | — | −0.03 | 0 | — | — | −0.03 | " |
| 25 | 375 | — | 125 | — | 340 | 1.0 | +0.08 | — | +0.07 | — | +0.08 | — | — | — | Comparison |
| 26 | 375 | — | 125 | — | 255 | 1.0 | −0.04 | — | −0.05 | — | −0.08 | — | +0.09 −0.10 | — | " |

TABLE I-6-continued

| | Processed Amount (rolls) | | | | Replenisher | | Photographic Properties | | | | | | | | |
|---|---|---|---|---|---|---|---|---|---|---|---|---|---|---|---|
| | | | | | Reple-nishing | | ΔDBmin | | | | ΔLogE | | | | |
| Test | 101A | 101B | 101C | 101D | Amount (ml/m²) | Concen-tration | 101A | 101B | 101C | 101D | 101A | 101B | 101C | 101D | Remarks |
| 27 | 375 | — | — | 125 | 340 | 1.0 | +0.08 | — | — | +0.08 | +0.08 | — | — | +0.10 | " |
| 28 | 375 | — | — | 125 | 255 | 1.0 | −0.04 | — | — | −0.05 | −0.08 | — | — | −0.11 | " |

Note:
1. The replenisher concentration is shown by a concentration ratio to the base replenisher.

According to the development processing method of the present invention, at the processing of a high silver bromide emulsion-containing color photographic light-sensitive material and a high silver chloride emulsion-containing color photographic light-sensitive material with a common color developer, both the concentration of the replenisher and the replenishing amount are changed according to the mixing ratio of the high silver chloride emulsion-containing color photographic light-sensitive material, so that the processing in mixture can be performed without changing the chemical composition of the developer replenisher and with no or small modification of the development processing apparatus, while maintaining the photographic properties of both types of the color light-sensitive materials.

Therefore, the development processing chemicals or mixed processing agents heretofore used can be continuously used and the development operation can be stably performed without increasing the load of the development control.

Example II-1

Using Sample 101A described in Example 1 of JP-A-9-204030 as a high silver bromide light-sensitive material and Sample 101B described in Example 1 of JP-A-9-204030 as a high silver chloride light-sensitive material, two types of light-sensitive materials were processed with a processing solution F1/C-41SM or F2/C-41SM produced by Eastman Kodak through the processing steps described in Example 1 of JP-A-9-204030 in a film processor QSF-V30SM manufactured by Noritsu Koki K. K. The replenishment control of the replenisher was performed in such a way that according to the contents in the above-described practical embodiments, with the increase of the mixing ratio (processing ratio of the high silver chloride light-sensitive material) to 5%, 15%, 25% and 50%, the replenisher and water were supplied by increasing the concentration of the replenisher and decreasing the replenishing amount of water (Tests 2, 3, 4 and 5). For comparison, the processing was performed by supplying the replenisher without changing at least either one of the replenishing amount and the replenisher concentration (Tests 6, 7, 8, 9 and 10). This is more specifically described below.

Development Test and Evaluation of Photographic Properties

Using the samples prepared above, a portrait was taken by a camera for use in the processing in a running test, namely, a test of continuously developing a large amount of light-sensitive material. Furthermore, in order to evaluate the photographic properties, a sensitometry sample was prepared by exposing a light-sensitive material at a color temperature of 4800 K and 20 cms through a gray optical wedge for the sensitometry. Then, a continuous processing was performed using the processing steps described in Example 1 of JP-A-9-204030 supra while replenishing the solution by a film processor QSF-V30SM manufactured by Noritsu Koki K. K. The development processing was performed using Fl/C-41SM or F2/C-41SM produced by Eastman Kodak as the standard formulation while varying the replenishing amount and the concentration of the replenisher according to the mixing ratio of the high silver chloride light-sensitive materials (Sample 101B) as shown in Table II-1. The development processing performed was a so-called running processing and 500 rolls in total of Sample 101A and Sample 101B were processed. The finish photographic properties were examined by the sensitometry during the stationary operation of continuously developing a large amount of light-sensitive material as in actual processing. The sensitometry was performed in such a way that the density of the developed sensitometry sample was measured by a densitometer in accordance with the International Standard (ISO 5-2 and ISO 5-3) and the sensitivity and the minimum density (Dmin) were measured according to the sensitometry method for color negative films provided in the International Standard (ISO 5800).

TABLE II-1

| | Processed Amount | | | Replenisher | | Photographic Properties | | | | |
|---|---|---|---|---|---|---|---|---|---|---|
| | | | | | Concentration | ΔDBmin | | ΔLogE | | |
| Test | 101A (rolls) | 101B (rolls) | Mixing Ratio (%) | Replenishing Amount (ml/m²) | (amount of prepared liquid, L) | 101A | 101B | 101A | 101B | Remarks |
| 1 | 500 | 0 | 0 | 368 | 1.0 (1.01) | 0 | — | 0 | — | Reference Example |
| 2 | 475 | 25 | 5 | 350 | 1.05 (0.95) | 0 | −0.01 | −0.01 | −0.02 | Invention |
| 3 | 425 | 75 | 15 | 313 | 1.18 (0.85) | 0 | 0 | 0 | −0.01 | " |

TABLE II-1-continued

| | Processed Amount | | | Replenisher | | Photographic Properties | | | | |
|---|---|---|---|---|---|---|---|---|---|---|
| | | | | | Concentration | | | | | |
| | | | Mixing | Replenishing | (amount of | | | | | |
| | 101A | 101B | Ratio | Amount | prepared | ΔDBmin | | ΔLogE | | |
| Test | (rolls) | (rolls) | (%) | (ml/m$^2$) | liquid, L) | 101A | 101B | 101A | 101B | Remarks |
| 4 | 375 | 125 | 25 | 276 | 1.33 (0.75) | −0.01 | −0.01 | 0 | 0 | " |
| 5 | 250 | 250 | 50 | 276 | 1.33 (0.75) | +0.02 | +0.02 | +0.03 | +0.03 | " |
| 6 | 425 | 75 | 15 | 368 | 1.0 (1.0) | +0.04 | +0.05 | +0.06 | +0.07 | Comparison |
| 7 | 375 | 125 | 25 | 368 | 1.0 (1.0) | +0.07 | +0.06 | +0.07 | +0.08 | " |
| 8 | 250 | 250 | 50 | 368 | 1.0 (1.0) | +0.11 | +0.10 | +0.12 | +0.12 | " |
| 9 | 375 | 125 | 25 | 276 | 1.0 (1.0) | −0.04 | −0.04 | −0.07 | −0.08 | " |
| 10 | 375 | 125 | 25 | 368 | 1.33 (0.75) | +0.13 | +0.13 | +0.13 | +0.14 | " |

Note:
1. The mixing ratio is the ratio (%) by number of 101B in all processed rolls.
2. The concentration of the replenisher is shown by the concentration ratio to the standard replenisher; the numeral in ( ) is the amount of replenisher prepared from the standard replenishing agent in a formulation amount of 1 L.

Sample 101A using the high silver bromide emulsion and Sample 101B using the high silver chloride emulsion were processed in mixture by varying the ratio therebetween as shown in Table II-1. The change in the photographic properties was examined by developing the sensitometry sample prepared above at the start and at the end of the running test and shown by the change in the yellow minimum density (ΔDBmin) and the change in the magenta sensitivity (ΔlogE).

For the developer replenisher, a standard developer according to the formulation designed for the processing of Sample 101A described in Example II-1 of JP-A-9-204030 was used as a base and in the test, the replenishing amount and the concentration of the replenisher were changed to various levels shown in Table II-1. The evaluation results of the developed sensitometry sample obtained are shown together in Table II-1.

In Table II-1, Test 1 where Sample 101A was processed under the standard development conditions was the control for each of Sample 101B and Sample 101A, and the evaluation results are shown relatively to the evaluation values of this sample.

The results are shown in Table II-1. In Table II-1, the minimum density (Dmin) was measured by the blue filter optical density (DBmin) because of its most outstanding appearance, but the value thereof is referred to as "Dmin" following the common use.

As apparent from the results in Table II-1, according to the replenishing method of the present invention, the high silver bromide Sample 101A and the high silver chloride Sample 101B both underwent almost no change in the photographic properties during the running test and could stably exhibit the capability similarly to Test 1. On the other hand, as shown in Tests 6, 7 and 8 for comparison, when the replenishing amount and the concentration of the replenisher were not changed, the minimum density (Dmin) and the sensitivity greatly changed. Furthermore, as shown in Test 9, when only the replenishing amount was changed, two kinds of films could not be processed in mixture. Also, as shown in Test 10, when only the concentration of the replenisher was changed, the capability could not be maintained.

According to the present invention, even when light-sensitive materials different in the silver halide composition of the emulsion are processed in mixture, both types of the light-sensitive materials can have stable photographic properties. Therefore, the processing agents and the development processing apparatuses heretofore used can be commonly used and at the same time, the processing can be performed with a small load on the modification of the development processing apparatus.

Example III-1

Using Sample 101A described in Example 1 of JP-A-9-204030 as a high silver bromide light-sensitive material and Sample 101B described in Example 1 of JP-A-9-204030 as a high silver chloride light-sensitive material, two types of light-sensitive materials were processed with a processing solution ECOJET-N Type K-JIN-02 produced by Konica Corp. through the processing steps described in JP-A-5-107712 in a film processor CL-NPV30J manufactured by Konica Corp. The replenishment control of the diluting water was performed in such a way that according to the contents in the above-described practical embodiments, with the increase of the mixing ratio (processing ratio of the high silver chloride light-sensitive material) to 5%, 15%, 25% and 50%, the replenisher was supplied by decreasing the replenishing amount of water and increasing the concentration of the replenisher (Tests 2, 3, 4 and 5). For comparison, the processing was performed by supplying the replenisher without changing at least either one of the replenishing amount and the replenisher concentration (Tests 6, 7, 8, 9 and 10). This is more specifically described below.

Development Test and Evaluation of Photographic Properties

Using the samples prepared above, a portrait was taken by a camera for use in the processing in a running test, namely, a test of continuously developing a large amount of light-sensitive material. Furthermore, in order to evaluate the photographic properties, a sensitometry sample was prepared by exposing a light-sensitive material at a color temperature of 4800 K and 20 cms through a gray optical wedge for the sensitometry. Then, a continuous processing was performed using the processing steps described in JP-A-5-107712 while replenishing the solution by a film processor CL-NPV30J manufactured by Konica Corp. The development processing was performed using ECOJET-N Type K-JIN-02 produced by Konica Corp. as the standard formulation while varying the replenishing amount and the concentration of the replenisher according to the mixing ratio of the high silver chloride light-sensitive materials (Sample 101B) as shown in Table III-1. The development processing performed was a so-called running processing and 500 rolls in total of Sample 101A and Sample 101B were processed. The finish photographic properties were examined by the sensitometry during the stationary operation of continuously developing a large amount of light-sensitive material as in actual processing. The sensitometry was performed in such a way that the density of the developed sensitometry sample was measured by a densitometer in accordance with the International Standard (ISO 5-2 and ISO 5-3) and the sensitivity and the minimum density (Dmin) were measured according to the sensitometry method for color negative films provided in the International Standard (ISO 5800).

replenishing amount and the concentration of the replenisher were not changed, the minimum density (Dmin) and the sensitivity greatly changed. Furthermore, as shown in Test 9, when only the replenishing amount was changed, two kinds of films could not be processed in mixture. Also, as shown in Test 10, when only the concentration of the replenisher was changed, the capability could not be maintained.

According to the present invention, even when light-sensitive materials different in the silver halide composition of the emulsion are processed in mixture, both types of the light-sensitive materials can have stable photographic properties. Therefore, the solid processing agents and the development processing apparatuses heretofore used can be commonly used and at the same time, the processing can be performed with a small load on the modification of the

TABLE III-1

| | Processed Amount | | | Replenisher | | Photographic Properties | | | | |
|---|---|---|---|---|---|---|---|---|---|---|
| | | | | | Concentration | ΔDBmin | | ΔLogE | | |
| Test | 101A (rolls) | 101B (rolls) | Mixing Ratio (%) | Replenishing Amount (ml/m$^2$) | (amount of prepared liquid, L) | 101A | 101B | 101A | 101B | Remarks |
| 1 | 500 | 0 | 0 | 490 | 1.0 (1.01) | 0 | — | 0 | — | Reference Example |
| 2 | 475 | 25 | 5 | 466 | 1.05 (0.95) | −0.01 | −0.01 | −0.02 | −0.01 | Invention |
| 3 | 425 | 75 | 15 | 416 | 1.18 (0.85) | 0 | 0 | 0.01 | 0 | " |
| 4 | 375 | 125 | 25 | 368 | 1.33 (0.75) | −0.01 | 0 | 0 | 0.01 | " |
| 5 | 250 | 250 | 50 | 245 | 1.33 (0.75) | +0.02 | +0.02 | +0.03 | +0.04 | " |
| 6 | 425 | 75 | 15 | 490 | 1.0 (1.0) | +0.05 | +0.05 | +0.05 | +0.07 | Comparison |
| 7 | 375 | 125 | 25 | 490 | 1.0 (1.0) | +0.08 | +0.08 | +0.07 | +0.10 | " |
| 8 | 250 | 250 | 50 | 490 | 1.0 (1.0) | +0.11 | +0.09 | +0.10 | +0.12 | " |
| 9 | 375 | 125 | 25 | 368 | 1.0 (1.0) | −0.05 | −0.06 | −0.08 | −0.10 | " |
| 10 | 375 | 125 | 25 | 490 | 1.33 (0.75) | +0.13 | +0.13 | +0.14 | +0.15 | " |

Note:
1. The mixing ratio is the ratio (%) by number of 101B in all processed rolls.
2. The concentration of the replenisher is shown by the concentration ratio to the standard replenisher; the numeral in ( ) is the amount of replenisher prepared from the standard replenishing agent in a formulation amount of 1 L.

Sample 101A using the high silver bromide emulsion and Sample 101B using the high silver chloride emulsion were processed in mixture by varying the ratio therebetween as shown in Table III-1. The change in the photographic properties was examined by developing the sensitometry sample prepared above at the start and at the end of the running test and shown by the change in the yellow minimum density (ΔDBmin) and the change in the magenta sensitivity (ΔlogE).

In Table III-1, Test 1 where Sample 101A was processed under the standard development conditions was the control for each of Sample 101B and Sample 101A, and the evaluation results are shown relatively to the evaluation values of this sample.

The results are shown in Table III-1. In Table III-1, the minimum density (Dmin) was measured by the blue filter optical density (DBmin) because of its most outstanding appearance, but the value thereof is referred to as "Dmin" following the common use.

As apparent from the results in Table III-1, according to the replenishing method of the present invention, the high silver bromide Sample 101A and the high silver chloride Sample 101B both underwent almost no change in the photographic properties during the running test and could stably exhibit the capability similarly to Test 1. On the other hand, as shown in Tests 6, 7 and 8 for comparison, when the development processing apparatus. Furthermore, the processing can be satisfactorily performed even in a development processing apparatus where a solid processing agent and water are supplied directly to a developing tank.

Example IV-1

Using Sample 101A described in Example 1 of JP-A-9-204030 as a high silver bromide light-sensitive material and Sample 101B described in Example 1 of JP-A-9-204030 as a high silver chloride light-sensitive material, two types of light-sensitive materials were processed with a processing solution CN-16S through the processing steps described in Example 1 of JP-A-9-204030 in a film processor FP-363CS manufactured by Fuji Photo Film Co., Ltd. The replenishment control of the replenisher was performed in such a way that according to the contents in the above-described practical embodiments, with the increase of the mixing ratio (processing ratio of the high silver chloride light-sensitive material) to 5%, 15%, 25% and 50%, the replenisher was supplied by increasing the concentration of the replenisher and decreasing the replenishing amount of the replenisher (Tests 2, 3, 4 and 5). For comparison, the processing was performed by supplying the replenisher without changing at least either one of the replenishing amount and the replenisher concentration (Tests 6, 7, 8, 9 and 10). This is more specifically described below.

Development Test and Evaluation of Photographic Properties

Using the samples prepared above, a portrait was taken by a camera for use in the processing in a running test, namely, a test of continuously developing a large amount of light-sensitive material. Furthermore, in order to evaluate the photographic properties, a sensitometry sample was prepared by exposing a light-sensitive material at a color temperature of 4800 K and 20 cms through a gray optical wedge for the sensitometry. Then, a continuous processing was performed using the processing steps described in Example 1 of JP-A-9-204030 supra while replenishing the solution by a film processor FP-363SC manufactured by Fuji Photo Film Co., Ltd. The development processing was performed using a developer CN-16S produced by Fuji Photo Film Co., Ltd. as the standard formulation while varying the replenishing amount and the concentration of the replenisher according to the mixing ratio of the high silver chloride light-sensitive materials (Sample 101B) as shown in Table IV-1. The development processing performed was a so-called running processing and 500 rolls in total of Sample 101A and Sample 101B were processed. The finish photographic properties were examined by the sensitometry during the stationary operation of continuously developing a large amount of light-sensitive material as in actual processing. The sensitometry was performed in such a way that the density of the developed sensitometry sample was measured by a desitometer in accordance with the International Standard (ISO 5-2 and ISO 5-3) and the sensitivity and the minimum density (Dmin) were measured according to the sensitometry method for color negative films provided in the International Standard (ISO 5800).

For the developer replenisher, a standard developer according to the formulation described in JP-A-9-204030 designed for the processing of Sample 101A was used as a base and in the test, the replenishing amount and the concentration of the replenisher were changed to various levels shown in Table IV-1. The evaluation results of the developed sensitometry sample obtained are shown together in Table IV-1.

In Table IV-1, Test 1 where Sample 101A was processed under the standard development conditions was the control for each of Sample 101B and Sample 101A, and the evaluation results are shown relatively to the evaluation values of this sample.

The results are shown in Table IV-1. In Table IV-1, the minimum density (Dmin) was measured by the blue filter optical density (DBmin) because of its most outstanding appearance, but the value thereof is referred to as "Dmin" following the common use.

As apparent from the results in Table IV-1, according to the replenishing method of the present invention, the high silver bromide Sample 101A and the high silver chloride Sample 101B both underwent almost no change in the photographic properties during the running test and could stably exhibit the capability similarly to Test 1. On the other hand, as shown in Tests 6, 7 and 8 for comparison, when the replenishing amount and the concentration of the replenisher were not changed, the minimum density (Dmin) and the sensitivity greatly changed. Furthermore, as shown in Test 9, when only the replenishing amount was changed, two kinds of films could not be processed in mixture. Also, as shown in Test 10, when only the concentration of the replenisher was changed, the capability could not be maintained.

TABLE IV-1

| | Processed Amount | | | Replenisher | | Photographic Properties | | | | |
|---|---|---|---|---|---|---|---|---|---|---|
| | | | | | | ΔDBmin | | ΔLogE | | |
| Test | 101A (rolls) | 101B (rolls) | Mixing Ratio (%) | Replenishing Amount ($ml/m^2$) | Concentration (amount of prepared liquid, L) | 101A | 101B | 101A | 101B | Remarks |
| 1 | 500 | 0 | 0 | 368 | 1.0 (1.01) | 0 | — | 0 | — | Reference Example |
| 2 | 475 | 25 | 5 | 323 | 1.05 (0.95) | −0.01 | −0.01 | −0.01 | −0.01 | Invention |
| 3 | 425 | 75 | 15 | 289 | 1.18 (0.85) | 0 | 0 | −0.01 | 0 | " |
| 4 | 375 | 125 | 25 | 255 | 1.33 (0.75) | −0.01 | −0.01 | 0 | 0 | " |
| 5 | 250 | 250 | 50 | 170 | 1.33 (0.75) | +0.02 | +0.02 | +0.03 | +0.04 | " |
| 6 | 425 | 75 | 15 | 340 | 1.0 (1.0) | +0.05 | +0.05 | +0.07 | +0.08 | Comparison |
| 7 | 375 | 125 | 25 | 340 | 1.0 (1.0) | +0.07 | +0.07 | +0.09 | +0.10 | " |
| 8 | 250 | 250 | 50 | 340 | 1.0 (1.0) | +1.12 | +0.09 | +0.12 | +0.12 | " |
| 9 | 375 | 125 | 25 | 255 | 1.0 (1.0) | −0.04 | −0.05 | −0.07 | −0.08 | " |
| 10 | 375 | 125 | 25 | 340 | 1.33 (0.75) | +0.13 | +0.15 | +0.15 | +0.14 | " |

Note:
1. The mixing ratio is the ratio (%) by number of 101B in all processed rolls.
2. The concentration of the replenisher is shown by the concentration ratio to the standard replenisher; the numeral in ( ) is the amount of replenisher prepared from the standard replenishing agent in a formulation amount of 1 L.

Sample 101A using the high silver bromide emulsion and Sample 101B using the high silver chloride emulsion were processed in mixture by varying the ratio therebetween as shown in Table IV-1. The change in the photographic properties was examined by developing the sensitometry sample prepared above at the start and at the end of the running test and shown by the change in the yellow minimum density (ΔDBmin) and the change in the magenta sensitivity (ΔlogE).

According to the present invention, even when light-sensitive materials different in the silver halide composition of the emulsion are processed in mixture, both types of the light-sensitive materials can have stable photographic properties. Therefore, the processing agents and the development processing apparatuses heretofore used can be commonly used and at the same time, the processing can be performed with a small load on the modification of the development processing apparatus. Furthermore, the processing can be satisfactorily performed even in a development processing apparatus where a mixed processing agent for the developer replenisher is dissolved in or diluted with water to prepare a developer replenisher and the replenisher is supplied to a developing tank.

While the invention has been described in detail and with reference to specific embodiments thereof, it will be apparent to one skilled in the art that various changes and modifications can be made therein without departing from the spirit and scope thereof.

What is claimed is:

1. An apparatus for processing silver halide color photographic light-sensitive materials, which processes a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, said apparatus comprising a developing tank for storing a developer, a thick replenisher feeding means for feeding a thick replenisher directly to said developing tank, a diluting water feeding means for feeding a diluting water for diluting said thick replenisher to said developing tank, a processed amount setting means for setting respective processed amounts of said light-sensitive materials, and a diluting water feeding controlling means for changing the feeding amount of said diluting water to change both the concentration of said developer replenisher and the replenishing amount of said developer replenisher per a unit processing area according to respective processed amounts of said light-sensitive materials.

2. An apparatus for processing silver halide color photographic light-sensitive materials, which processes a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, said apparatus comprising a developing tank for storing a developer, a solid processing agent feeding means for feeding a solid processing agent at predetermined intervals to said developing tank, a diluting water feeding means for feeding a diluting water for dissolving said solid processing agent to said developing tank, a processed amount setting means for setting respective processed amounts of said light-sensitive materials, and a replenishment controlling means for changing the charging interval of the solid processing agent and/or the feeding amount of said diluting water to substantially change both the replenishing amount and the concentration of said replenisher according to the processing ratio between said two types of light-sensitive materials.

3. An apparatus for processing silver halide color photographic light-sensitive materials, which processes a silver halide color photographic light-sensitive material A for photographing containing a high silver bromide emulsion having a silver bromide content of 50 to 100 mol % and a silver halide color photographic light-sensitive material B for photographing containing a high silver chloride emulsion having a silver chloride content of from 50 to 100 mol % with a common color developer, said apparatus comprising a developing tank for storing a developer, a solid processing agent feeding means for feeding a solid processing agent at predetermined intervals to said developing tank, a diluting water feeding means for feeding a diluting water for dissolving said solid processing agent to said developing tank, a processed amount setting means for setting respective processed amounts of said light-sensitive materials, and a replenishment controlling means for changing the feeding amount of said diluting water per a unit processing area to substantially change both the replenishing amount and the concentration of said replenisher according to the processing ratio between said two types of light-sensitive materials.

4. An apparatus for processing silver halide color photographic light-sensitive materials, which processes a silver halide color photographic light-sensitive material A for photographing containing a high silver bromide emulsion having a silver bromide content of from 50 to 100 mol % and a silver halide color photographic light-sensitive material B for photographing containing a high silver chloride emulsion having a silver chloride content of from 50 to 100 mol % with a common color developer, said apparatus comprising a developing tank for storing a developer, a replenisher tank for storing a developer replenisher, a reservoir tank for storing water for dissolving or diluting a mixed processing agent for the developer replenisher supplied to said replenisher tank, a water feeding means for feeding said water to said replenisher tank, a processed amount setting means for setting respective processed amounts of said light-sensitive materials, and a replenishment controlling means for changing both the amount of said water supplied to said replenisher tank and the replenishing amount of said replenisher per a unit processing area at the mixing of the replenisher to change both the concentration and the replenishing amount of said developer replenisher according to respective processed amounts of said light-sensitive materials.

* * * * *